US010777143B2

(12) United States Patent
Ban et al.

(10) Patent No.: US 10,777,143 B2
(45) Date of Patent: Sep. 15, 2020

(54) GATE DRIVER AND DISPLAY DEVICE INCLUDING THE SAME

(71) Applicant: LG Display Co., Ltd., Seoul (KR)

(72) Inventors: Myungho Ban, Paju-si (KR); Inhyo Han, Paju-si (KR); Seok Noh, Paju-si (KR); Kimin Son, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/548,761

(22) Filed: Aug. 22, 2019

(65) Prior Publication Data

US 2020/0074933 A1 Mar. 5, 2020

(30) Foreign Application Priority Data

Aug. 31, 2018 (KR) ..... 10-2018-0103840

(51) Int. Cl.

| | |
|---|---|
| ***G09G 3/3266*** | (2016.01) |
| ***G09G 3/3233*** | (2016.01) |
| ***G09G 3/3283*** | (2016.01) |
| ***G09G 3/3291*** | (2016.01) |
| ***G09G 3/3258*** | (2016.01) |

(52) U.S. Cl.

CPC ..... *G09G 3/3266* (2013.01); *G09G 3/3233* (2013.01); *G09G 3/3258* (2013.01); *G09G 3/3283* (2013.01); *G09G 3/3291* (2013.01); *G09G 2300/0842* (2013.01)

(58) Field of Classification Search

CPC .. G09G 3/3258; G09G 3/3291; G09G 3/3233; G09G 3/3266; G09G 3/3283; G09G 2310/08; G09G 2320/0295; G09G 2300/0819; G09G 2310/0205; G09G 2310/0286; G09G 2300/0842

See application file for complete search history.

(56) References Cited

U.S. PATENT DOCUMENTS

| | | | | |
|---|---|---|---|---|
| 2002/0149606 | A1* | 10/2002 | Kubota | G09G 3/3648 345/690 |
| 2005/0206969 | A1* | 9/2005 | Murade | G09G 3/3688 358/474 |
| 2017/0061869 | A1* | 3/2017 | Bae | G09G 3/3275 |
| 2017/0162122 | A1* | 6/2017 | In | G09G 3/3266 |
| 2017/0249916 | A1* | 8/2017 | Jen | H01L 27/1255 |

FOREIGN PATENT DOCUMENTS

KR 10-2017-0135378 A 12/2017

* cited by examiner

*Primary Examiner* — Shaheda A Abdin
(74) *Attorney, Agent, or Firm* — Polsinelli PC

(57) ABSTRACT

A gate driver includes a gate shift register in which an A block and a B block each having a plurality of stages, the A block and the B block being alternately arranged; scan clock lines inputting a first scan clock group and a second scan clock group each including both image data writing (IDW) scan clocks synchronized with an image write timing and black data insertion (BDI) scan clocks synchronized with a black write timing to the A block and the B block; and carry clock lines inputting carry clocks to the A block and the B block and sense clock lines inputting sense clocks to the A block and the B block, wherein each of the stages belonging to the A block and the B block includes a BDI memory storing a BDI carry signal for outputting the BDI scan clocks.

23 Claims, 26 Drawing Sheets

FIG. 11

| | PRIOR ART | EMBODIMENT 1 | EMBODIMENT 2 | EMBODIMENT 3 |
|---|---|---|---|---|
| Concept | CLK(48ea) S/R | CLK(38ea) S/R BDI Memory | CLK(32ea) DATA Memory S/R BDI Memory | CLK(31ea) DATA Memory S/R BDI Memory |
| CLK number (for Data, for BDI) | SC(8, 8)/SE(8, 8)/CR(8, 8) | SC(8, 8)/SE(8, 0)/CR(8, 0) | SC(8, 0)/SE(8, 0)/CR(8, 0) | SC(8, 0)/SE(8, 0)/CR(8, 0) |
| ADDITIONAL BLOCK CONFIGURATION | – | BDI Memory | BDI Memory<br>Video Data Memory | BDI Memory<br>Video Data Memory<br>BRST(1) SIGNAL →<br>REPLACED WITH BCLK |
| BDI CONTROL SIGNAL | – | BVST(1), BRST(1), BCLK(4) | BVST(1), BRST(1), BCLK(6) | BVST(1), BCLK(6) |

GATE DRIVER AND DISPLAY DEVICE INCLUDING THE SAME

CROSS REFERENCE TO RELATED APPLICATION

This application claims the benefit of Korea Patent Application No. 10-2018-0103840 filed on Aug. 31, 2018, which is hereby incorporated by reference in its entirety.

BACKGROUND

Field of the Disclosure

The present document relates to a display device, and more particularly, to a gate driver and a display device including the same.

Description of the Background

Display devices have widely been used in portable computers such as notebook computers or personal digital assistants (PDAs), or mobile terminals, and the like, as well as in monitors of desktop computers due to advantages of compactness and light weight. Such display devices include a liquid crystal display (LCD), a plasma display panel (PDP), an organic light display device, and the like. In particular, an active matrix type organic light emitting display device includes a self-luminous organic light emitting diode (OLED) and has a high response speed, high luminous efficiency, high brightness, and a wide viewing angle.

Recently, a technique of inserting a black image in order to shorten a motion picture response time (MPRT) in an organic light emitting display has been proposed. The black image insertion technique aims at effectively erasing an image of a previous frame by displaying a black image between neighboring image frames.

SUMMARY

In an existing black image insertion technique, a clock signal for writing an input image and a clock signal for writing a black image are supplied to a gate shift register through different clock lines, and a scan signal and a sense signal required for driving are generated through separate gate shift registers, thus causing a bezel region of a display panel to increase due to an increase in the number of clock lines and the gate shift registers.

In addition, in the existing black image insertion technique, a black image is inserted after an input image corresponding to the quantity of one screen is entirely written, and thus, one frame time is long, which is inappropriate for high speed driving.

In addition, in the existing black image insertion technique, since a black image is sequentially written in units of one pixel line, a long time is spared for writing the black image in one frame and a charge time of the input image is insufficient as much.

The present disclosure provides a gate driver and a display device including the gate driver, capable of implementing a narrow bezel in improving a motion picture response speed by inserting a black image.

The present disclosure also provides a gate driver and a display device including the same, which are optimized for high-speed driving and solving a problem of insufficient charge time for an input image in improving a motion picture response speed by inserting a black image.

In an aspect, a gate driver includes: a gate shift register in which an A block and a B block each having a plurality of stages, the A block and the B block being alternately arranged; scan clock lines inputting a first scan clock group and a second scan clock group each including both image data writing (IDW) scan clocks synchronized with an image write timing and black data insertion (BDI) scan clocks synchronized with a black write timing to the A block and the B block; and carry clock lines inputting carry clocks to the A block and the B block and sense clock lines inputting sense clocks to the A block and the B block, wherein the number of the carry clock lines and the number of the sense clock lines are half of the number of the scan clock lines, and each of the stages belonging to the A block and the B block includes a BDI memory storing a BDI carry signal for outputting the BDI scan clocks.

In another aspect, a gate driver includes: a gate shift register in which an A block, a B block, and a C block each having a plurality of stages, the A block and the B block and the C block being alternately arranged; scan clock lines inputting a scan clock group including both image data writing (IDW) scan clocks synchronized with an image write timing and black data insertion (BDI) scan clocks synchronized with a black write timing to the A block, the B block, and the C block; and carry clock lines inputting carry clocks to the A block, the B block, and the C block and sense clock lines inputting sense clocks to the A block, the B block, and the C block, wherein the number of scan clock lines, the number of the carry clock lines, and the number of the sense clock lines are equal, and each of the stages belonging to the A block, the B block, and the C block includes a BDI memory storing a BDI carry signal for outputting the BDI scan clocks and a data memory storing an IDW carry signal for outputting IDW scan clocks.

BRIEF DESCRIPTION OF THE DRAWINGS

The accompanying drawings, which are included to provide a further understanding of the disclosure and are incorporated in and constitute a part of the disclosure, illustrate aspects of the disclosure and together with the description serve to explain the principle of the disclosure.

In the drawings.

Figure 12:
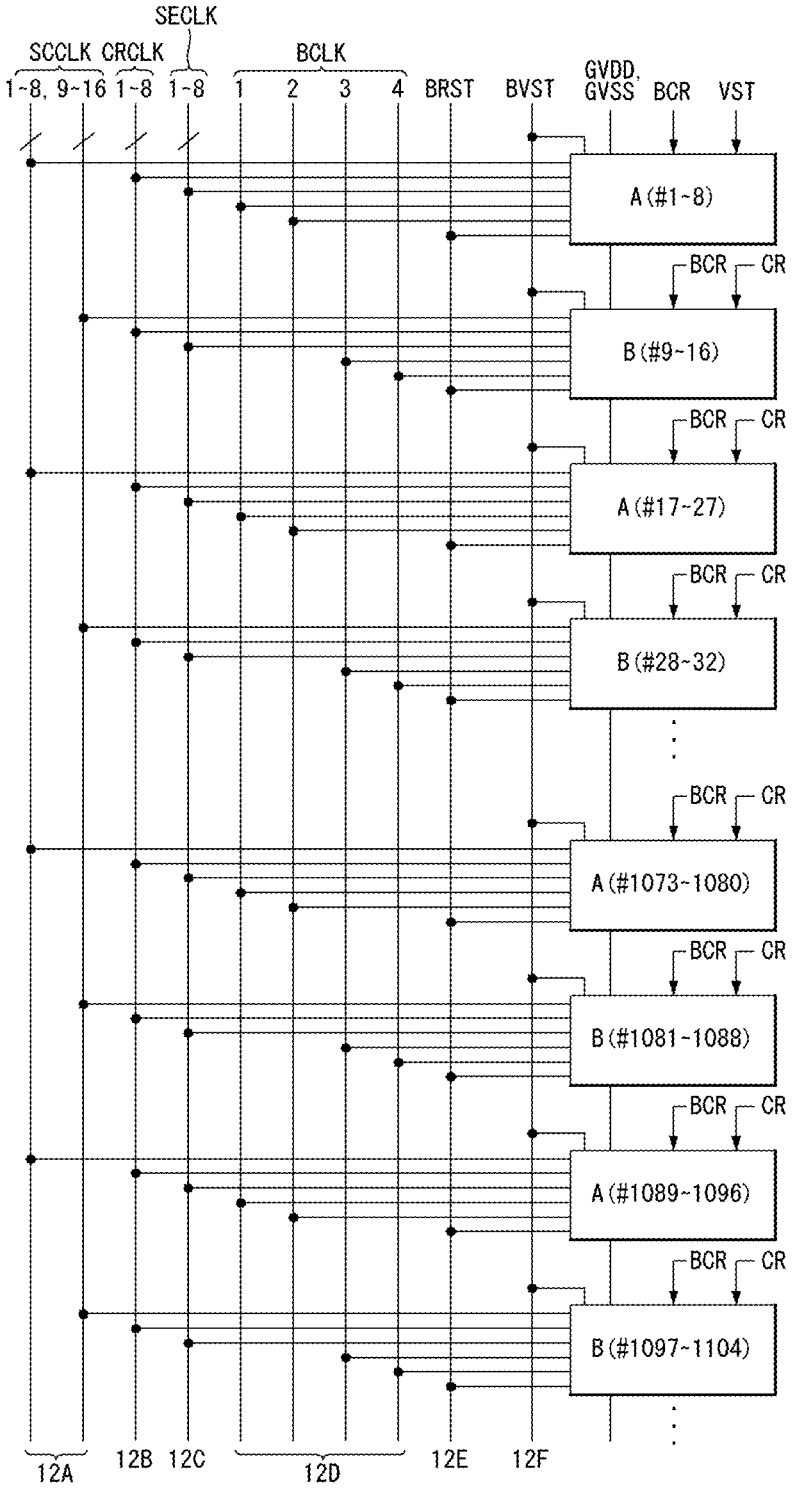
Figure 13:
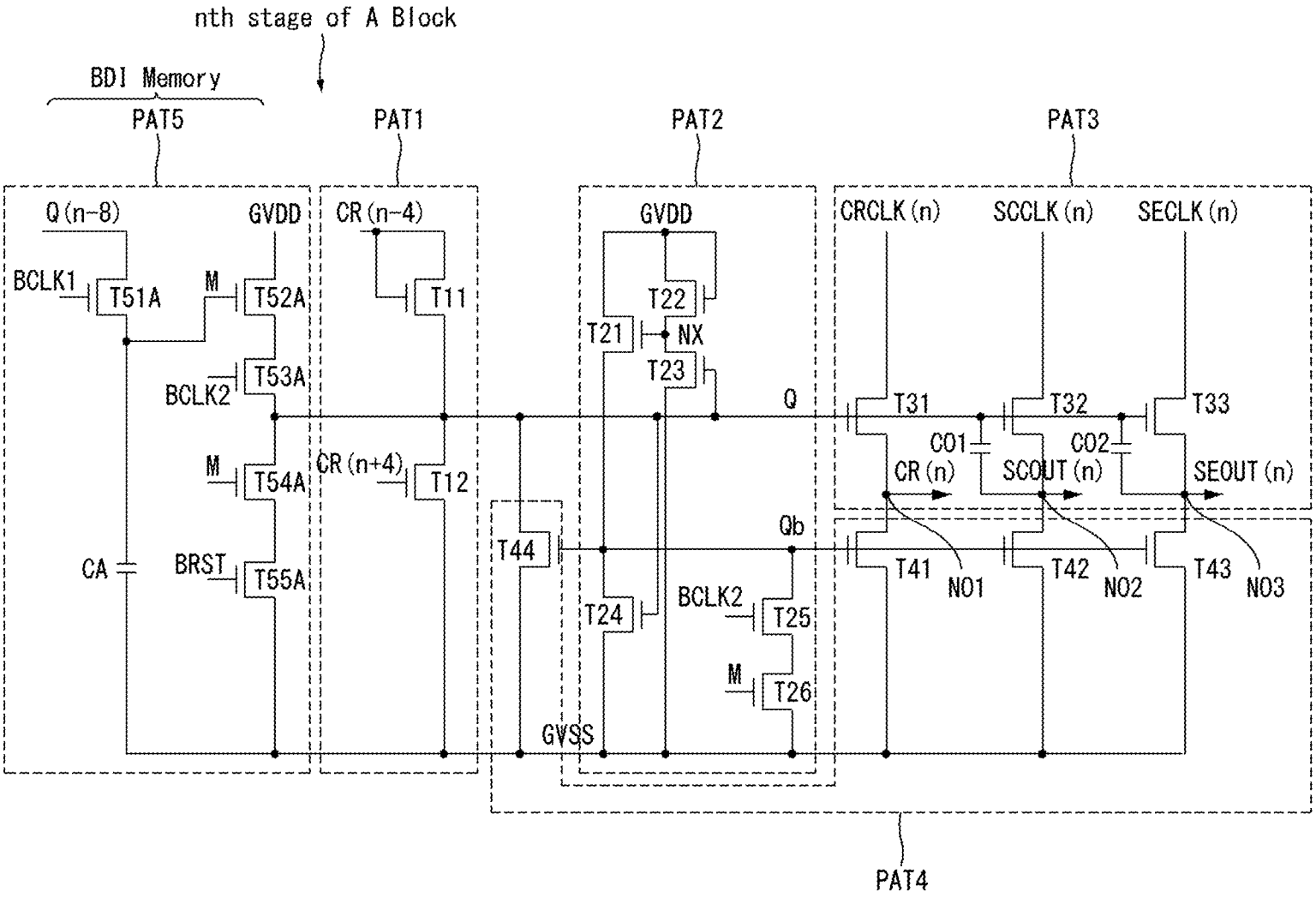
Figure 14:
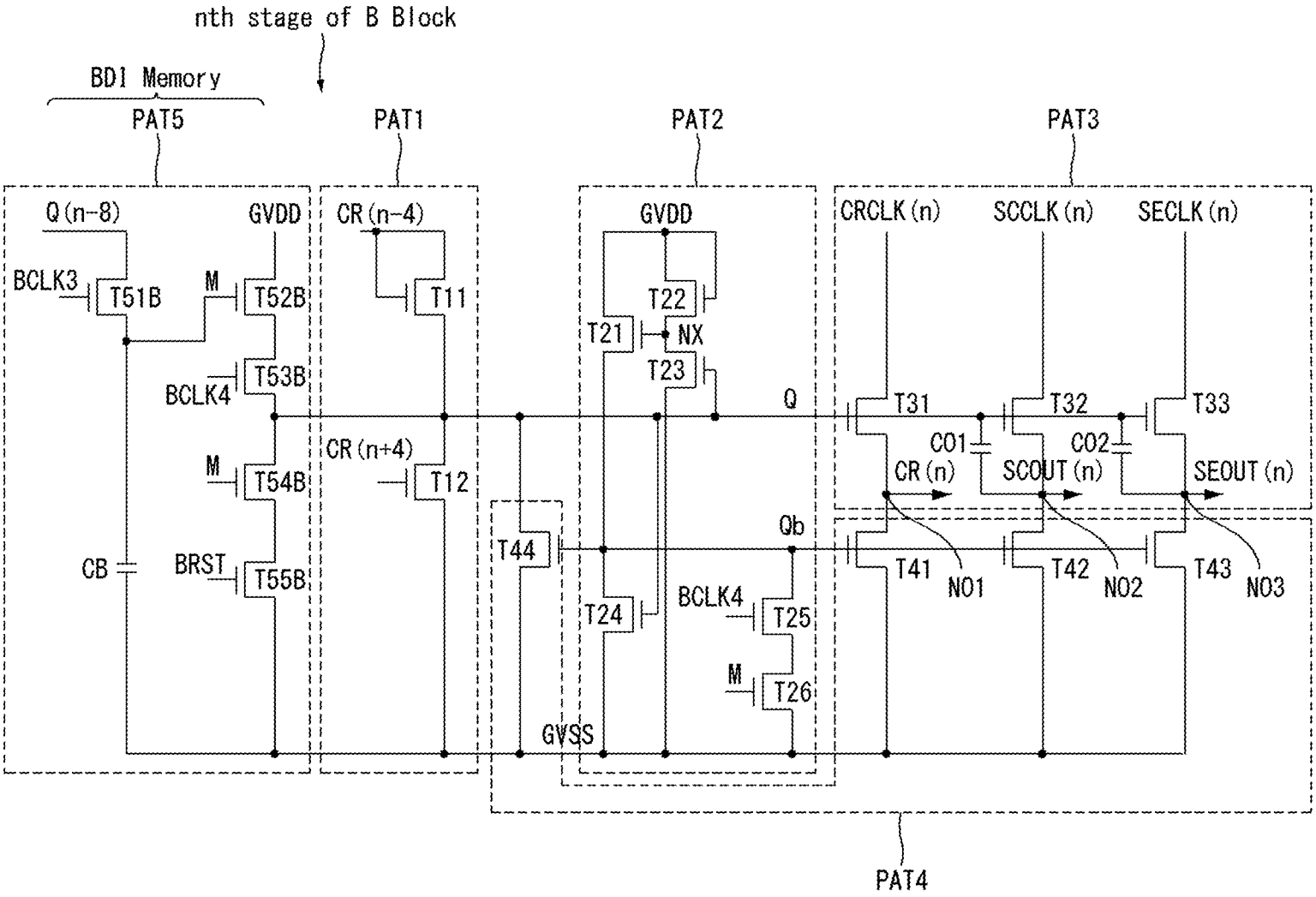
Figure 15:
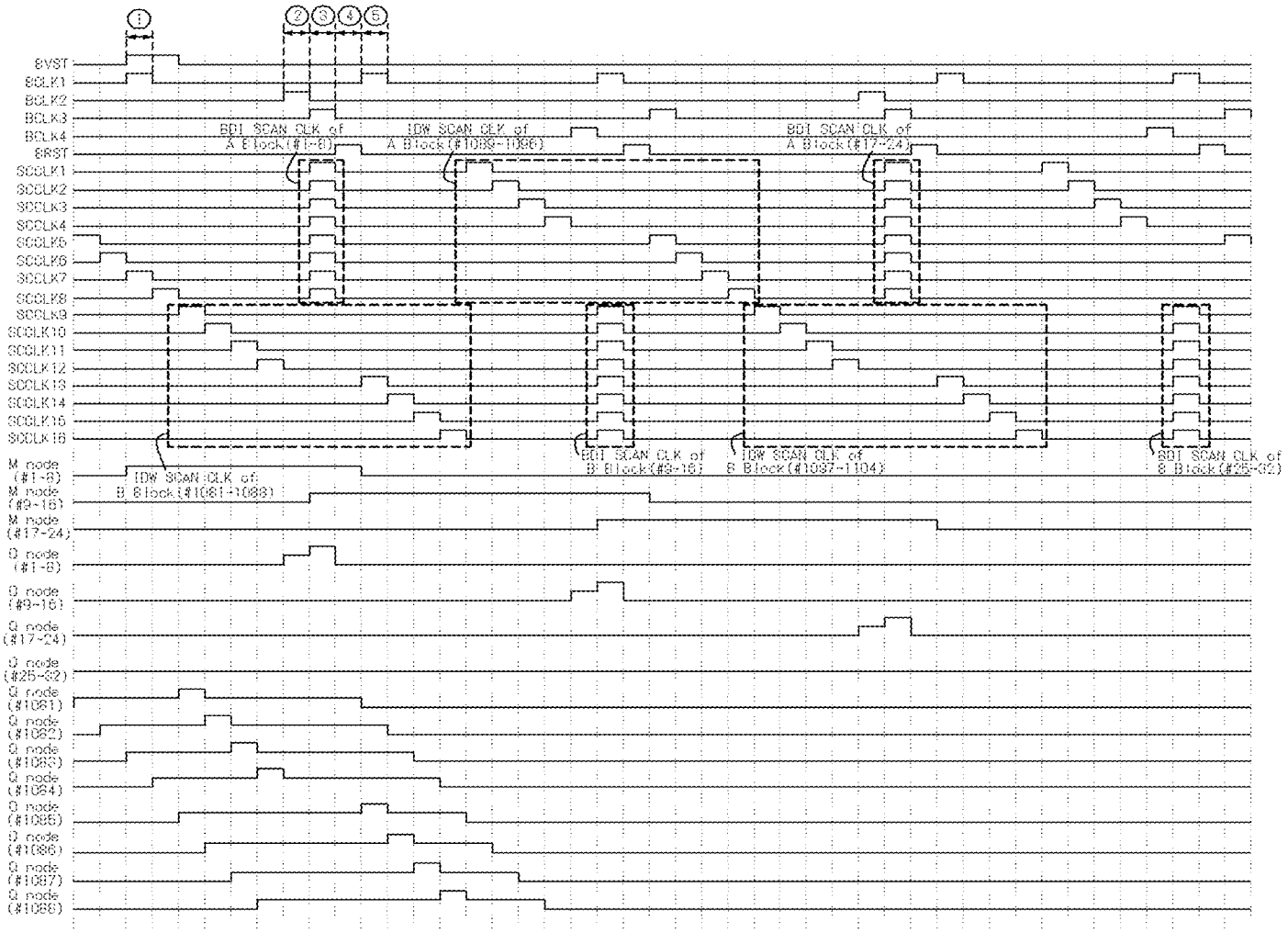
Figure 16:
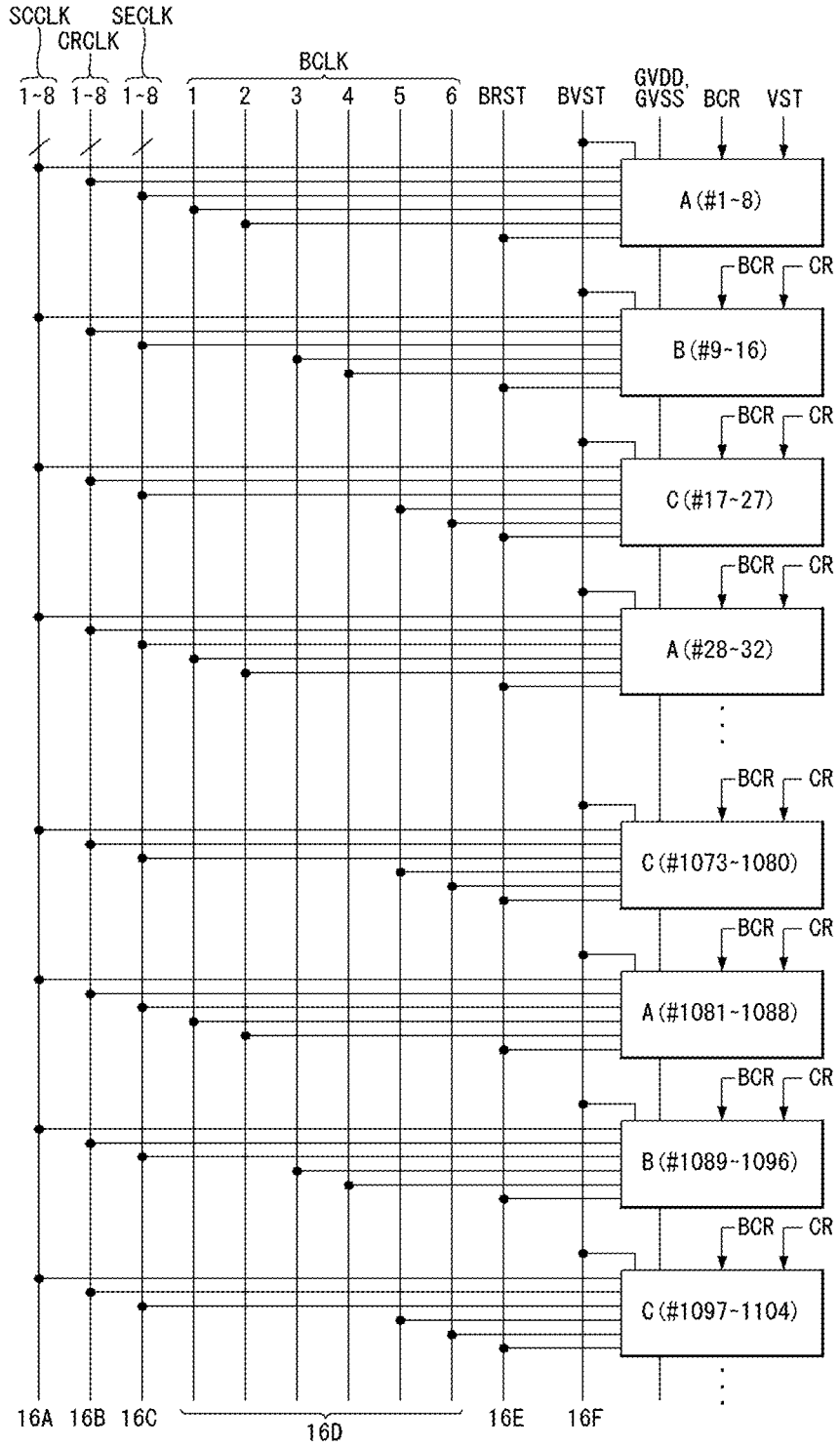
Figure 17:
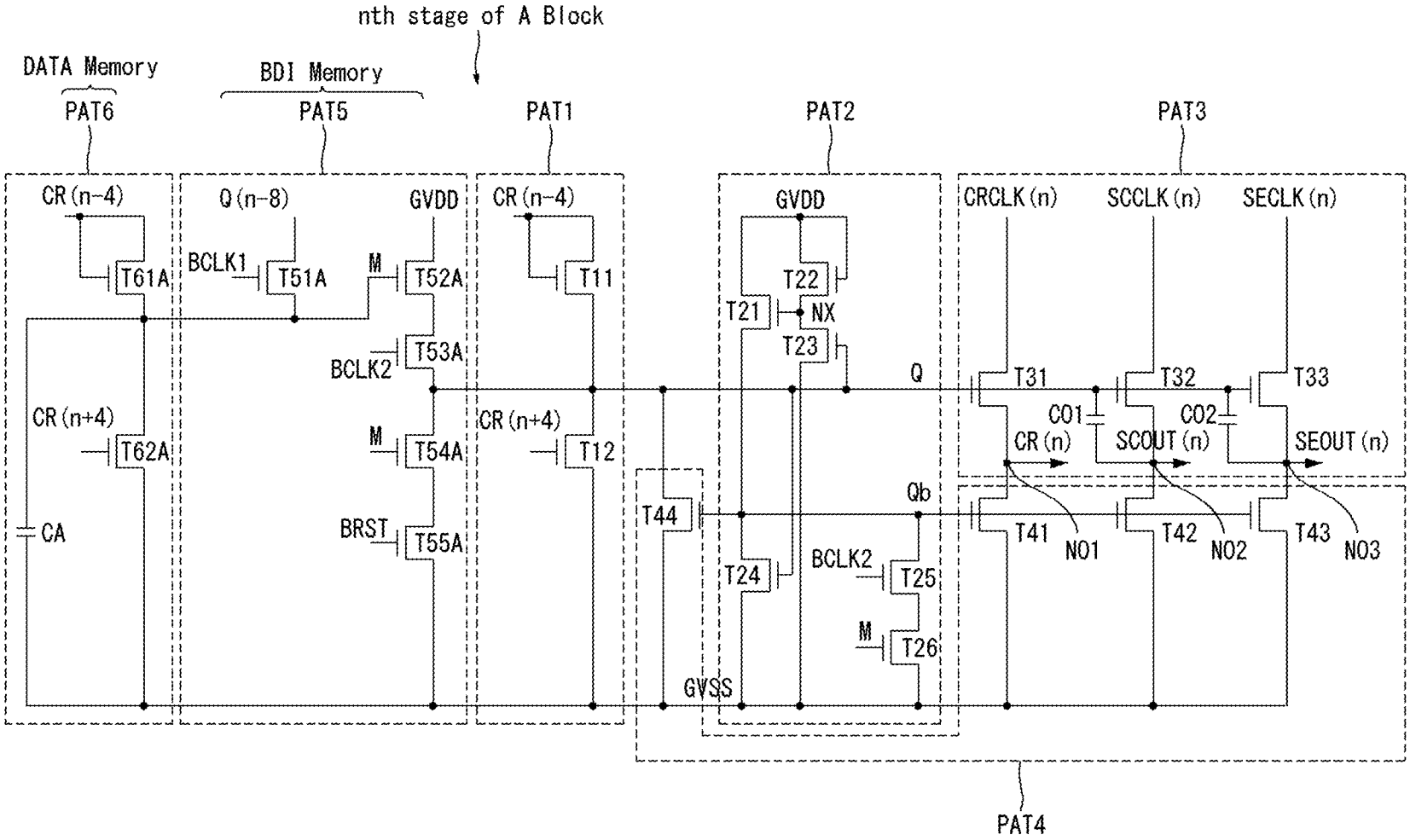
Figure 18:
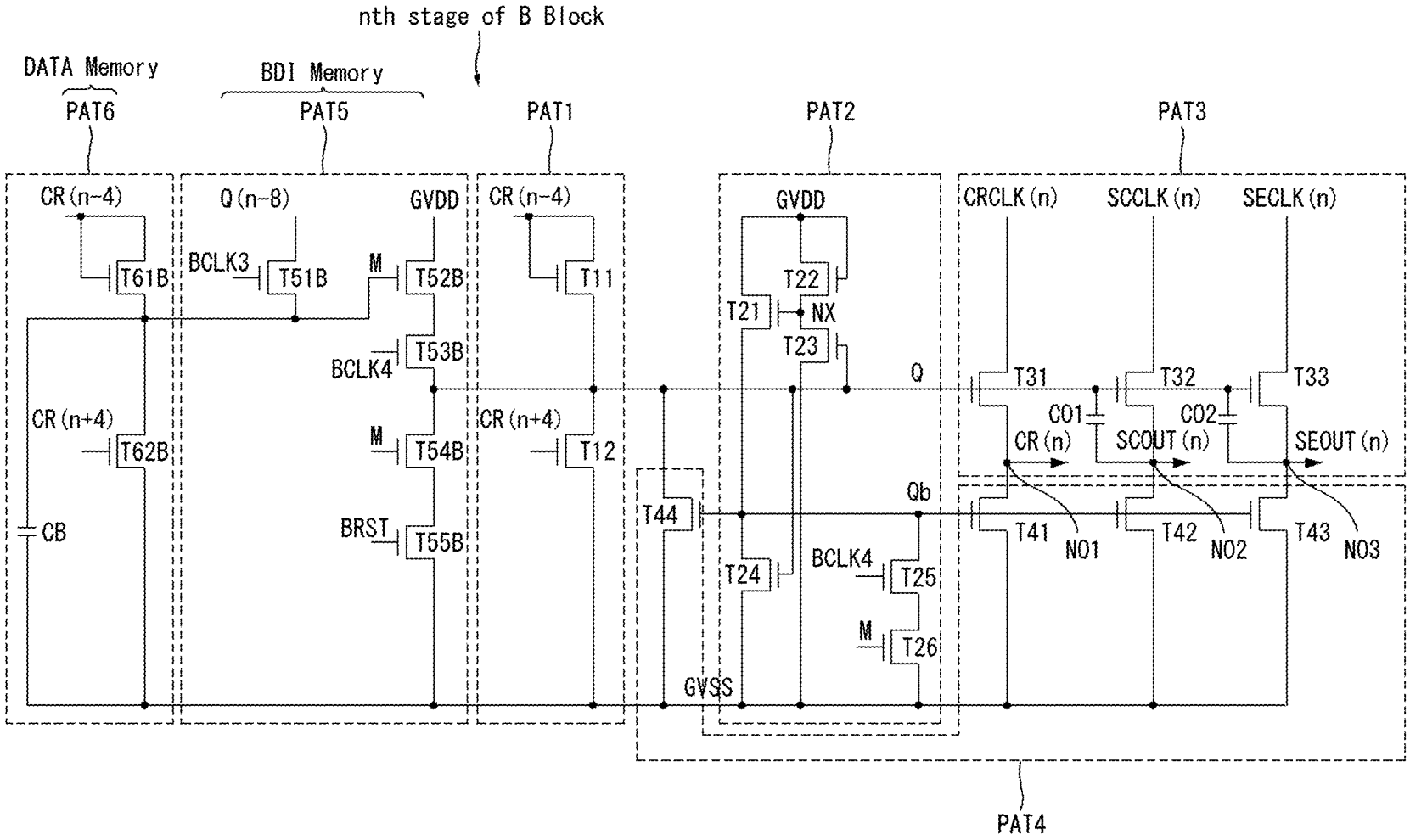
Figure 19:
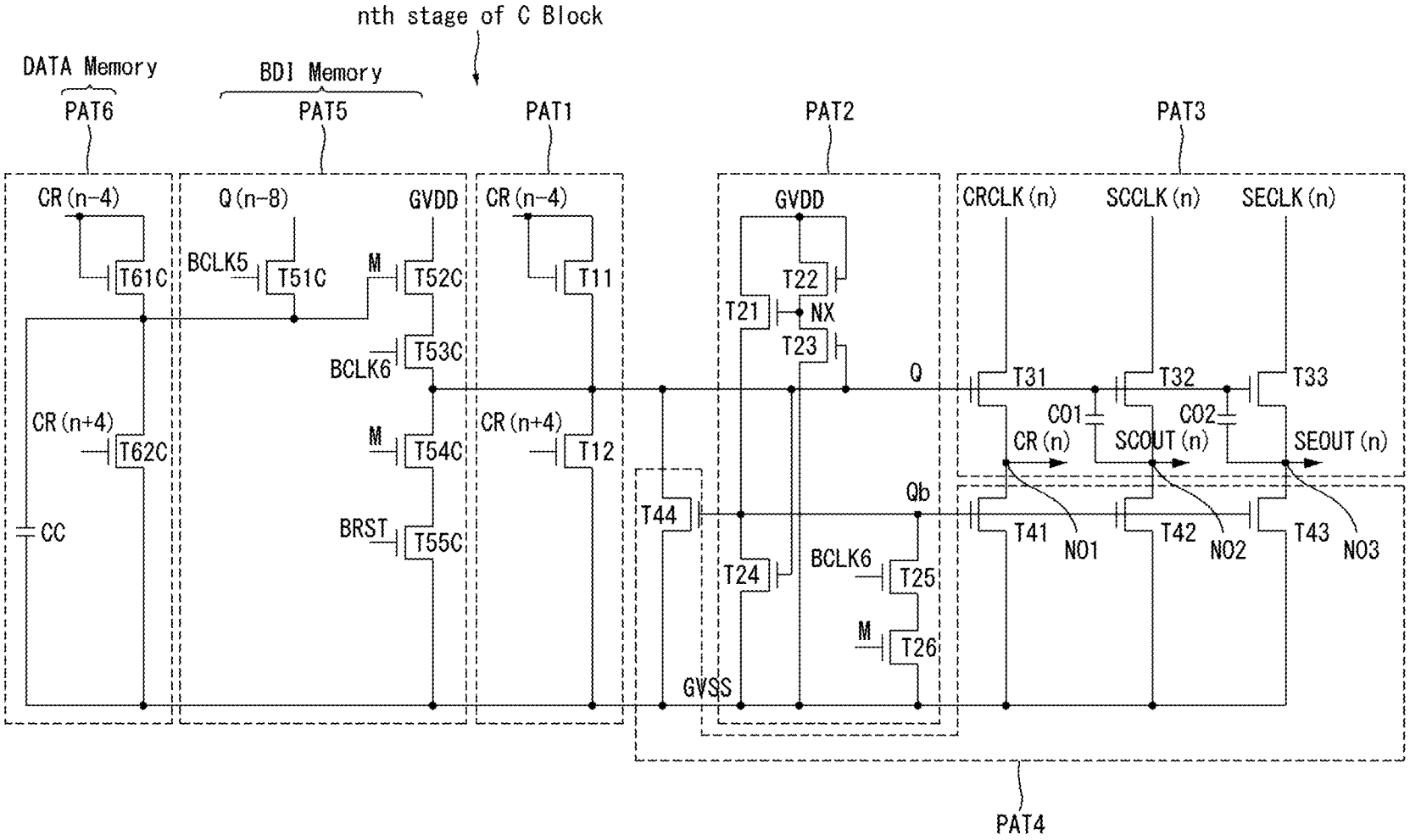
Figure 20:
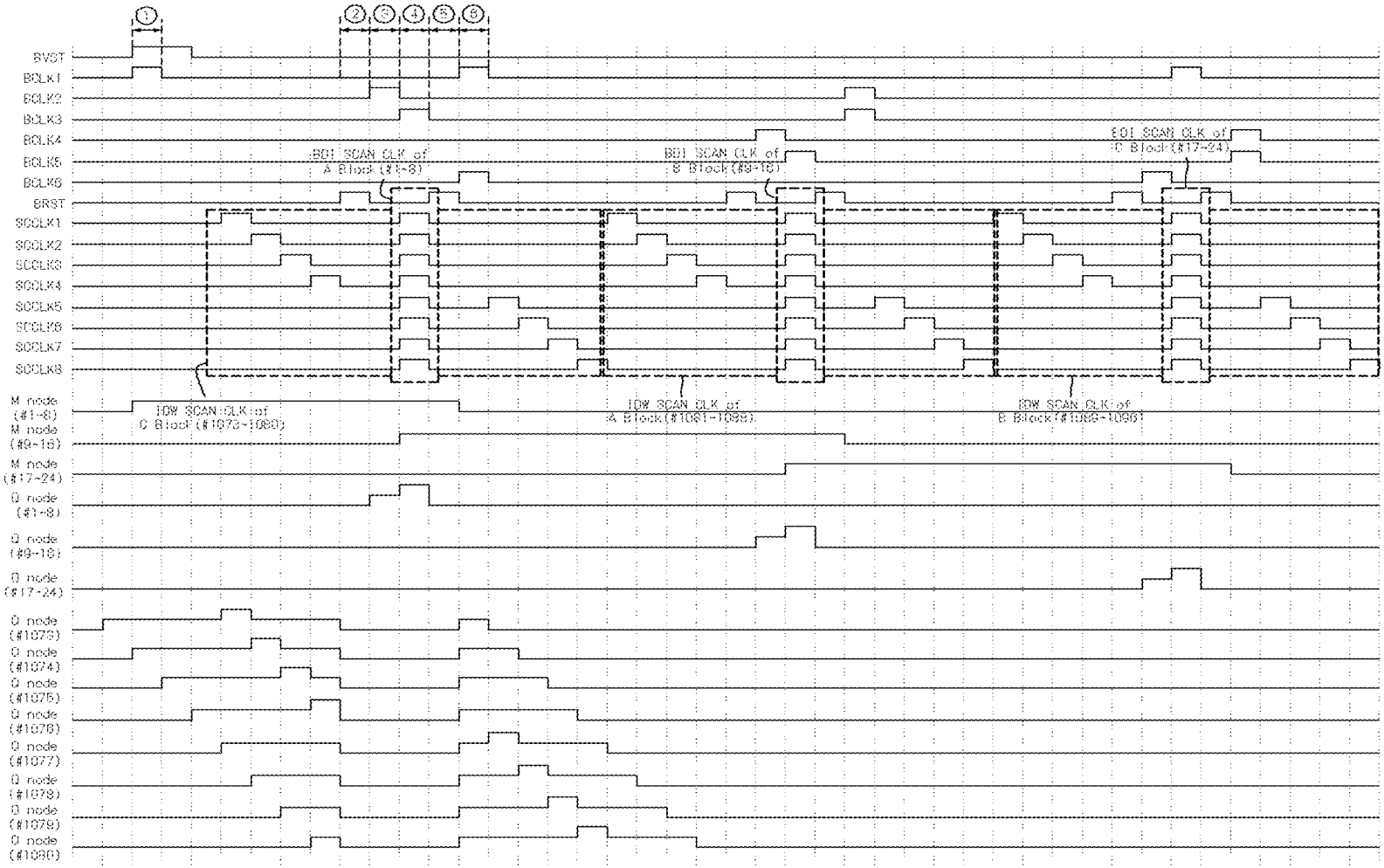
Figure 21:
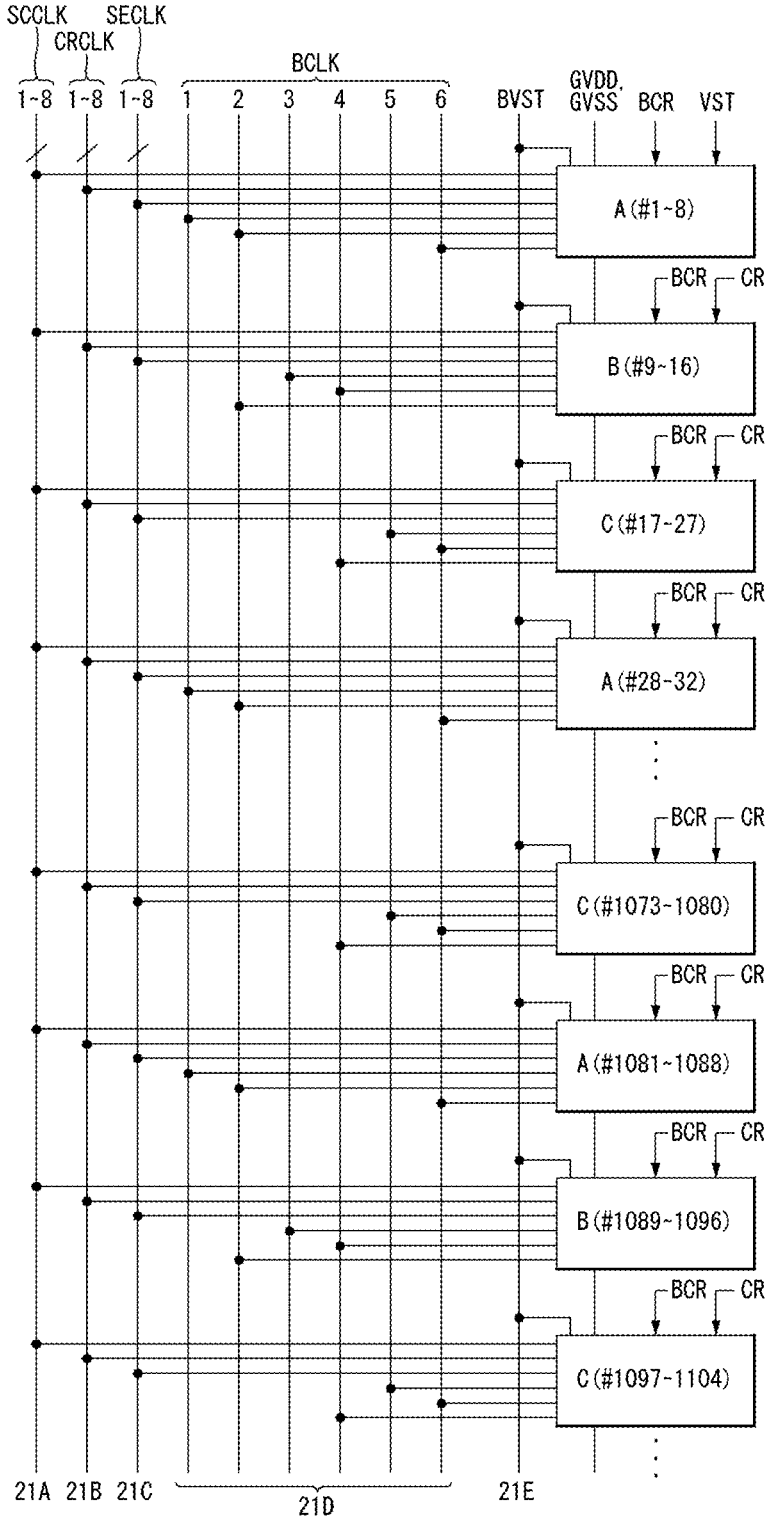
Figure 22:
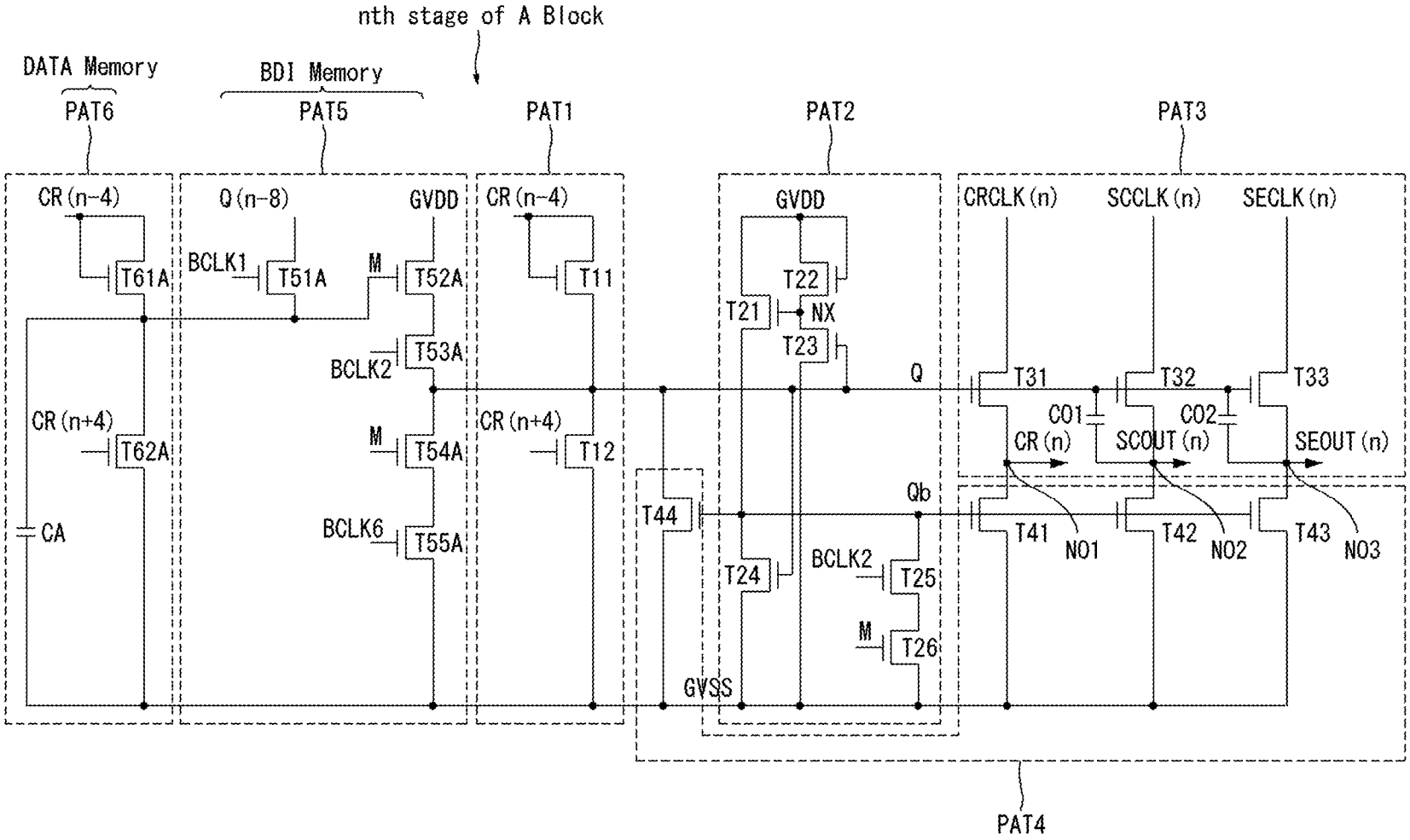
Figure 23:
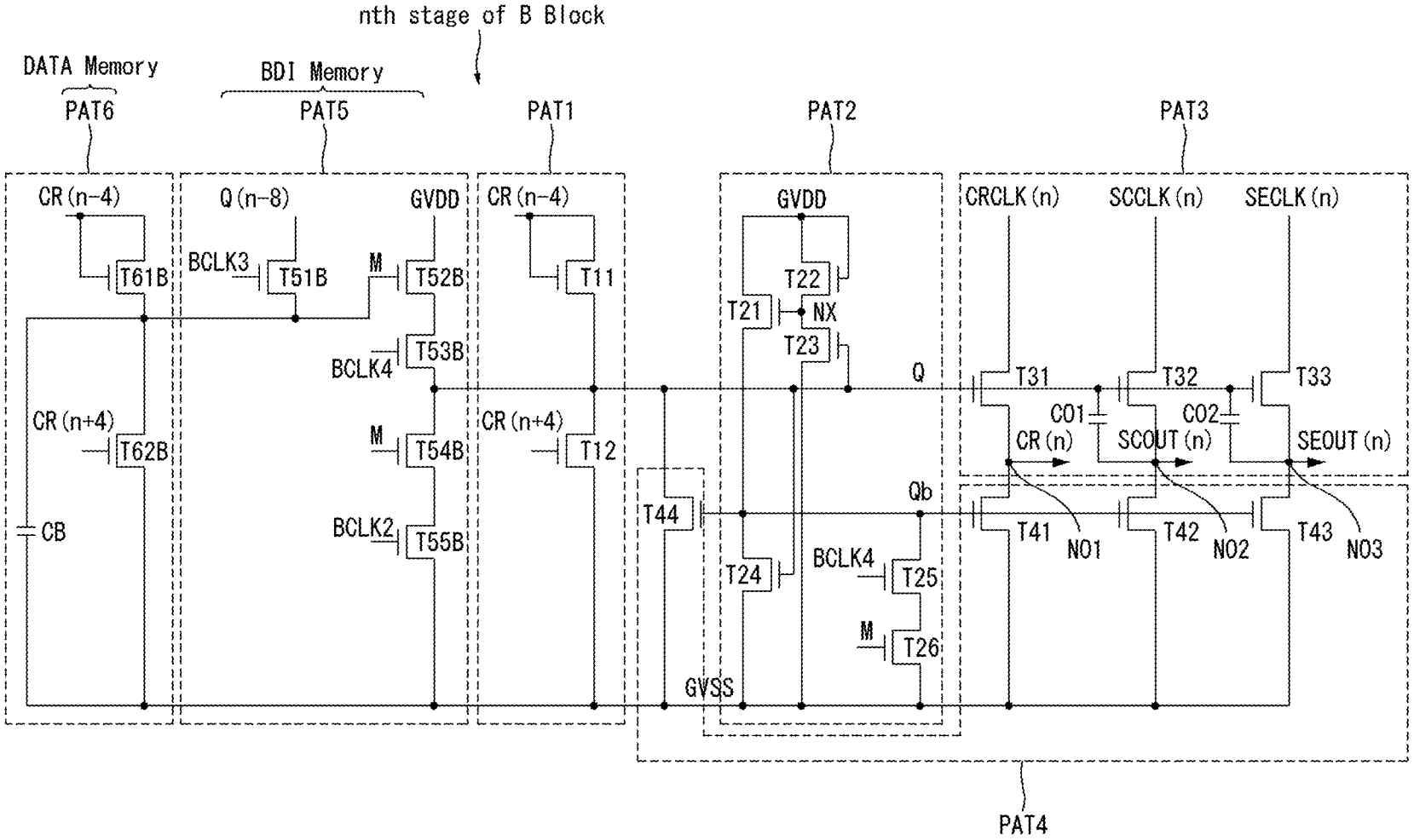
Figure 24:
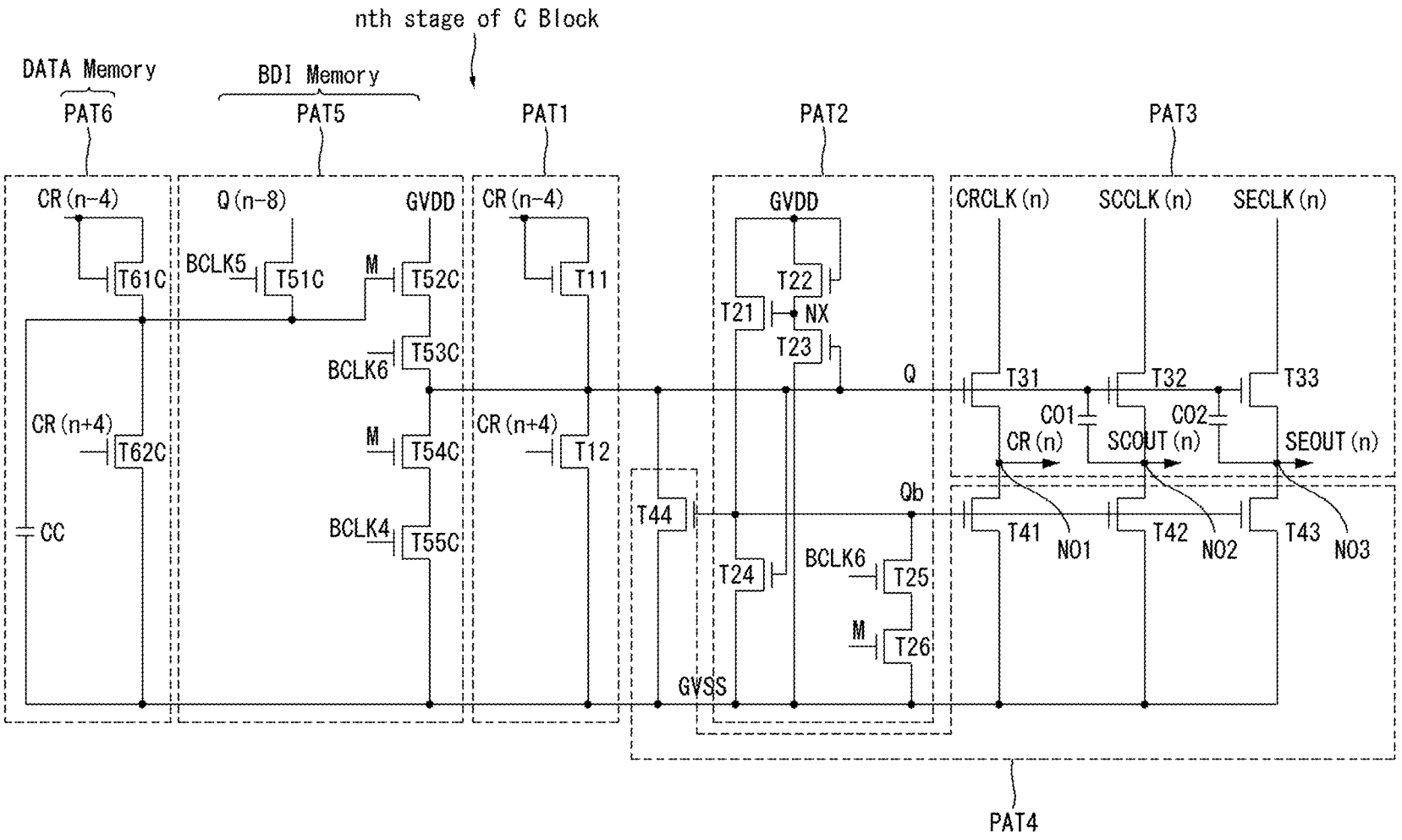
Figure 25:
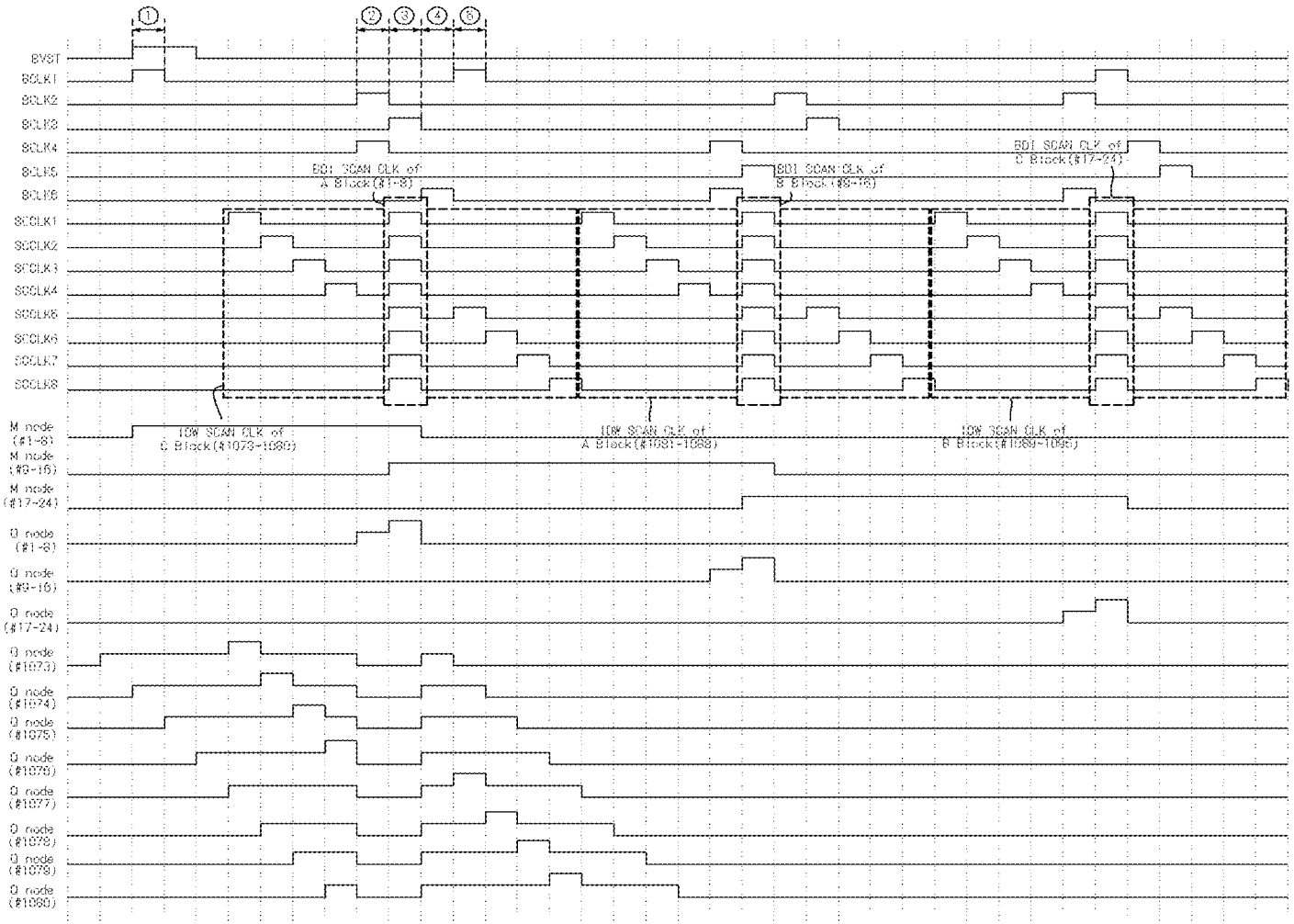

B3 and image data is sequentially written into regions B2-A3-B3-A1-B1-A2 according to a first clock group and a second clock group;

FIG. 11 is a view illustrating a comparison between the present disclosure and the related art;

FIG. 12 is a view illustrating a clock connection configuration of a gate driver according to a first aspect of the present disclosure;

FIG. 13 is a view illustrating a configuration of nth stage of A block illustrated in FIG. 12;

FIG. 14 is a view illustrating a configuration of nth stage of B block illustrated in FIG. 12;

FIG. 15 is a detailed waveform view illustrating operations of A blocks and B blocks illustrated in FIG. 12;

FIG. 16 is a view illustrating a clock connection configuration of a gate driver according to a second aspect of the present disclosure;

FIG. 17 is a view illustrating a configuration of nth stage of A block illustrated in FIG. 16;

FIG. 18 is a view illustrating a configuration of nth stage of B block illustrated in FIG. 16;

FIG. 19 is a view illustrating a configuration of nth stage of block C illustrated in FIG. 16;

FIG. 20 is a detailed waveform view illustrating operations of A blocks, B blocks, and C blocks illustrated in FIG. 16;

FIG. 21 is a view illustrating a clock connection configuration of a gate driver according to a third aspect of the present disclosure;

FIG. 22 is a view illustrating a configuration of nth stage of A block illustrated in FIG. 21;

FIG. 23 is a view illustrating a configuration of nth stage of B block illustrated in FIG. 21;

FIG. 24 is a view illustrating a configuration of nth stage of block C illustrated in FIG. 21; and FIG. 25 is a detailed waveform view illustrating operations of A blocks, B blocks, and C blocks illustrated in FIG. 21.

DETAILED DESCRIPTION

Advantages and features of the present disclosure, and implementation methods thereof will be clarified through following aspects described with reference to the accompanying drawings. The present disclosure may, however, be embodied in different forms and should not be construed as limited to the aspects set forth herein. Rather, these aspects are provided so that this disclosure will be thorough and complete, and will fully convey the scope of the present disclosure to those skilled in the art. Further, the present disclosure is only defined by scopes of claims.

The shapes, sizes, ratios, angles, numbers and the like disclosed in the drawings for describing the aspects of the present disclosure are illustrative and are not limited to those illustrated in the present disclosure. Like reference numerals refer to like elements throughout the specification. Further, in the description of the present disclosure, detailed description of known related arts will be omitted if it is determined that the gist of the present disclosure may be unnecessarily obscured.

In construing an element, the element is construed as including an error range although there is no explicit description.

In describing a position relationship, for example, when two portions are described as "~on", "~above", "~below", or "~on the side", one or more other portions may be positioned between the two portions unless "immediately" or "directly" is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

Like reference numerals refer to like elements throughout the specification.

In this disclosure, a pixel circuit and a gate driver formed on a substrate of a display panel may be realized as a thin film transistor (TFT) having an n-type metal oxide semiconductor field effect transistor (MOSFET) structure, but without being limited thereto, the pixel circuit and a gate driver may also be realized as a TFT having a p-type MOSFET structure. A TFT is a three-electrode element including a gate, a source, and a drain. The source is an electrode that supplies a carrier to a transistor. In the TFT, carriers start to flow from the source. The drain is an electrode through which the carriers exit from the TFT. That is, in the MOSFET, the carriers flow from the source to the drain. In the case of the n-type TFT, the carriers are electrons, and thus, a source voltage has a voltage lower than a drain voltage so that electrons may flow from the source to the drain. In the n-type TFT, electrons flow from the source to the drain, and thus, current flows from the drain to the source. In contrast, in the case of a p-type TFT (PMOS), since carriers are holes, a source voltage is higher than a drain voltage so that holes may flow from the source to the drain. In the p-type TFT, since holes flow from the source to the drain, current flows from the source to the drain. It should be noted that the source and the drain of the MOSFET are not fixed. For example, the source and the drain of the MOSFET may be changed depending on the applied voltage. Therefore, in the description of the aspects, one of the source and the drain is referred to as a first electrode and the other is referred to as a second electrode.

Hereinafter, aspects of the present disclosure will be described in detail with reference to the accompanying drawings. In the following aspects, an organic light emitting display device including an organic luminescent material will mainly be described as a display device. However, it should be noted that the technical idea of the present disclosure is not limited to the organic light emitting display device but may be applied to an inorganic light emitting display device including an inorganic luminescent material.

In describing the present disclosure, if a detailed description for a related known function or construction is considered to unnecessarily divert the gist of the present disclosure, such explanation has been omitted but would be understood by those skilled in the art.

Figure 1:
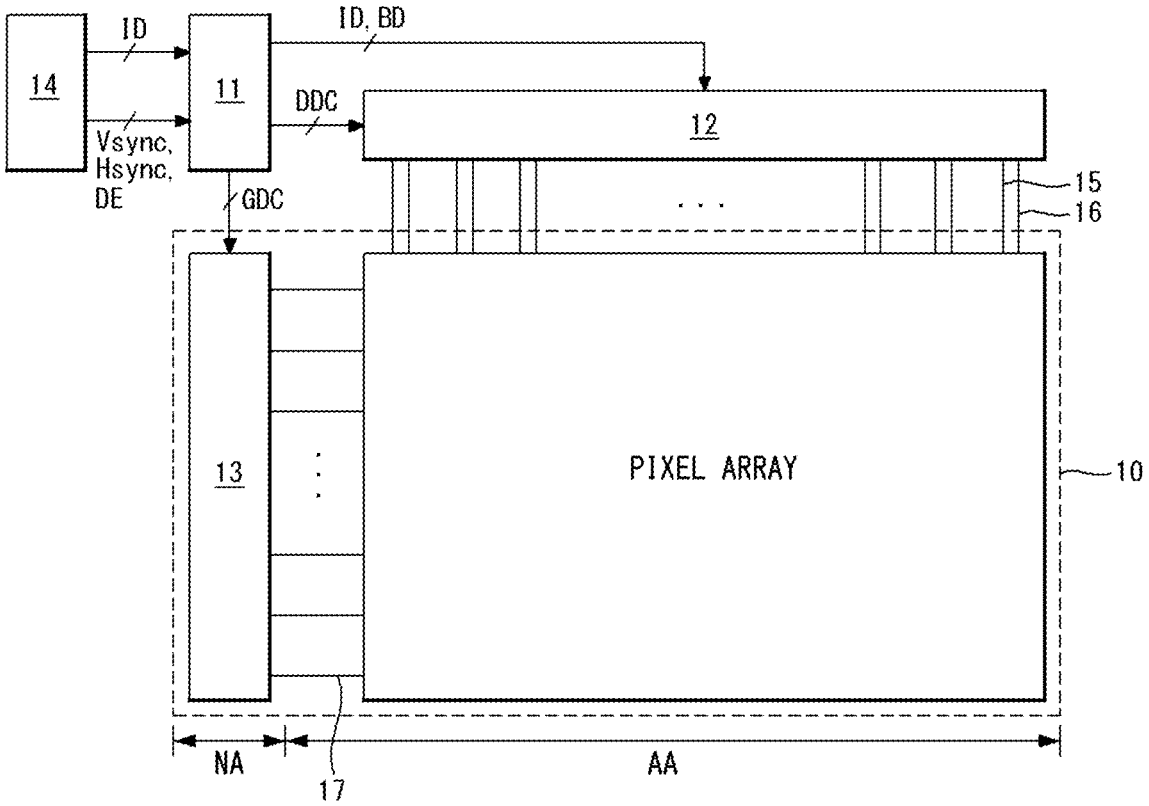
FIG. 1 is a view illustrating a display device according to the present disclosure.
Figure 2:
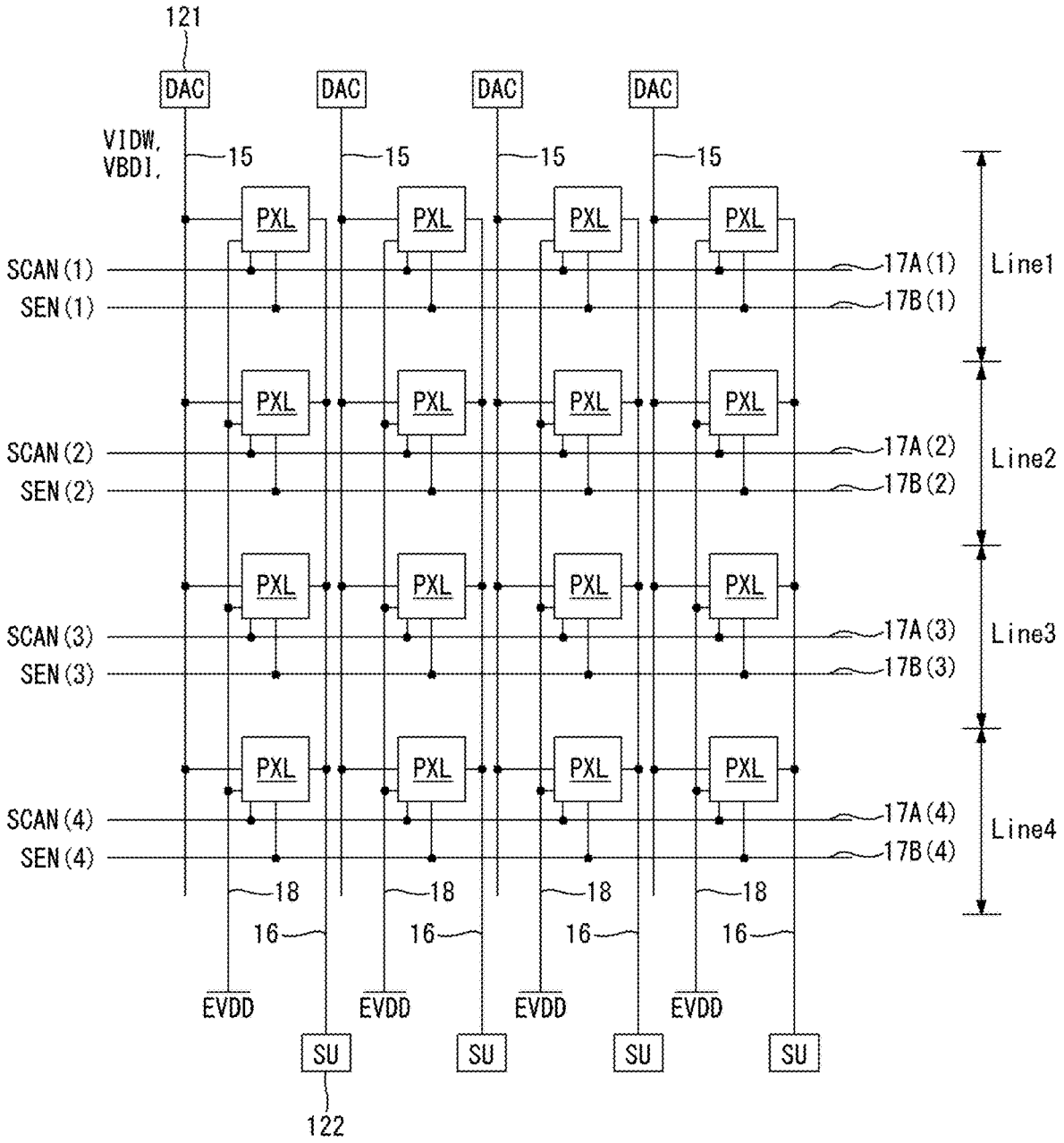
FIG. 2 is a view illustrating a pixel array included in the display device of FIG. 1.
Figure 3:
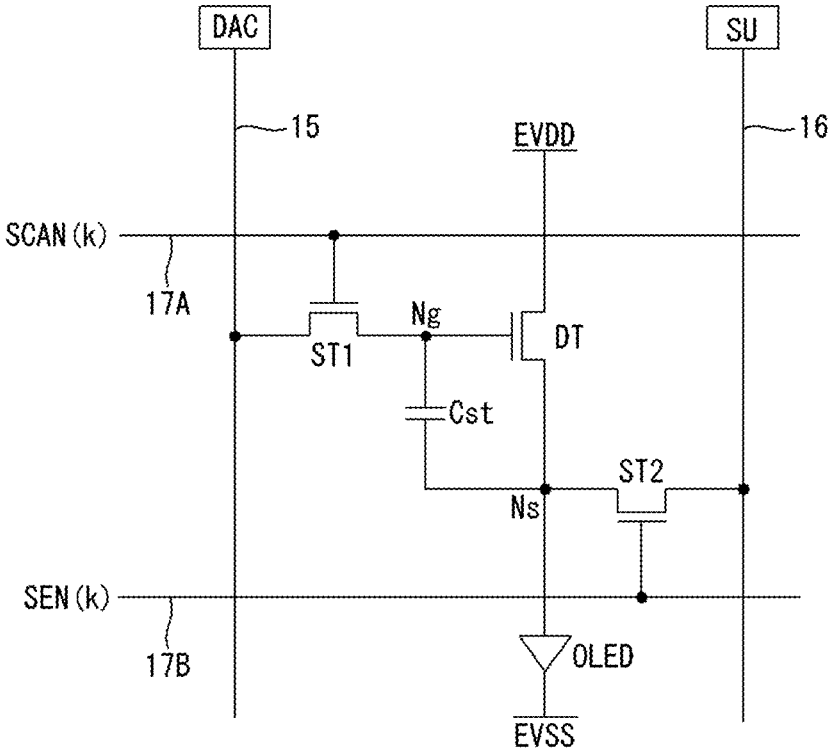
FIG. 3 is a view illustrating a pixel included in the pixel array of FIG. 2.

FIG. 1 is a view illustrating a display device according to an aspect of the present disclosure. FIG. 2 is a view illustrating a pixel array included in the display device of FIG. 1. FIG. 3 is a view illustrating a pixel included in the pixel array of FIG. 2.

Referring to FIGS. 1 to 3, a display device according to an aspect of the present disclosure may include a display panel 10, a timing controller 11, and panel drivers 12 and 13. The panel drivers 12 and 13 include a data driver 12 for driving data lines 15 of the display panel 10 and a gate driver 13 for driving gate lines 17 of the display panel 10.

The display panel 10 may include a plurality of data lines 15 and reference voltage lines 16 and a plurality of gate lines 17. Pixels PXL may be disposed at intersections of the data lines 15, the reference voltage lines 16, and the gate lines 17. A pixel array as illustrated in FIG. 2 may be formed in a display area AA of the display panel 10 by the pixels PXL arranged in a matrix form.

In the pixel array, the pixels PXL may be divided by lines on the basis of one direction. For example, the pixels PXL may be divided by a plurality of pixel lines (Line 1 to Line 4, etc.) with respect to an extending direction (or horizontal direction) of the gate lines. Here, the pixel lines refer to an aggregate of pixels PXL arranged adjacent to each other in one horizontal direction, rather than physical signal lines. Thus, the pixels PXL constituting the same pixel line may be connected to the same gate lines 17A and 17B.

In the pixel array, the pixels PXL are connected to digital-to-analog converters (DACs) 121 through the data lines 15 and connected to sensing units SU via reference voltage lines 16, respectively. The reference voltage lines 16 may be further connected to the DACs 121 to supply a reference voltage, respectively. The DAC 121 and the sensing unit SU may be embedded in the data driver 12, but are not limited thereto.

In the pixel array, the pixels PXL may be connected to high potential pixel power sources EVDD via power supply lines 18, respectively. Each of the pixels PXL may be connected to the gate driver 13 through the first gate line 17A and the second gate line 17B.

Each pixel PXL may be implemented as illustrated in FIG. 3. One pixel PXL disposed in kth (k is an integer) pixel line includes an organic light emitting diode (OLED), a driving thin film transistor (TFT) DT, a storage capacitor Cst, a first switch TFT ST1, and a second switch TFT ST2, and the first switch TFT ST1 and the second switch TFT ST2 may be connected to different gate lines 17A and 17B.

The OLED includes an anode electrode connected to a source node Ns, a cathode electrode connected to an input terminal of a low-potential pixel power supply source EVSS, and an organic compound layer positioned between the anode electrode and the cathode electrode. The driving TFT DT controls a driving current flowing in the OLED according to a voltage difference between the gate node Ng and the source node Ns. The driving TFT DT has a gate electrode connected to the gate node Ng, a first electrode connected to an input terminal of the high potential pixel power supply source EVDD, and a second electrode connected to the source node Ns. The storage capacitor Cst is connected between the gate node Ng and the source node Ns to store a gate-source voltage of the driver TFT DT.

The first switch TFT ST1 is turned on according to a first gate signal SCAN(k) to apply a data voltage charged in the data line 15 to the gate node Ng. The first switch TFT ST1 has a gate electrode connected to the first gate line 17A, a first electrode connected to the data line 15, and a second electrode connected to the gate node Ng. The second switch TFT ST2 is turned on according to a second gate signal SEN(k) to apply a reference voltage charged in the reference voltage line 16 to the source node Ns or transfers a change in the source node Ns voltage according to a pixel current to the reference voltage line 16. The second switch TFT ST2 has a gate electrode connected to the second gate line 17B, a first electrode connected to the reference voltage line 16, and a second electrode connected to the source node Ns.

The number of gate lines 17 connected to each pixel PXL may vary depending on a pixel (PXL) structure. For example, in the case of a two-scan pixel structure in which the first switch TFT ST1 and the second switch TFT ST2 are driven differently, the number of gate lines 17 connected to each pixel PXL is 2. In the two-scan pixel structure, the gate lines 17 include a first gate line 17A to which a scan signal is applied and a second gate line 17B to which a sense signal is applied. Hereinafter, the two-scan pixel structure will be used as an example for the purposes of description, but the technical idea of the present disclosure is not limited to the pixel structure, the number of gate lines, and the like.

The timing controller 11 may generate a data control signal DDC for controlling an operation timing of the data driver 12 and a gate control signal GDC for controlling an operation timing of the gate driver 13 on the basis of timing signals such as a vertical synchronization signal Vsync, a horizontal synchronization signal Hsync, a dot clock DCLK, and a data enable signal DE input from the host system 14. The gate control signal GDC may include a gate start signal, gate shift clocks, and the like. The data control signal DDC includes a source start pulse, a source sampling clock, a source output enable signal, and the like. The source start pulse controls a data sampling start timing of the data driver 12. The source sampling clock controls a sampling timing of data on the basis of a rising or falling edge. The source output enable signal controls an output timing of the data driver 12.

The timing controller 11 may control a display driving timing for the pixel lines of the display panel 10 on the basis of the timing control signals GDC and DDC.

Display driving refers to driving for sequentially reproducing an input image and a black image on the display panel 10 by starting to write input image data ID and black image data BD into the pixel lines with a predetermined time difference therebetween in one frame. Display driving includes image data writing (IDW) driving for writing input image data ID to pixel lines and black data insertion (BDI) driving for writing black image data BD to pixel lines. BDI driving may be started before IDW driving is completed in one frame so that the display device optimized for high-speed driving may be implemented. That is, IDW driving for a first pixel line and BDI driving for a second pixel line may temporally overlap in one frame.

The timing controller 11 may adjust a time difference between a start timing of IDW driving and a start timing of BDI driving, i.e., an emission duty, by controlling the start timing of BDI driving in one frame.

The timing controller 11 may control the start timing of BDI driving in one frame in conjunction with a motion of the input image data ID. After detecting the motion of the input image data ID through various known image processing techniques, the timing controller 11 may advance the start timing of BDI driving in one frame as a variation in the input image data ID increases, thus reducing the emission duty. This may improve MPRT performance and motion blurring may be alleviated when there is a rapid change in an image. Meanwhile, when there is no image change, the timing controller 11 may delay the start timing of BDI driving and increase the emission duty to lower maximum instantaneous brightness of the pixels.

The timing controller 11 may implement IDW driving in a vertical active period of one frame and implement BDI driving using both the vertical active period and a vertical blank period. Therefore, BDI driving timing may overlap IDW driving timing during the vertical active period.

The timing controller 11 outputs gate shift clocks including carry clocks, scan clocks, and sense clocks and a gate start signal to the gate driver 13 for IDW and BDI driving.

The timing controller 11 may control the operation of the gate driver 13 on the basis of the gate shift clocks to divide the pixel array into at least one first region and at least one second region. That is, the timing controller 11 may perform BDI driving on the second region BDI while IDW driving is performed on the first region, and conversely, while the timing controller 11 may perform IDW driving on the second region, while BDI driving is performed on the first region. Here, the timing controller 11 may generate gate shift clocks such that a pulse interval (ON voltage interval) of scan clocks for BDI (or BDI scan clocks) and a pulse interval of scan clocks for IDW (or IDW scan clocks) do not overlap each other. Thus, unwanted data mixing (i.e., data collision) between the input image data ID and the black image data BD may be prevented in the technique of inserting a black image to improve MPRT performance.

The timing controller 11 may simultaneously output a plurality of BDI scan clocks so that a plurality of pixel lines in the first region or the second region may be controlled to be simultaneously BDI-driven. Accordingly, in the technique of improving MPRT performance, an insertion time of the black image data BD is reduced, while a writing time of the input image data ID may be sufficiently secured.

The timing controller 11 outputs the input image data ID input from the host system 14 to the data driver 12. The timing controller 11 outputs internally generated black image data BD (or which is previously set as a specific value) to the data driver 12. The black image data BD corresponds to the lowest gradation data of the input image data ID and is for displaying a black image when during BDI driving.

The gate driver 13 generates the scan signal SCAN and the sense signal SEN on the basis of the gate control signal GDC from the timing controller 11. The gate driver 13 generates a scan signal for image writing (hereinafter, referred to as an IDW scan signal) and a scan signal for black writing (hereinafter, referred to as a BDI scan signal) on the basis of carry clocks, scan clocks, and sense clocks.

In order to implement IDW driving and BDI driving, the gate driver 13 sequentially supplies the IDW scan signal SCAN to the first gate lines 17A of the first region (or the second region) and simultaneously supplies the BDI scan signal SCAN to the plurality of first gate lines 17A in the second region (or the first region). The gate driver 13 sequentially applies a sense signal for image writing, i.e., an IDW sense signal SEN to the second gate lines 17B of the first region (or the second region) in synchronization with a timing at which the IDW scan signal SCAN is supplied to the first gate lines 17A of the first region (or the second region).

The gate driver 13 may be embedded in a non-display area NA of the display panel 10 according to a gate driver in-panel (GIP) scheme.

The gate driver 13 may further include clock lines provided in the non-display area NA of the display panel 10. In order to reduce the number of clock lines and implement a narrow bezel, each stage of the gate driver 13 may include a BDI memory and may further include a data memory. Details thereof will be described with reference to FIGS. 11 to 25.

The data driver 12 includes a plurality of DACs 121 and a plurality of sensing units SUs 122. The DAC 121 converts the input image data ID into an IDW data voltage VIDW and outputs the black image data BD into a BDI data voltage VBDI on the basis of the data control signal DDC from the timing controller 11. Also, the DAC 121 generates a reference voltage to be applied to the pixels PXL.

In order to implement IDW driving and BDI driving, the DAC 121 outputs the IDW data voltage VIDW to the data lines 15 in synchronization with the IDW scanning signal SCAN, outputs the BDI data voltage VBDI to the data lines 15 in synchronization with the BDI scan signal SCAN, and outputs the reference voltage to the reference lines 16 in synchronization with the IDW sense signal SEN.

Figure 4:
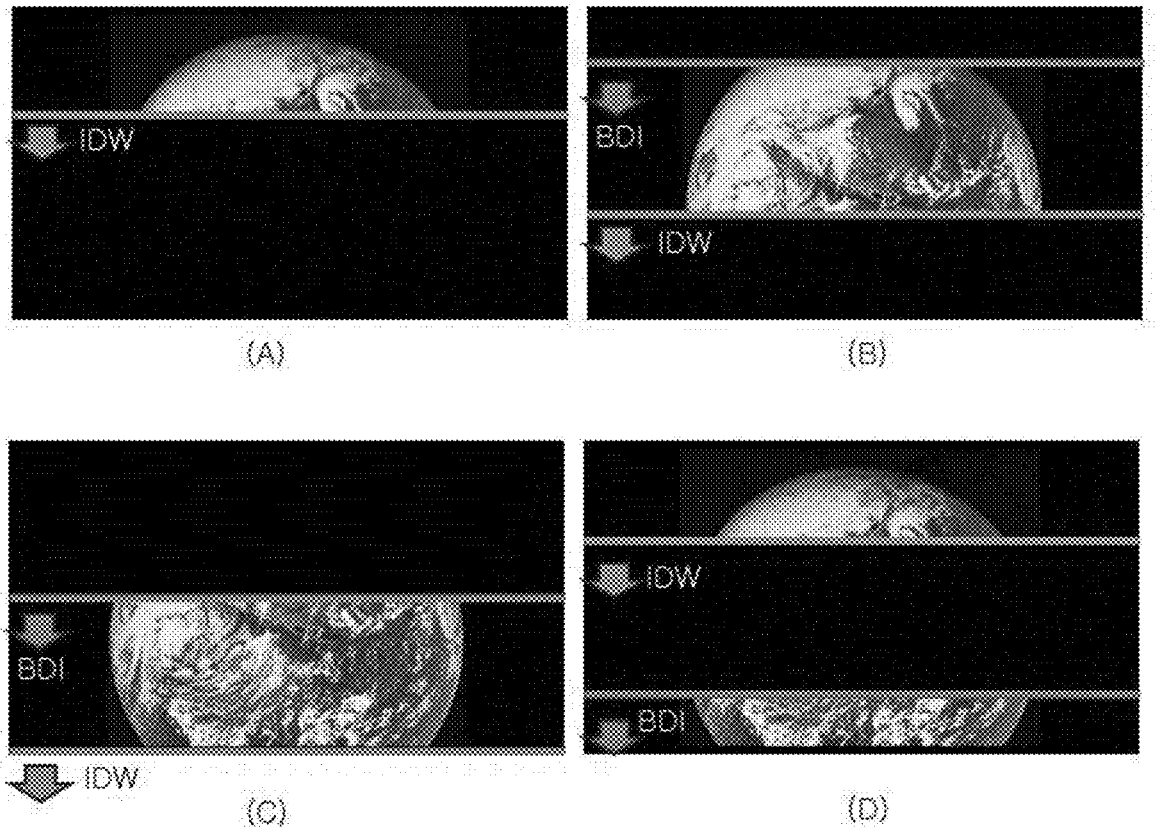
FIGS. 4 to 6 are views illustrating a black image insertion technique applied to the display device of FIG. 1.
Figure 5:
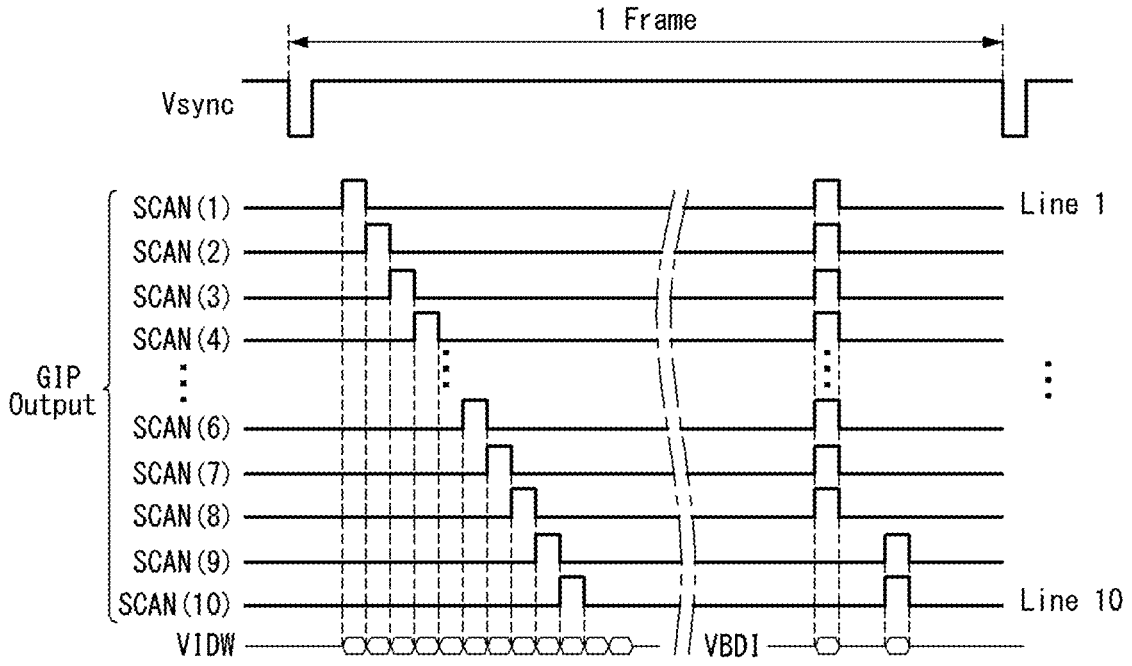
Figure 6:
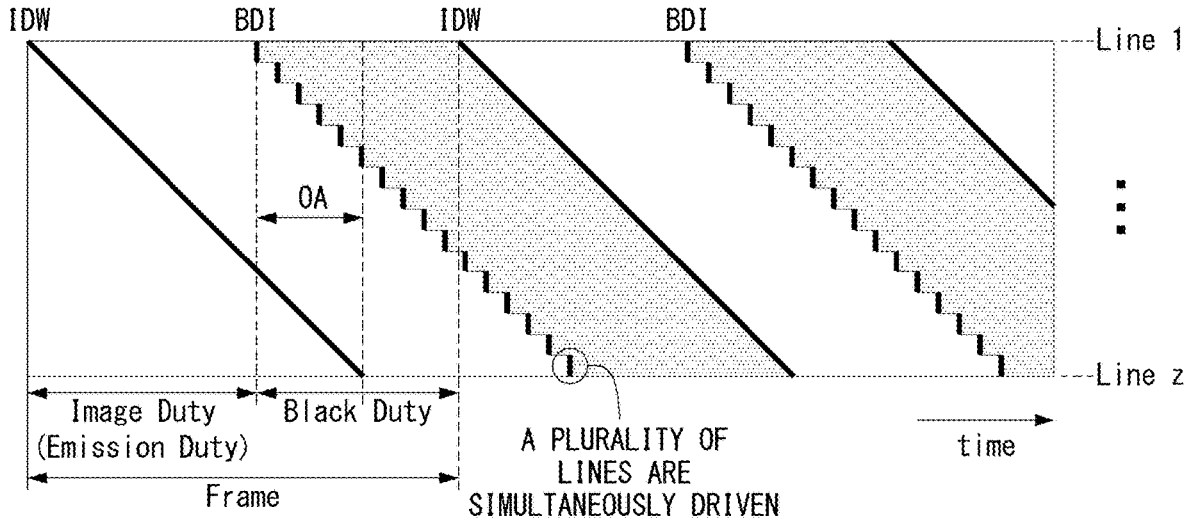

FIGS. 4 to 6 are views illustrating a black image insertion technique applied to the display device of FIG. 1.

Referring to FIG. 4, with respect to the same pixel line, IDW driving and BDI driving are continuously performed with a predetermined time difference therebetween in one frame. An emission duty of the pixels PXL is determined by a time difference between a start timing of IDW driving and a start timing of BDI driving within the same frame. The start timing of IDW driving is a fixed factor, and the start timing of BDI driving is an adjustable design factor. The start timing of IDW driving is determined by an IDW start signal, and the start timing of BDI driving is determined by a BDI start signal. Therefore, the emission duty of the pixels PXL may be controlled by advancing or delaying an output timing of the BDI start signal and adjusting the start timing of BDI driving. Thus, when the emission duty of the pixels PXL is determined in this manner, the emission duty is maintained regardless of frame changes. That is, an IDW driving timing and a BDI driving timing for the pixel lines are equally shifted while maintaining the emission duty over time.

Referring to FIG. 5, the IDW scan signal SCAN and the BDI scan signal SCAN are output with a predetermined time difference corresponding to the emission duty within one frame. In FIG. 5, the IDW sense signal SEN is omitted for the purposes of description. The IDW scan signals SCAN1 to SCAN10 are shifted in phase in a line sequential manner to select the pixel lines Line 1 to Line 10 one by one and the IDW data voltage VIDW is sequentially applied to the selected pixel lines Line 1 to Line 10. The BDI scan signals SCAN1 to SCAN10 are shifted in phase in A block sequential manner to simultaneously select a plurality of pixel lines Line 1 to Line 10, and the BDI data voltage VBDI is simultaneously applied to the pixel lines Line 1 to Line 8 of the selected block.

Referring to FIG. 6, it is illustrated that IDW driving timing and BDI driving timing for the pixel lines Line 1 to Line z are shifted while maintaining the emission duty although the frame is changed. If such a driving concept is employed, there is no need to add a separate frame for BDI driving, and thus, a frame rate is not required to be increased.

However, since the IDW driving timing is ahead of BDI driving timing by the emission duty and the shift speeds of the IDW driving timing and the BDI driving timing are substantially the same, an overlap interval OA in which IDW driving for the first pixel line and BDI driving for the second pixel line overlap is inevitably generated. Since two pixel lines are driven in an overlapping manner in the overlap interval OA, there is a risk of data collision (or data mixing) because two pixel lines are driven in an overlapping manner. To prevent such a data collision, a pulse interval (on-voltage interval) of the BDI scan clocks and a pulse interval of the IDW scan clocks may not overlap each other.

Figure 7:
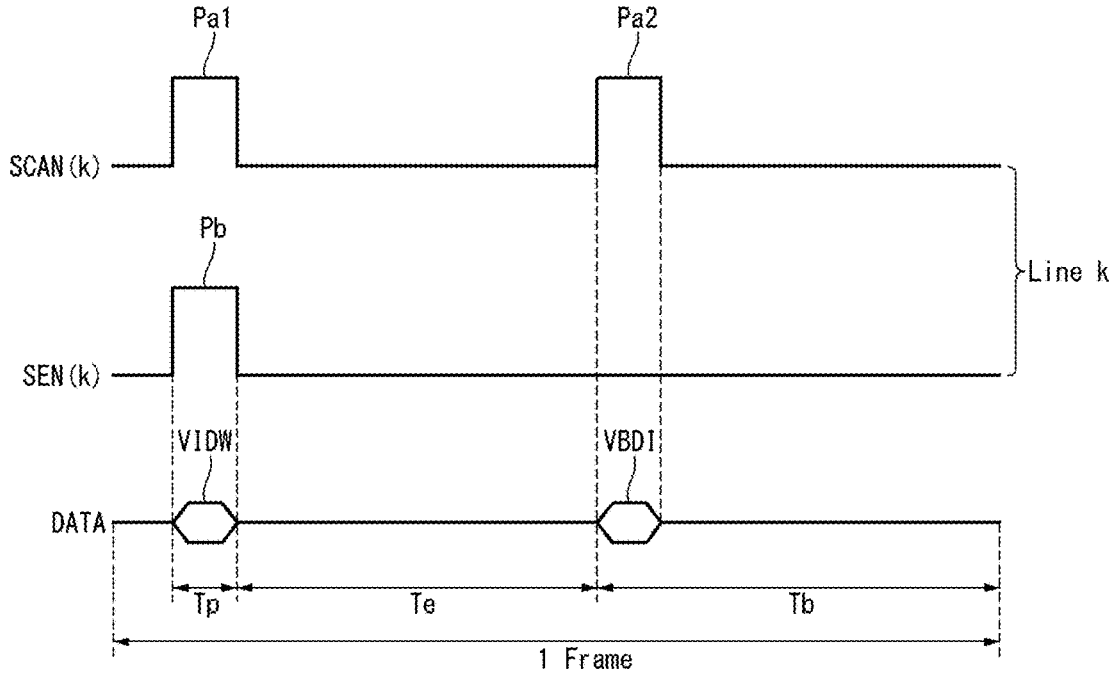
FIG. 7 is a timing chart of a gate signal and a data signal for implementing IDW driving and BDI driving in FIG. 6.
Figure 8A:
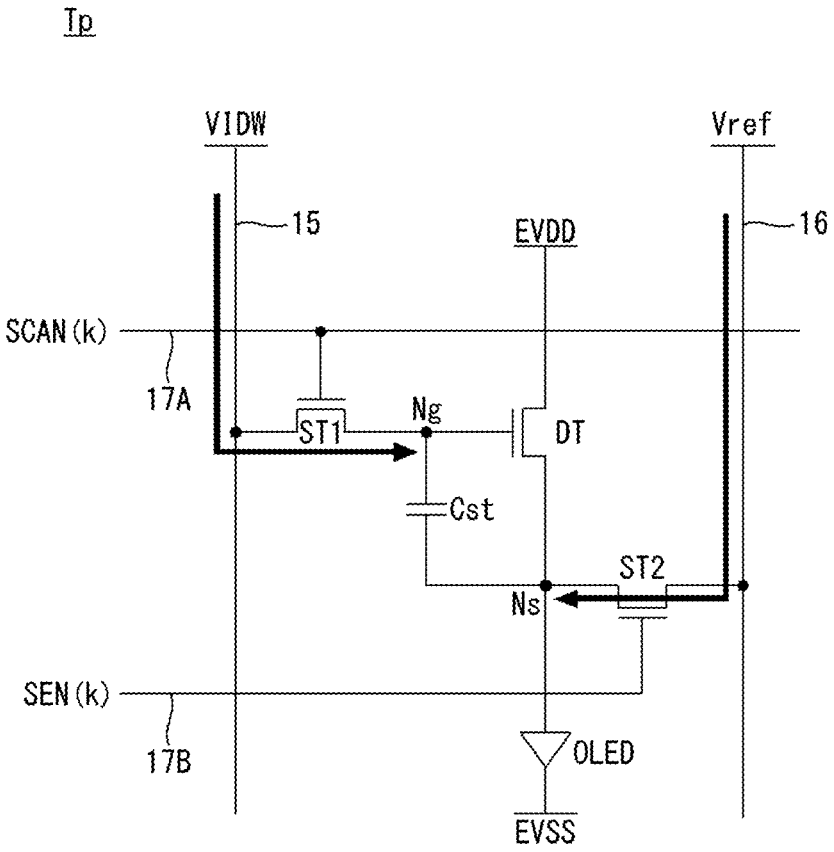
FIG. 8A is an equivalent circuit diagram of a pixel corresponding to a programming period of FIG. 7.
Figure 8B:
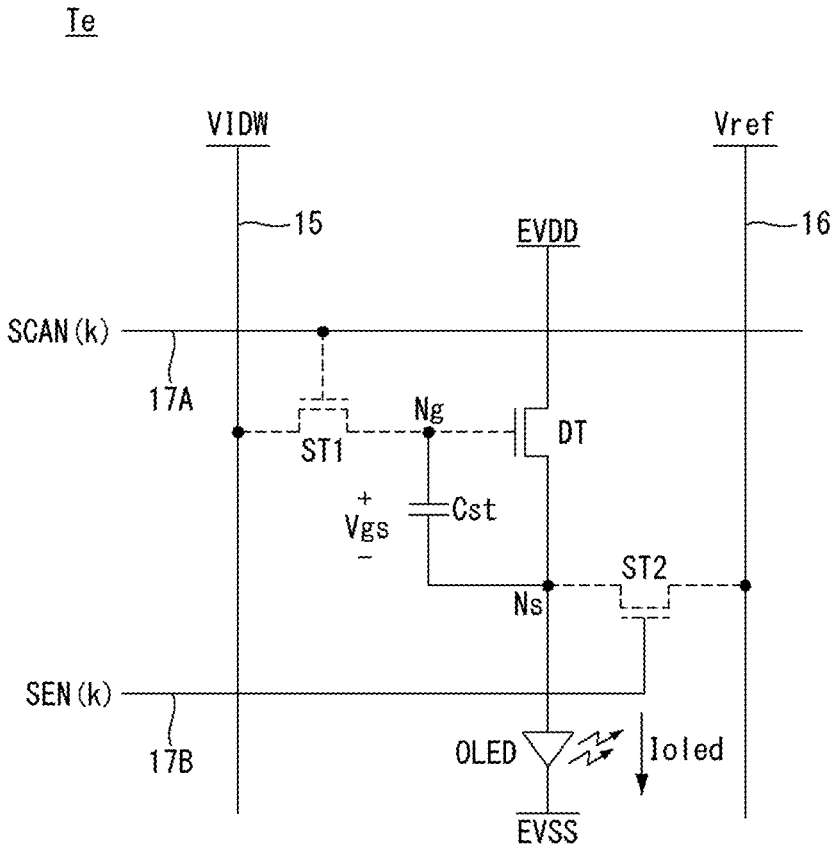
FIG. 8B is an equivalent circuit diagram of a pixel corresponding to an emission period of FIG. 7.
Figure 8C:
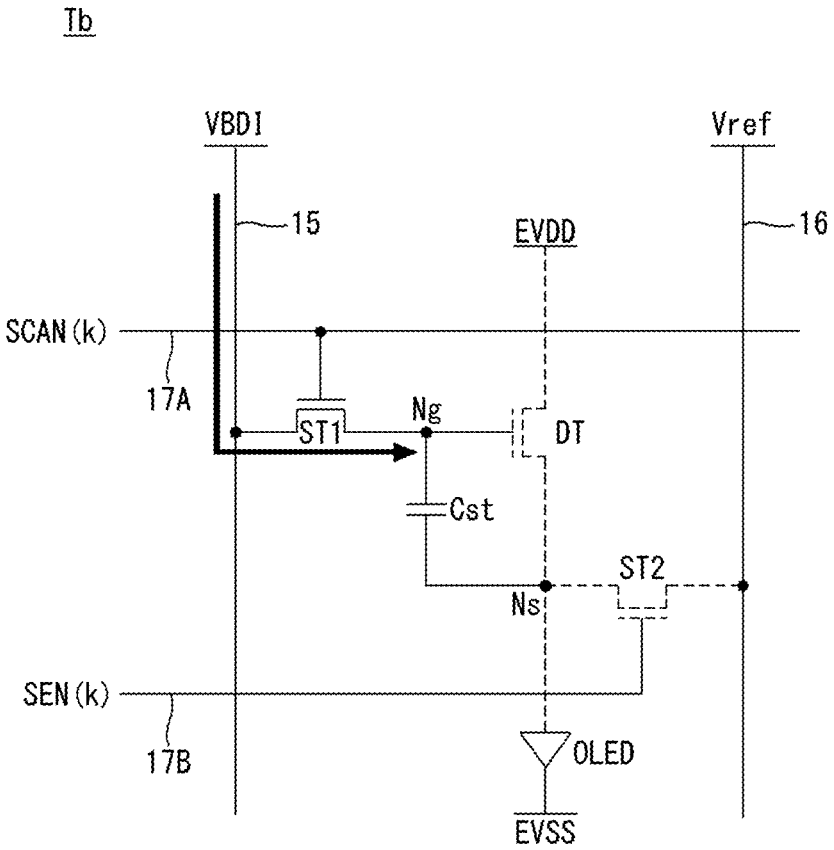
FIG. 8C is an equivalent circuit diagram of a pixel corresponding to a black period of FIG. 7.

FIG. 7 is a timing chart of a gate signal and a data signal for implementing IDW driving and BDI driving of FIG. 6 in a kth pixel line. FIG. 8A is an equivalent circuit diagram of a pixel corresponding to a programming period of FIG. 7. FIG. 8B is an equivalent circuit diagram of a pixel corresponding to an emission period of FIG. 7. FIG. 8C is an equivalent circuit diagram of a pixel corresponding to a black period of FIG. 7.

FIG. 7 illustrates IDW and BDI driving for a specific pixel of a kth pixel line Line k. Referring to FIG. 7, one frame for IDW and BDI driving includes a programming period Tp in which a voltage between the gate node Ng and the source node Ns is set to match a pixel current for gradation representation, an emission period Te in which the OLED emits light according to the pixel current, and a black period Tb in which emission of the OLED is stopped. The emission duty may correspond to the emission period Te and the black duty may correspond to the black period Tb. In FIG. 7, the IDW scan signal SCAN is illustrated as Pa1, the BDI scan signal SCAN is illustrated as Pa2, and the IDW sense signal SEN is illustrated as Pb.

Referring to FIGS. 7 and 8A, during the programming period Tp, the first switch TFT ST1 of the pixel is turned on according to the IDW scan signal Pa1 and applies the IDW data voltage VIDW to the gate node Ng. During the programming period Tp, the second switch TFT ST2 of the pixel is turned on according to the IDW sense signal Pb and applies the reference voltage Vref to the source node Ns. Accordingly, a voltage between the gate node Ng and the source node Ns of the pixel is set to fit to a desired pixel current during the programming period Tp.

Referring to FIGS. 7 and 8B, during the emission period Te, the first switch TFT ST1 and the second switch TFT ST2 of the pixel are turned off. The voltage Vgs between the gate node Ng and the source node Ns previously set in the pixel in the programming period Tp is also maintained during the emission period Te. Since the voltage Vgs between the gate node Ng and the source node Ns is larger than a threshold voltage of the driving TFT DT of the pixel, a pixel current Ioled flows at the driving TFT DT of the pixel during the emission period. A potential of the gate node Ng and a potential of the source node Ns are boosted by the pixel current Ioled, while the voltage Vgs between the gate node Ng and the source node Ns is maintained, during the emission period Td. When the potential of the source node Ns is boosted to an operating point level of the OLED, the OLED of the pixel emits light.

Referring to FIGS. 7 and 8C, during the black period Tb, the first switch TFT ST1 of the pixel is turned on according to the scan signal Pa2 for BDI and applies a data voltage VBDI for BDI. In the black period Tb, the second switch TFT ST2 of the pixel maintains a turned-off state, and thus, a potential of the source node Ns maintains an operating point level of the OLED. The data voltage VBDI for BDI is lower than the operating point level of the OLED. Therefore, since the voltage Vgs between the gate node Ng and the source node Ns is smaller than a threshold voltage of the driving TFT DT in the black period Tb, the pixel current Ioled does not flow to the driver TFT DT of the pixel and the OLED stops emitting light.

Figure 9:
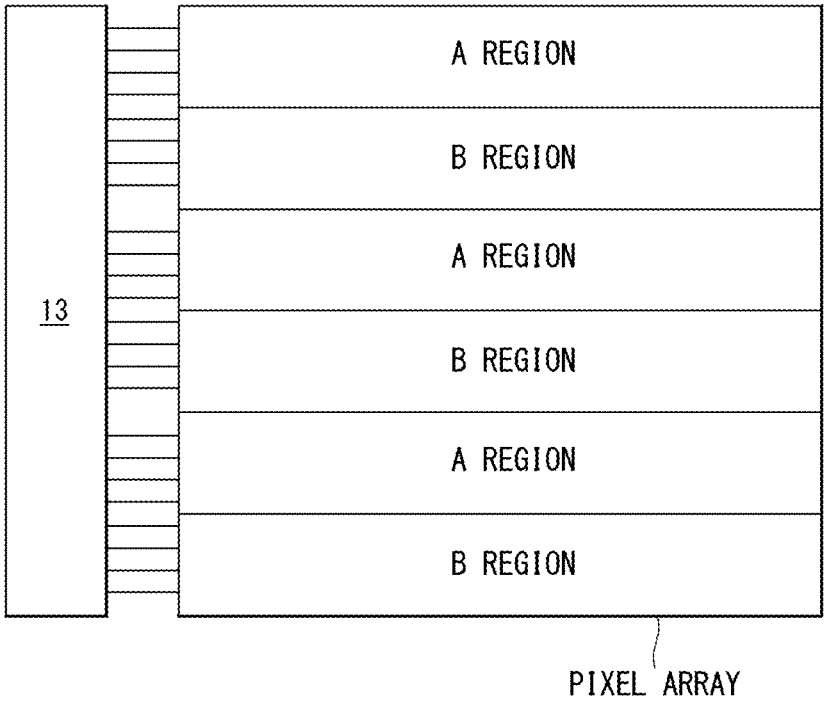
FIG. 9 is a view illustrating an example in which a pixel array is divided into a plurality of first regions and a plurality of second regions on the basis of phase-separated first clock group and second clock group so as to be driven.

FIG. 9 is a view illustrating an example in which a pixel array is divided into a plurality of first regions and a plurality of second regions on the basis of phase-separated first clock group and second clock group so as to be driven.

In the pixel array, a first region and a second region may be alternately arranged. When the pixel array is divided into a plurality of first regions and a plurality of second regions on the basis of this arrangement and separately driven, a design freedom for adjusting an emission duty ratio increases.

Figure 10:
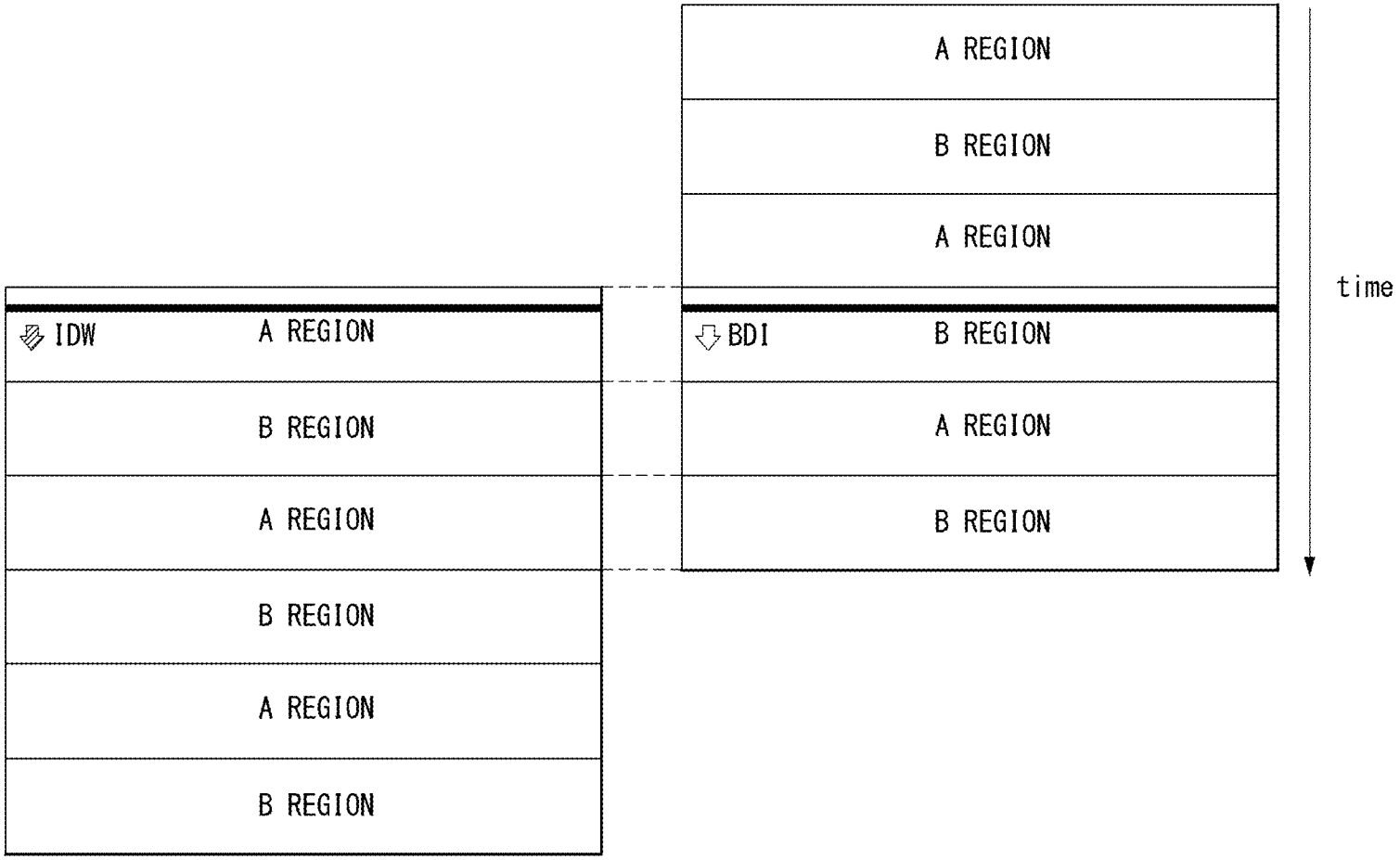
FIG. 10 is a timing chart illustrating a way in which black data is sequentially written into regions A1-B1-A2-B2-A3-

In FIG. 10, a write timing of the IDW data voltage VIDW is sequentially shifted from the uppermost region A of the pixel array according to an IDW start signal, and at the same time, a write timing of the BDI data voltage VBDI is sequentially shifted from a middle region B of the pixel array according to a BDI start signal. This may be performed when the BDI start signal is adjusted to be applied to any one of the second regions at a time point when IDW driving according to the IDW start signal is applied to any one of the first regions.

FIG. 11 is a view illustrating a comparison between the aspects of the present disclosure and the related art for reducing the number of clock lines. In FIG. 11, S/R denotes a shift register unit that outputs a scan signal, a sense signal, and a carry signal.

Referring to FIG. 11, the related art uses 16-phase scan clocks SC(8,8), 16-phase sense clocks SE(8,8), and 16-phase carry clocks CR(8,8) to implement IDW driving and BDI driving. In order to input 16-phase scan clocks SC(8,8) to the gate driver, 16 scan clock lines are required. In order to input 16-phase sense clocks SE(8,8) to the gate driver, 16 sense clock lines are required. In order to input 16-phase carry clocks CR(8,8) to the gate driver, 16 carry clock lines are required. As a result, the related art has a difficulty in implementing a narrow bezel due to the 48 clock lines and consumes a large amount of power to generate the 48 clocks.

Therefore, the present disclosure provides a method for effectively reducing the number of clocks and the number of clock lines in implementing IDW driving and BDI driving.

In a first aspect of the present disclosure described below with reference to FIGS. 12 to 15, by adding a BDI memory to each stage of the gate driver, in addition to a shift register unit, and adding 6 BDI control signals, 8 sense clocks and 8 carry clocks may be omitted. In the case of the first aspect of the present disclosure, since 38 clocks and 38 clock lines are required, it is easier to implement a narrow bezel or reduce power consumption as compared with the related art.

In a second aspect of the present disclosure described below with reference to FIGS. 16 to 20, by adding a BDI memory and a data memory to each stage of the gate driver in addition to the shift register unit, and adding 8 BDI control signals, 8 scan clocks, 8 sense clocks, and 8 carry clocks may be omitted. In the case of the second aspect of the present disclosure, since 32 clock and 32 clock lines are required, it is even easier to implement a narrow bezel and reduce power consumption as compared with the related art.

In a third aspect of the present disclosure described below with reference to FIGS. 21 to 25, by adding a BDI memory and a data memory to each stage of the gate driver in addition to the shift register unit, and adding 7 BDI control signals, 8 scan clocks, 8 sense clocks, and 8 carry clocks may be omitted. In the case of the third aspect of the present disclosure, since 31 clock and 31 clock lines are required, it is easier to implement a narrow bezel and reduce power consumption as compared with the related art.

[First Aspect]

FIG. 12 is a view illustrating a clock connection configuration of a gate driver according to the first aspect of the present disclosure.

Referring to FIG. 12, the gate driver according to the first aspect of the present disclosure may be implemented by gate shift registers and clock lines in which A block and B block are alternately arranged. The A block and the B block may each include a plurality of stages. When scan clocks SCCLK are implemented as 2N-phase clocks (e.g., 16 phase clocks), carry clocks CRCLK are implemented as N-phase clocks (e.g., 8 phase clocks), and sense clocks SECLK are implemented as N-phase clocks (e.g., 8 phase clocks), the A block and the B block may each include N stages (e.g., 8 stages).

The scan clocks SCCLK include N-phase first scan clock group SCCLK1~8 including both IDW scan clocks synchronized with an image write timing and BDI scan clocks synchronized with a black write timing and an N-phase second scan clock group SCCLK9~16 including both the IDW scan clocks and the BDI scan clocks. The N-phase first scan clock group SCCLK1~8 are input to the A blocks through N scan clock lines 12A and the N-phase second scan clock group SCCLK9~16 are input to B blocks through the N scan clock lines 12A.

The N-phase carries clocks CRCLK1~8 are input to the A blocks and B blocks through N carry clock lines 12B. Also, the N-phase sense clocks SECLK1~8 on the N-phase are input to the A blocks and the B blocks through N sense clock lines 12C.

According to the first aspect of the present disclosure, since the sense clocks and the carry clocks are implemented as N-phase clocks, the number of the carry clock lines 12B and the number of the sense clock lines 12C are half of the number of the scan clock lines 12A. However, in order to implement IDW driving and BDI driving described above, each of the stages that belong to the A block and the B block may further include a BDI memory in addition to the shift register unit to store a BDI carry signal for outputting BDI scan clocks and may further receive K (K is a natural number smaller than N) BDI control signals (e.g., 6 BDI control signals) to control an operation of the BDI memory.

The 6 additional BDI control signals may include 4 BDI clocks BCLK1~4, one BDI start signal BVST, and one BDI reset signal BRST. Four BDI clock lines 12D may further be provided for inputting four BDI clocks BCLK1~4, one BDI reset line 12E may further be provided for inputting one BDI reset signal BRST, and one BDI start line 12F may further be provided for inputting one BDI start signal BVST.

Among the 4 BDI clocks BCLK1~4, the first BDI clock group BCLK1~2 is input to the A blocks through the BDI clock lines 12D, and the second BDI clock group BCLK3~4 is input to the B blocks through the BDI clock lines 12D.

The BDI reset signal BRST is input to the A blocks and the B blocks through the BDI reset line 12E, and the BDI start signal BVST is input to the A blocks and the B blocks through the BDI start line 12F.

The IDW start signal VST is input to the uppermost stage, among the stages constituting the A blocks, and the IDW carry signal CR is input to the other remaining stages of the A blocks and B blocks excluding the uppermost stage. The high potential power supply voltage GVDD and the low potential power supply voltage GVSS are input to all the stages of the A blocks and the B blocks. The IDW carry signal CR includes a previous stage IDW carry signal and a subsequent stage IDW carry signal. The previous stage IDW carry signal may be output from any one of the previous stages and may be synchronized with any of the N-phase carry clocks CRCLK1 to CRCLK8. The subsequent stage IDW carry signal may be output from any of the subsequent stages and may be synchronized with any one of the N-phase carry clocks CRCLK1 to CRCLK8.

The BDI start signal BVST is a BDI carry signal for determining a start timing of BDI driving. A Q node voltage of any one of the previous stages is input as a BDI carry signal to the other remaining blocks excluding a specific A or B block to which the BDI start signal BVST is input.

While IDW driving is performed in any one of the A blocks, BDI driving is performed in any one of the B blocks. To this end, the BDI scan clocks are input to the B block, while the IDW scan clocks are input to the A block. Also, the Q nodes of the stages belonging to the A block maintain the gate-on voltage, while the BDI scan clocks are input to the B block.

Conversely, while IDW driving is performed in any one of the B blocks, BDI driving is performed in any one of the A blocks. To this end, the BDI scan clocks are input to the A block, while the IDW scan clocks are input to the B block. Also, the Q nodes of the stages belonging to the B block maintain the gate-on voltage, while the BDI scan clocks are input to the A block.

Meanwhile, when BDI driving is performed in any one of the A blocks, the BDI carry signal is simultaneously stored upon receiving the Q node voltage (gate-on voltage) of the stages belonging to the A block from any one of the B blocks. Also, when BDI driving is performed in one of the B blocks, the BDI carry signal is simultaneously stored upon receiving the Q node voltage (gate-on voltage) of the stages belonging to the B block from any one of the A blocks.

FIG. 13 is a view illustrating a configuration of an nth stage of the A block illustrated in FIG. 12. FIG. 14 is a view illustrating a configuration of an nth stage of the B block illustrated in FIG. 12.

Referring to FIG. 13, the nth stage of the A block to which the technical idea of the present disclosure is applied may include a first shift register unit and a first BDI memory PAT5.

The first shift register unit outputs an IDW scan clock SCCLK(n) belonging to the first scan clock group SCCLK1~8 as a scan signal SCOUT(n) for image writing, outputs the BDI scan clock SCCLK(n) belonging to the first scan clock group SCCLK1~8 as a scan signal SCOUT(n) for black writing, outputs the carry clock CRCLK(n) as a carry signal for image writing, and outputs the sense clock SECLK(n) as a sense signal for image writing during a period in which the Q node of the nth stage is activated by the gate-on voltage.

The first shift register unit may include an input and reset unit PAT1, an inverter unit PAT2, an output unit PAT3, and a stabilization unit PAT4.

The input and reset unit PAT1 charges the Q node with the gate-on voltage (i.e., the high potential power supply voltage GVDD) according to the previous stage carry signal CR (n−4) and discharges the Q node to a gate-off voltage (i.e., a low potential power supply voltage GVSS) according to the subsequent stage carry signal CR(n+4). The input and reset unit PAT1 includes a transistor T11 for charging the Q node with the previous stage carry signal of the gate-on voltage and a transistor T12 discharging the Q node to the low-potential power supply voltage GVSS according to the subsequent stage carry signal CR(n+4). The previous stage carry signal CR(n−4) is input to a gate electrode and a first electrode of the transistor T11, and a second electrode of the transistor T11 is connected to the Q node. The subsequent stage carry signal CR(n+4) is input to a gate electrode of the transistor T12, and a first electrode of the transistor T12 is connected to the Q node and the low-potential power supply voltage GVSS is input to a second electrode of the transistor T12.

The inverter unit PAT2 charges/discharges a voltage of a Qb node, reversely to that of the Q node, according to a voltage of the Q node. The inverter unit PAT2 includes a transistor T24 which discharges the Qb node to the low potential power supply voltage GVSS (i.e., gate-off voltage) when the Q node is charged with the gate-on voltage, transistors T21 to T23 which charges the Qb node with the high potential power supply voltage GVDD (i.e., the gate-on voltage) when the Q node is discharged to the gate-off voltage, and transistors T25 and T26 which discharges the Qb node to the low potential power supply voltage GVSS according to a voltage of an M node and the second BDI clock BCLK2 belonging to the first BDI clock group.

A gate electrode of the transistor T21 is connected to an NX node, the high potential power supply voltage GVDD is input to a first electrode of the transistor T21, and a second electrode of the transistor T21 is connected to the Qb node. The high potential power supply voltage GVDD is input to a gate electrode and a first electrode of the transistor T22, and a second electrode of the transistor T22 is connected to the NX node. A gate electrode of the transistor T23 is connected to the Q node, a first electrode of the transistor T23 is connected to the NX node, and the low potential power supply voltage GVSS is input to a second electrode of the transistor T23. A gate electrode of the transistor T24 is connected to the Q node, a first electrode of the transistor T24 is connected to the Qb node, and the low potential power supply voltage GVSS is input to a second electrode of the transistor T24. The second BDI clock BCLK2 is input to a gate electrode of the transistor T25, a first electrode of the transistor T25 is connected to the Qb node, and one electrode of the transistor T26 is connected to a second electrode of the transistor T25. A gate electrode of the transistor T26 is connected to an M node, a first electrode of the transistor T26 is connected to the second electrode of the transistor T25, and the low potential power supply voltage GVSS is input to a second electrode of the transistor T26.

The output unit PAT3 may include three output terminals NO1 to NO3 which share the Q node, thereby simplifying the circuit. The output unit PAT3 includes a pull-up transistor T31 outputting the carry clock signal CRCLK(n) as the carry signal CR(n) for image writing while the Q node is being bootstrapped to a voltage higher than the gate-on voltage, a pull-up transistor T32 outputting the IDW scan clock SCCLK(n) as a scan signal SCOUT(n) for image writing or outputting the BDI scan clock SCCLK(n) as a scan signal SCOUT(n) for black writing, and a pull-up transistor T33 outputting the sense clock signal SECLK(n) as a sense signal SEN(n) for image writing. A gate electrode of the pull-up transistor T31 is connected to the Q node, the carry clock signal CRCLK(n) is input to a first electrode of the pull-up transistor T31, and a second electrode of the pull-up transistor T31 is connected to a first output terminal NO1. A gate electrode of the pull-up transistor T32 is connected to the Q node, the scan clock signal SCCLK(n) is input to a first electrode of the pull-up transistor T32, and a second electrode of the pull-up transistor T32 is connected to a second output terminal NO2. A first booster capacitor CO1 may further be connected between the gate electrode of the pull-up transistor T32 and the second output terminal NO2. A gate electrode of the pull-up transistor T33 is connected to the Q node, the sense clock signal SECLK(n) is input to the first electrode of the pull-up transistor T33, and a second electrode of the pull-up transistor T33 is connected to a third output terminal NO3. A second booster capacitor CO2 may further be connected between the gate electrode of the pull-up transistor T33 and the third output terminal NO3.

The stabilization unit PAT4 includes pull-down transistors T41 to T43 suppressing ripples of the output terminals NO1 to NO3, while the Qb node is being charged with the gate-on voltage and a transistor T44 suppressing a ripple of the Q node. The gate electrodes of the pull-down transistors T41 to T43 are connected to the Qb node, and the low potential power supply voltage GVSS is input to the second electrodes of the pull-down transistors T41 to T43. The first electrode of the pull-down transistor T41 is connected to the first output terminal NO1, the first electrode of the pull-down transistor T42 is connected to the second output terminal NO2, and the first electrode of the pull-down transistor R43 is connected to the third output terminal NO3. The gate electrode of the transistor T44 is connected to the Qb node, the first electrode of the transistor T44 is connected to the Q node, and the low potential power supply voltage GVSS is input to the second electrode of the transistor T44.

The first BDI memory PAT5 charges the M node with the gate-on voltage according to the first BDI clock BCLK1 belonging to the first BDI clock group BCLK1~2, applies the charged voltage of the M node to the Q node according to the second BDI clock BCLK2 belonging to the first BDI clock group BCLK1~2, and discharges the Q node to the gate-off voltage according to the BDI reset signal BRST.

To this end, the first BDI memory PAT5 includes a transistor T51A turning on/off a current flow between a Q node (e.g., Q(n−8) node) of any one of the block stages B and the M node according to the first BDI clock BCLK1, a transistor T53A turning on/off a current flow between the input terminal of the high potential power supply voltage GVDD and the Q node according to the second BDI clock BCLK2, a transistor T52A turning on/off a current flow between the input terminal of the high potential power supply voltage GVDD and the transistor T53A according to a voltage of the M node, a transistor T55A turning on/off a current flow between the Q node and the input terminal of the low potential power supply voltage GVSS according to the BDI reset signal BRST, a transistor T54A turning on/off a current flow between the Q node and the transistor T55A according to the voltage of the M node, and a capacitor CA connected between the M node and the input terminal of the low-potential power supply voltage GVSS.

The first BDI clock BCLK1 is input to a gate electrode of the transistor T51A and a first electrode and a second electrode of the transistor T51A are connected to a Q node (e.g., Q(n−8) node) of any one of the block stages B and the M node. A gate electrode of the transistor T52A is connected to the M node, and a first electrode and a second electrode of the transistor T52A are connected to the input terminal of the high potential power supply voltage GVDD and one electrode of the transistor T53A. The second BDI clock BCLK2 is input to a gate electrode of the transistor T53A, and a first electrode and a second electrode of the transistor T53A are connected to the second electrode of the transistor T52A and the Q node. A gate electrode of the transistor T54A is connected to the M node, and a first electrode and a second electrode of the transistor T54A are connected to the Q node and one electrode of the transistor T55A. The BDI reset signal BRST is input to a gate electrode of the transistor T55A and a first electrode and a second electrode of the transistor T55A are connected to the second electrode of the transistor T54A and the input terminal of the low potential power supply voltage GVSS. The capacitor CA maintains the BDI carry signal (either the Q node voltage of any one of the block stages B or the BDI start signal) charged in the M node for a predetermined time.

Referring to FIG. 14, the nth stage of the B block to which the technical idea of the present disclosure is applied may include a second shift register unit and a second BDI memory PAT5.

The second shift register unit outputs the IDW scan clock SCCLK(n), which belongs to the second scan clock group SCCLK9~16, as a scan signal SCOUT(n) for image writing, outputs the BDI scan clock SCCLK(n), which belongs to the second scan clock group SCCLK9~16, as a scan signal SCOUT(n) for black writing, outputs the carry clock CRCLK(n) as a carry signal for image writing, and outputs the sense clock SECLK(n) as a sense signal for image writing, during a period in which the Q node of the nth stage is activated by the gate-on voltage.

The second shift register unit may include an input and reset unit PAT1, an inverter unit PAT2, an output unit PAT3, and a stabilization unit PAT4.

The input and reset unit PAT1 charges the Q node with the gate-on voltage (i.e., the high potential power supply voltage GVDD) according to the previous stage carry signal CR(n−4) and discharges the Q node to the gate-off voltage (i.e., the low potential power supply voltage GVSS) according to the subsequent stage carry signal CR(n+4). A configuration of the input and reset unit PAT1 is substantially the same as that described above with reference to FIG. 13.

The inverter unit PAT2 charges/discharges a voltage of a Qb node, reversely to that of the Q node, according to a voltage of the Q node. The inverter unit PAT2 includes a transistor T24 which discharges the Qb node to the low potential power supply voltage GVSS (i.e., gate-off voltage) when the Q node is charged with the gate-on voltage, transistors T21 to T23 which charges the Qb node with the high potential power supply voltage GVDD (i.e., the gate-on voltage) when the Q node is discharged to the gate-off voltage, and transistors T25 and T26 which discharge the Qb node to the low potential power supply voltage GVSS according to a voltage of the M node and the fourth BDI clock BCLK4 belonging to the second BDI clock group.

A gate electrode of the transistor T21 is connected to an NX node, the high potential power supply voltage GVDD is input to a first electrode of the transistor T21, and a second electrode of the transistor T21 is connected to the Qb node. The high potential power supply voltage GVDD is input to a gate electrode and a first electrode of the transistor T22, and a second electrode of the transistor T22 is connected to the NX node. A gate electrode of the transistor T23 is connected to the Q node, a first electrode of the transistor T23 is connected to the NX node, and the low potential power supply voltage GVSS is input to a second electrode of the transistor T23. A gate electrode of the transistor T24 is connected to the Q node, a first electrode of the transistor T24 is connected to the Qb node, and the low potential power supply voltage GVSS is input to a second electrode of the transistor T24. The fourth BDI clock BCLK4 is input to a gate electrode of the transistor T25, a first electrode of the transistor T25 is connected to the Qb node, and one electrode of the transistor T26 is connected to a second electrode of the transistor T25. A gate electrode of the transistor T26 is connected to an M node, a first electrode of the transistor T26 is connected to the second electrode of the transistor T25, and the low potential power supply voltage GVSS is input to a second electrode of the transistor T26.

The output unit PAT3 may include three output terminals NO1 to NO3 which share the Q node, thereby simplifying the circuit. The output unit PAT3 includes a pull-up transistor T31 outputting the carry clock signal CRCLK(n) as the carry signal CR(n) for image writing while the Q node is being bootstrapped to a voltage higher than the gate-on voltage, a pull-up transistor T32 outputting the IDW scan clock SCCLK(n) as a scan signal SCOUT(n) for image writing or outputting the BDI scan clock SCCLK(n) as a scan signal SCOUT(n) for black writing, and a pull-up transistor T33 outputting the sense clock signal SECLK(n) as a sense signal SEN(n) for image writing.

The stabilization unit PAT4 includes pull-down transistors T41 to T43 suppressing ripples of the output terminals NO1 to NO3, while the Qb node is being charged with the gate-on voltage and a transistor T44 suppressing a ripple of the Q node. A configuration of the stabilization unit PAT4 is substantially the same as that described above with reference to FIG. 13.

The second BDI memory PAT5 charges the M node with the gate-on voltage according to the third BDI clock BCLK3 belonging to the second BDI clock group BCLK3~4, applies the charged voltage of the M node to the Q node according to the fourth BDI clock BCLK4 belonging to the second BDI clock group BCLK3~4, and discharges the Q node to the gate-off voltage according to the BDI reset signal BRST.

To this end, the second BDI memory PAT5 includes a transistor T51B turning on/off a current flow between a Q node (e.g., Q(n−8) node) of any one of the block stages A and the M node according to the third BDI clock BCLK3, a transistor T53B turning on/off a current flow between the input terminal of the high potential power supply voltage GVDD and the Q node according to the fourth BDI clock BCLK4, a transistor T52B turning on/off a current flow between the input terminal of the high potential power supply voltage GVDD and the transistor T53B according to a voltage of the M node, a transistor T55B turning on/off a current flow between the Q node and the input terminal of the low potential power supply voltage GVSS according to the BDI reset signal BRST, a transistor T54B turning on/off a current flow between the Q node and the transistor T55B according to the voltage of the M node, and a capacitor CB connected between the M node and the input terminal of the low-potential power supply voltage GVSS.

The third BDI clock BCLK3 is input to a gate electrode of the transistor T51B and a first electrode and a second electrode of the transistor T51B are connected to a Q node (e.g., Q(n−8) node) of any one of the block stages A and the M node. A gate electrode of the transistor T52B is connected to the M node, and a first electrode and a second electrode of the transistor T52B are connected to the input terminal of the high potential power supply voltage GVDD and one electrode of the transistor T53B. The fourth BDI clock BCLK4 is input to a gate electrode of the transistor T53B, and a first electrode and a second electrode of the transistor T53B are connected to the second electrode of the transistor T52B and the Q node. A gate electrode of the transistor T54B is connected to the M node, and a first electrode and a second electrode of the transistor T54B are connected to the Q node and one electrode of the transistor T55B. The BDI reset signal BRST is input to a gate electrode of the transistor T55B and a first electrode and a second electrode of the transistor T55B are connected to the second electrode of the transistor T54B and the input terminal of the low potential power supply voltage GVSS. The capacitor CB maintains the BDI carry signal (either the Q node voltage of any one of the block stages A or the BDI start signal) charged in the M node for a predetermined time.

FIG. 15 is a detailed waveform view illustrating operations of the A blocks and B blocks illustrated in FIG. 12. In FIG. 15, the scan clocks SCCLK1~16, the BDI clocks BCLK1~4, the BDI start signal BVST, and the BDI reset signal BRST swing between a relatively high gate-on voltage and a relatively low gate-off voltage. Also, voltages of the M node swing between the gate-on voltage and the gate-off voltage. Also, the voltages of the Q node swing between the gate-on voltage and the gate-off voltage, and in particular, increase to a boosting voltage in synchronization with the scan clocks SCCLK1~16. The boosting voltage is higher than the gate-on voltage.

Referring to FIGS. 12 to 15, when BDI driving is performed in the A block (#1~8), IDW driving is performed in the B block (#1081~1088). Subsequently, when BDI driving is performed in the B block (#9~16), IDW driving is performed in the A block (#1089~1096). Subsequently, when BDI driving is performed in the A block (#17~24), IDW driving is performed in the B block (#1097~1104).

To this end, during an interval ①, the M node of the A block (#1~8) is charged with the BDI start signal BVST of the gate-on voltage (or the previous stage Q(n−8) node voltage) according to the first BDI clock BCLK1. The BDI start signal BVST (or the previous stage Q(n−8) node voltage) becomes a BDI carry signal. The M node of A block (#1~8) store the BDI carry signal from the interval ① to an interval ④ to maintain the charged state.

Subsequently, between the interval ① and ②, IDW driving is performed in the B block (#1081~1088). The B block (#1081~1088) outputs some SCCLK9~12 of the IDW scan clocks of the second scan clock group SCCLK9~16, as scan signals for image writing.

Subsequently, during the interval ②, the Q node of the B block (#1081~1088) being IDW-driven is activated by the gate-on voltage. Here, according to the second BDI clock BCLK2, the Q node of the A block (#1~8) is connected to the M node and charged with the gate-on voltage.

Subsequently, during an interval ③, the Q node of the A block (#1~8) is bootstrapped in synchronization with the BDI scan clocks of the first scan clock group (SCCLK1~8), and as a result, the A block (#1~8) is BDI-driven. That is, the A block (#1~8) outputs the BDI scan clocks of the first scan clock group (SCCLK1~8) as scan signals for black writing. Here, the M node of the B block (#9~16) is charged with the Q node voltage of the A block (#1~8) of the gate-on voltage according to the third BDI clock BCLK3.

Subsequently, during an interval ④, the Q node of the A block (#1~8) is discharged to the gate-off voltage according to the BDI reset signal BRST.

Subsequently, during the interval ⑤, the M node of the A block (#1~8) is discharged to the BDI start signal BVST (or previous stage Q(n−8) node voltage) according to the first BDI clock BCLK1.

Meanwhile, in the B block (#1081~1088), IDW driving is temporarily stopped during the ②, ③, and ④ intervals. This is to prevent a collision between a data voltage for IDW (or IDW data voltage) and a data voltage for BDI (or BDI data voltage). In the B block (#1081~1088), IDW driving is resumed during the ⑤ interval. The B block (#1081~1088) outputs the remaining (SCCLK13~16) among the IDW scan clocks of the second scan clock group (SCCLK9~16) as scan signals for image writing.

In this manner, the BDI scan clocks are input to the B block, while the IDW scan clocks are being input to the A block, and the BDI scan clocks are input to the A block, while the IDW scan clocks are being input to the B block.

While the BDI scan clocks are being input to the A block, the Q nodes of the stages belonging to the B block maintain the gate-on voltage, and while the BDI scan clocks are being input to the B block, the Q nodes of the stages belonging to the A block maintain the gate-on voltage.

The BDI carry signal is stored at the B block in synchronization with a timing at which the BDI scan clocks are input to the A block, and the BDI carry signal is stored at the A block in synchronization with a timing at which the BDI scan clocks are input to the B block.

[Second Aspect]

FIG. 16 is a view illustrating a clock connection configuration of a gate driver according to a second aspect of the present disclosure.

Referring to FIG. 16, the gate driver according to the second aspect of the present disclosure may be implemented by gate shift registers and clock lines in which A block, B block, and C block are alternately arranged. The A block, the B block, and the C block may each include a plurality of stages. When scan clocks SCCLK are implemented as N-phase clocks (e.g., 8 phase clocks), carry clocks CRCLK are implemented as N-phase clocks (e.g., 8 phase clocks), and sense clocks SECLK are implemented as N-phase clocks (e.g., 8 phase clocks), the A block, the B block, and the C block may each include N stages (e.g., 8 stages).

The scan clocks SCCLK include N-phase scan clock group SCCLK1~8 including both IDW scan clocks synchronized with an image write timing and BDI scan clocks synchronized with a black write timing. The N-phase scan clock group SCCLK1~8 are input to A blocks, B blocks, and C blocks through N scan clock lines 16A.

The N-phase carry clocks CRCLK1~8 are input to the A blocks, B blocks, and C blocks through N carry clock lines 16B. Also, the N-phase sense clocks SECLK1~8 on the N-phase are input to the A blocks, B blocks, and C blocks through N sense clock lines 16C.

According to the second aspect of the present disclosure, since the sense clocks and the carry clocks are implemented as N-phase clocks, the number of the carry clock lines 16B and the number of the sense clock lines 16C are equal to the number of the scan clock lines 16A. However, in order to implement IDW driving and BDI driving described above, each of the stages that belong to the A block, the B block, and C block may further include a BDI memory in addition to the shift register unit to store a BDI carry signal for outputting BDI scan clocks and may further receive N BDI control signals (e.g., 8 BDI control signals) to control an operation of the BDI memory. Each of the stages belonging to the A block, the B block, and the C block may further include a data memory in addition to the shift register unit to store an IDW carry signal for outputting IDW scan clocks.

The 8 additional BDI control signals may include 6 BDI clocks BCLK1~6, one BDI start signal BVST, and one BDI reset signal BRST. Six BDI clock lines 16D may further be provided for inputting 6 BDI clocks BCLK1~6, one BDI reset line 16E may further be provided for inputting one BDI reset signal BRST, and one BDI start line 16F for inputting one BDI start signal BVST may further be provided.

Among the 6 BDI clocks BCLK1~6, the first BDI clock group BCLK1~2 is input to the A blocks through the BDI clock lines 16D, the second BDI clock group BCLK3~4 is input to the B blocks through the BDI clock lines 16D, and the third BDI clock group BCLK5~6 is input to the C blocks through the BDI clock lines 16D.

The BDI reset signal BRST is input to the A blocks, the B blocks, and the C blocks through the BDI reset line 16E, and the BDI start signal BVST is input to the A blocks, the B blocks, and the C blocks through the BDI start line 16F.

The IDW start signal VST is input to the uppermost stage, among the stages constituting the A blocks, and the IDW carry signal CR is input to the other remaining stages of the A blocks, the B blocks, and the C blocks excluding the uppermost stage. The high potential power supply voltage GVDD and the low potential power supply voltage GVSS are input to all the stages of the A blocks, the B blocks, and the C blocks. The IDW carry signal CR includes a previous stage IDW carry signal and a subsequent stage IDW carry signal. The previous stage IDW carry signal may be output from any one of the previous stages and may be synchronized with any of the N-phase carry clocks CRCLK1 to CRCLK8. The subsequent stage IDW carry signal may be output from any of the subsequent stages and may be synchronized with any one of the N-phase carry clocks CRCLK1 to CRCLK8.

The BDI start signal BVST is a BDI carry signal for determining a start timing of BDI driving. A Q node voltage of any one of the previous stages is input as a BDI carry signal to the other remaining blocks excluding a specific A, B, or C block, to which the BDI start signal BVST is input.

While IDW driving is performed in any one of the C blocks, BDI driving is performed in one of the A blocks, and while IDW driving is performed in any one of the A blocks, the BDI driving is performed in any one of the B blocks, and while IDW driving is performed in any one of the B blocks, BDI driving is performed in any one of the C blocks.

To this end, the BDI scan clocks are input to the A block while the IDW scan clocks are being input to the C block, the BDI scan clocks are input to the B block while the IDW scan clocks are being input into the A block, and the BDI scan clocks are input to the C block while the IDW scan clocks are being input to the B block.

Also, before the BDI scan clocks are input to the A block, the Q nodes of the stages belonging to the C block maintain the gate-on voltage, before the BDI scan clocks are input to the B block, the Q-nodes of the stages belonging to the A block maintain the gate-on voltage, and before the BDI scan clocks are input to the C block, the Q-nodes of the stages belonging to the B block maintain the gate-on voltage.

While the BDI scan clocks are input to the A block, the Q nodes of the stages belonging to the C block are discharged to the gate-off voltage, while the BDI scan clocks are input to the B block, the Q nodes of the stages belonging to the A block are discharged to the gate-off voltage, and while the BDI scan clocks are input to the C block, the Q nodes of the stages belonging to the B block are discharged to the gate-off voltage. Here, while the Q nodes are discharged to the gate-off voltage, the stages belonging to the A, B, and C blocks store the previous stage IDW carry signal (e.g., CR(n−4)) in the data memory.

Also, with reference to the previous stage IDW carry signal stored at the data memory, after the BDI scan clocks are input to the A block, the Q nodes of the stages belonging to the C block are recharged with the gate-on voltage, after the BDI scan clocks are input to the B block, the Q nodes of the stages belonging to the A block are recharged with the gate-on voltage, and after the BDI scan clocks are input to the C block, the Q nodes of the stages belonging to the B block are recharged with the gate-on voltage.

Meanwhile, when BDI driving is performed in any one of the A blocks, the BDI carry signal is simultaneously stored upon receiving the Q node voltage (gate-on voltage) of the stages belonging to the A block from any one of the B blocks. Also, when BDI driving is performed in one of the B blocks, the BDI carry signal is simultaneously stored upon receiving the Q node voltage (gate-on voltage) of the stages belonging to the B block from any one of the C blocks. Also, when BDI driving is performed in one of the C blocks, the BDI carry signal is simultaneously stored upon receiving the Q node voltage (gate-on voltage) of the stages belonging to the C block from any one of the A blocks.

FIG. 17 is a view illustrating a configuration of an nth stage of the A block illustrated in FIG. 16. FIG. 18 is a view illustrating a configuration of an nth stage of the B block illustrated in FIG. 16. FIG. 19 is a view illustrating a configuration of an nth stage of the C block illustrated in FIG. 16.

Referring to FIG. 17, the nth stage of the A block to which the technical idea of the present disclosure is applied may include a first shift register unit, a first BDI memory PAT5, and a first data memory PAT6.

The first shift register unit outputs an IDW scan clock SCCLK(n) belonging to the scan clock group SCCLK1~8 as a scan signal SCOUT(n) for image writing, outputs the BDI scan clock SCCLK(n) belonging to the scan clock group SCCLK1~8 as a scan signal SCOUT(n) for black writing, outputs the carry clock CRCLK(n) as a carry signal for image writing, and outputs the sense clock SECLK(n) as a sense signal for image writing during a period in which the Q node of the nth stage is activated by the gate-on voltage.

The first shift register unit may include an input and reset unit PAT1, an inverter unit PAT2, an output unit PAT5, and a stabilization unit PAT4.

The input and reset unit PAT1 charges the Q node with the gate-on voltage (i.e., the high potential power supply voltage GVDD) according to the previous stage carry signal CR(n−4) and discharges the Q node to the gate-off voltage (i.e., low potential power supply voltage GVSS) according to the subsequent stage carry signal CR(n+4). The input and reset unit PAT1 includes a transistor T11 for charging the Q node with the previous stage carry signal of the gate-on voltage and a transistor T12 discharging the Q node to the low-potential power supply voltage GVSS according to the subsequent stage carry signal CR(n+4). The previous stage carry signal CR(n−4) is input to a gate electrode and a first electrode of the transistor T11, and a second electrode of the transistor T11 is connected to the Q node. The subsequent stage carry signal CR(n+4) is input to a gate electrode of the transistor T12, and a first electrode of the transistor T12 is connected to the Q node and the low-potential power supply voltage GVSS is input to a second electrode of the transistor T12.

The inverter unit PAT2 charges/discharges a voltage of a Qb node, reversely to that of the Q node, according to a voltage of the Q node. The inverter unit PAT2 includes a transistor T24 which discharges the Qb node to the low potential power supply voltage GVSS (i.e., gate-off voltage) when the Q node is charged with the gate-on voltage, transistors T21 to T23 which charges the Qb node with the high potential power supply voltage GVDD (i.e., the gate-on voltage) when the Q node is discharged to the gate-off voltage, and transistors T25 and T26 which discharges the Qb node to the low potential power supply voltage GVSS according to a voltage of an M node and the second BDI clock BCLK2 belonging to the first BDI clock group.

A gate electrode of the transistor T21 is connected to an NX node, the high potential power supply voltage GVDD is input to a first electrode of the transistor T21, and a second electrode of the transistor T21 is connected to the Qb node. The high potential power supply voltage GVDD is input to a gate electrode and a first electrode of the transistor T22, and a second electrode of the transistor T22 is connected to the NX node. A gate electrode of the transistor T23 is connected to the Q node, a first electrode of the transistor T23 is connected to the NX node, and the low potential power supply voltage GVSS is input to a second electrode of the transistor T23. A gate electrode of the transistor T24 is connected to the Q node, a first electrode of the transistor T24 is connected to the Qb node, and the low potential power supply voltage GVSS is input to a second electrode of the transistor T24. The second BDI clock BCLK2 is input to a gate electrode of the transistor T25, a first electrode of the transistor T25 is connected to the Qb node, and one electrode of the transistor T26 is connected to a second electrode of the transistor T25. A gate electrode of the transistor T26 is connected to an M node, a first electrode of the transistor T26 is connected to the second electrode of the transistor T25, and the low potential power supply voltage GVSS is input to a second electrode of the transistor T26.

The output unit PAT3 may include three output terminals NO1 to NO3 which share the Q node, thereby simplifying the circuit. The output unit PAT3 includes a pull-up transistor T31 outputting the carry clock signal CRCLK(n) as the carry signal CR(n) for image writing while the Q node is being bootstrapped to a voltage higher than the gate-on voltage, a pull-up transistor T32 outputting the IDW scan clock SCCLK(n) as a scan signal SCOUT(n) for image writing or outputting the BDI scan clock SCCLK(n) as a scan signal SCOUT(n) for black writing, and a pull-up transistor T33 outputting the sense clock signal SECLK(n) as a sense signal SEN(n) for image writing. A gate electrode of the pull-up transistor T31 is connected to the Q node, the carry clock signal CRCLK(n) is input to a first electrode of the pull-up transistor T31, and a second electrode of the pull-up transistor T31 is connected to a first output terminal NO1. A gate electrode of the pull-up transistor T32 is connected to the Q node, the scan clock signal SCCLK(n) is input to a first electrode of the pull-up transistor T32, and a second electrode of the pull-up transistor T32 is connected to a second output terminal NO2. A first booster capacitor CO1 may further be connected between the gate electrode of the pull-up transistor T32 and the second output terminal NO2. A gate electrode of the pull-up transistor T33 is connected to the Q node, the sense clock signal SECLK(n) is input to the first electrode of the pull-up transistor T33, and a second electrode of the pull-up transistor T33 is connected to a third output terminal NO3. A second booster capacitor CO2 may further be connected between the gate electrode of the pull-up transistor T33 and the third output terminal NO3.

The stabilization unit PAT4 includes pull-down transistors T41 to T43 suppressing ripples of the output terminals NO1 to NO3, while the Qb node is being charged with the gate-on voltage and a transistor T44 suppressing a ripple of the Q node. The gate electrodes of the pull-down transistors T41 to T43 are connected to the Qb node, and the low potential power supply voltage GVSS is input to the second electrodes of the pull-down transistors T41 to T43. The first electrode of the pull-down transistor T41 is connected to the first output terminal NO1, the first electrode of the pull-down transistor T42 is connected to the second output terminal NO2, and the first electrode of the pull-down transistor R43 is connected to the third output terminal NO3. The gate electrode of the transistor T44 is connected to the Qb node, the first electrode of the transistor T44 is connected to the Q node, and the low potential power supply voltage GVSS is input to the second electrode of the transistor T44.

The first BDI memory PAT5 charges the M node with the gate-on voltage according to the first BDI clock BCLK1 belonging to the first BDI clock group BCLK1~2, applies a charge voltage of the M node to the Q node according to the second BDI clock BCLK2 belonging to the first BDI clock group BCLK1~2, and discharges the Q node to the gate-off voltage according to the BDI reset signal BRST.

To this end, the first BDI memory PAT5 includes a transistor T51A turning on/off a current flow between a Q node (e.g., Q(n−8) node) of any one of the block stages B and the M node according to the first BDI clock BCLK1, a transistor T53A turning on/off a current flow between the input terminal of the high potential power supply voltage GVDD and the Q node according to the second BDI clock BCLK2, a transistor T52A turning on/off a current flow between the input terminal of the high potential power supply voltage GVDD and the transistor T53A according to a voltage of the M node, a transistor T55A turning on/off a current flow between the Q node and the input terminal of the low potential power supply voltage GVSS according to the BDI reset signal BRST, and a transistor T54A turning on/off a current flow between the Q node and the transistor T55A according to the voltage of the M node.

The first BDI clock BCLK1 is input to a gate electrode of the transistor T51A and a first electrode and a second electrode of the transistor T51A are connected to a Q node (e.g., Q(n−8) node) of any one of the block stages B and the M node. A gate electrode of the transistor T52A is connected to the M node, and a first electrode and a second electrode of the transistor T52A are connected to the input terminal of the high potential power supply voltage GVDD and one electrode of the transistor T53A. The second BDI clock BCLK2 is input to a gate electrode of the transistor T53A, and a first electrode and a second electrode of the transistor T53A are connected to the second electrode of the transistor T52A and the Q node. A gate electrode of the transistor T54A is connected to the M node, and a first electrode and a second electrode of the transistor T54A are connected to the Q node and one electrode of the transistor T55A. The BDI reset signal BRST is input to a gate electrode of the transistor T55A and a first electrode and a second electrode of the transistor T55A are connected to the second electrode of the transistor T54A and the input terminal of the low potential power supply voltage GVSS.

The first data memory PAT6 stores the IDW carry signal CR(n−4) input from any one of the C block stages at the M node, and discharges the M node to the gate-off voltage according to the IDW carry signal CR(n−4) input from any one of the B block stages.

The first data memory PAT6 includes a transistor T61A diode-connected to an input terminal of the IDW carry signal CR(n−4) input from any one of the C block stages, a transistor T62A turning on/off a current flow between the M node and the input terminal of the low-potential power supply voltage GVSS according to the IDW carry signal CR(n+4) input from any one of the B block stages, and a capacitor CA connected between the M node and the input terminal of the low potential power supply voltage GVSS.

A gate electrode of the transistor T61A is connected to an input terminal of the IDW carry signal CR(n−4) and a first electrode and a second electrode of the transistor T61A are connected to the input terminal of the IDW carry signal CR(n−4) and the M node. A gate electrode of the transistor T62A is connected to an input terminal of the IDW carry signal CR(n+4), and a first electrode and a second electrode of the transistor T62A are connected to the M node and the input terminal of the low potential power supply voltage GVSS. The capacitor CA maintains the BDI carry signal and the data carry signal charged in the M node for a predetermined time.

Referring to FIG. 18, the nth stage of the B block to which the technical idea of the present disclosure is applied includes a second shift register unit, a second BDI memory PAT5, and a second data memory PAT6.

The second shift register unit outputs the IDW scan clock SCCLK(n), which belongs to the scan clock group SCCLK1~8, as a scan signal SCOUT(n) for image writing, outputs the BDI scan clock SCCLK(n), which belongs to the scan clock group SCCLK1~8, as a scan signal SCOUT(n) for black writing, outputs the carry clock CRCLK(n) as a carry signal for image writing, and outputs the sense clock SECLK(n) as a sense signal for image writing, during a period in which the Q node of the nth stage is activated by the gate-on voltage.

The second shift register unit may include an input and reset unit PAT1, an inverter unit PAT2, an output unit PAT3, and a stabilization unit PAT4.

The input and reset unit PAT1 charges the Q node with the gate-on voltage (i.e., the high potential power supply voltage GVDD) according to the previous stage carry signal CR(n−4) and discharges the Q node to the gate-off voltage (i.e., the low potential power supply voltage GVSS) according to the subsequent stage carry signal CR(n+4). A configuration of the input and reset unit PAT1 is substantially the same as that described above with reference to FIG. 17.

The inverter unit PAT2 charges/discharges a voltage of a Qb node, reversely to that of the Q node, according to a voltage of the Q node. The inverter unit PAT2 includes a transistor T24 which discharges the Qb node to the low potential power supply voltage GVSS (i.e., gate-off voltage) when the Q node is charged with the gate-on voltage, transistors T21 to T23 which charges the Qb node with the high potential power supply voltage GVDD (i.e., the gate-on voltage) when the Q node is discharged to the gate-off voltage, and transistors T25 and T26 which discharge the Qb node to the low potential power supply voltage GVSS according to a voltage of the M node and the fourth BDI clock BCLK4 belonging to the second BDI clock group.

A gate electrode of the transistor T21 is connected to an NX node, the high potential power supply voltage GVDD is input to a first electrode of the transistor T21, and a second electrode of the transistor T21 is connected to the Qb node. The high potential power supply voltage GVDD is input to a gate electrode and a first electrode of the transistor T22, and a second electrode of the transistor T22 is connected to the NX node. A gate electrode of the transistor T23 is connected to the Q node, a first electrode of the transistor T23 is connected to the NX node, and the low potential power supply voltage GVSS is input to a second electrode of the transistor T23. A gate electrode of the transistor T24 is connected to the Q node, a first electrode of the transistor T24 is connected to the Qb node, and the low potential power supply voltage GVSS is input to a second electrode of the transistor T24. The fourth BDI clock BCLK4 is input to a gate electrode of the transistor T25, a first electrode of the transistor T25 is connected to the Qb node, and one electrode of the transistor T26 is connected to a second electrode of the transistor T25. A gate electrode of the transistor T26 is connected to an M node, a first electrode of the transistor T26 is connected to the second electrode of the transistor T25, and the low potential power supply voltage GVSS is input to a second electrode of the transistor T26.

The output unit PAT3 may include three output terminals NO1 to NO3 which share the Q node, thereby simplifying the circuit. The output unit PAT3 includes a pull-up transistor T31 outputting the carry clock signal CRCLK(n) as the carry signal CR(n) for image writing while the Q node is being bootstrapped to a voltage higher than the gate-on voltage, a pull-up transistor T32 outputting the IDW scan clock SCCLK(n) as a scan signal SCOUT(n) for image writing or outputting the BDI scan clock SCCLK(n) as a scan signal SCOUT(n) for black writing, and a pull-up transistor T33 outputting the sense clock signal SECLK(n) as a sense signal SEN(n) for image writing. A configuration of the output unit PAT3 is substantially the same as that described above with reference to FIG. 17.

The stabilization unit PAT4 includes pull-down transistors T41 to T43 suppressing ripples of the output terminals NO1 to NO3, while the Qb node is being charged with the gate-on voltage and a transistor T44 suppressing a ripple of the Q node. A configuration of the stabilization unit PAT4 is substantially the same as that described above with reference to FIG. 17.

The second BDI memory PAT5 charges the M node with the gate-on voltage according to the third BDI clock BCLK3 belonging to the second BDI clock group BCLK3~4, applies a charge voltage of the M node to the Q node according to the fourth BDI clock BCLK4 belonging to the second BDI clock group BCLK3~4, and discharges the Q node to the gate-off voltage according to the BDI reset signal BRST.

To this end, the second BDI memory PAT5 includes a transistor T51B turning on/off a current flow between a Q node (e.g., Q(n−8) node) of any one of the block stages A and the M node according to the third BDI clock BCLK3, a transistor T53B turning on/off a current flow between the input terminal of the high potential power supply voltage GVDD and the Q node according to the fourth BDI clock BCLK4, a transistor T52B turning on/off a current flow between the input terminal of the high potential power supply voltage GVDD and the transistor T53B according to a voltage of the M node, a transistor T55B turning on/off a current flow between the Q node and the input terminal of the low potential power supply voltage GVSS according to the BDI reset signal BRST, and a transistor T54B turning on/off a current flow between the Q node and the transistor T55B according to the voltage of the M node.

The third BDI clock BCLK3 is input to a gate electrode of the transistor T51B and a first electrode and a second electrode of the transistor T51B are connected to a Q node (e.g., Q(n−8) node) of any one of the block stages A and the M node. A gate electrode of the transistor T52B is connected to the M node, and a first electrode and a second electrode of the transistor T52B are connected to the input terminal of the high potential power supply voltage GVDD and one electrode of the transistor T53B. The fourth BDI clock BCLK4 is input to a gate electrode of the transistor T53B, and a first electrode and a second electrode of the transistor T53B are connected to the second electrode of the transistor T52B and the Q node. A gate electrode of the transistor T54B is connected to the M node, and a first electrode and a second electrode of the transistor T54B are connected to the Q node and one electrode of the transistor T55B. The BDI reset signal BRST is input to a gate electrode of the transistor T55B and a first electrode and a second electrode of the transistor T55B are connected to the second electrode of the transistor T54B and the input terminal of the low potential power supply voltage GVSS.

The second data memory PAT6 stores the IDW carry signal CR(n−4) input from any one of the A block stages at the M node, and discharges the M node to the gate-off voltage according to the IDW carry signal CR(n−4) input from any one of the C block stages.

The second data memory PAT6 includes a transistor T61B diode-connected to the input terminal of the IDW carry signal CR(n−4) input from any one of the A block stages, a transistor T62B turning on/off a current flow between the M node and the input terminal of the low potential power supply voltage GVSS according to the IDW carry signal CR(n+4) input from any one of the C block stages, and a capacitor CB connected between the M node and the input terminal of the low potential power supply voltage GVSS.

A gate electrode of the transistor T61B is connected to the input terminal of the IDW carry signal CR(n−4), and a first electrode and a second electrode of the transistor T61B are connected to the input terminal of the IDW carry signal CR(n−4). A gate electrode of the transistor T62B is connected to the input terminal of the IDW carry signal CR(n+4), and a first electrode and a second electrode of the transistor T62B are connected to the M node and the input terminal of the low potential power supply voltage GVSS. The capacitor CB maintains the BDI carry signal and the data carry signal charged in the M node for a predetermined time.

Meanwhile, referring to FIG. 19, the nth stage of the C block to which the technical idea of the present disclosure is applied includes a third shift register unit, a third BDI memory PAT5, and a third data memory PAT6.

The third shift register unit outputs the IDW scan clock SCCLK(n), which belongs to the scan clock group SCCLK1~8, as a scan signal SCOUT(n) for image writing, outputs the BDI scan clock SCCLK(n), which belongs to the scan clock group SCCLK1~8, as a scan signal SCOUT(n) for black writing, outputs the carry clock CRCLK(n) as a carry signal for image writing, and outputs the sense clock SECLK(n) as a sense signal for image writing, during a period in which the Q node of the nth stage is activated by the gate-on voltage.

The third shift register unit may include an input and reset unit PAT1, an inverter unit PAT2, an output unit PAT3, and a stabilization unit PAT4.

The input and reset unit PAT1 charges the Q node with the gate-on voltage (i.e., the high potential power supply voltage GVDD) according to the previous stage carry signal CR(n−4) and discharges the Q node to the gate-off voltage (i.e., the low potential power supply voltage GVSS) according to the subsequent stage carry signal CR(n+4). A configuration of the input and reset unit PAT1 is substantially the same as that described above with reference to FIG. 17.

The inverter unit PAT2 charges/discharges a voltage of a Qb node, reversely to that of the Q node, according to a voltage of the Q node. The inverter unit PAT2 includes a transistor T24 which discharges the Qb node to the low potential power supply voltage GVSS (i.e., gate-off voltage) when the Q node is charged with the gate-on voltage, transistors T21 to T23 which charges the Qb node with the high potential power supply voltage GVDD (i.e., the gate-on voltage) when the Q node is discharged to the gate-off voltage, and transistors T25 and T26 which discharge the Qb node to the low potential power supply voltage GVSS according to a voltage of the M node and the sixth BDI clock BCLK6 belonging to the second BDI clock group.

A gate electrode of the transistor T21 is connected to an NX node, the high potential power supply voltage GVDD is input to a first electrode of the transistor T21, and a second electrode of the transistor T21 is connected to the Qb node. The high potential power supply voltage GVDD is input to a gate electrode and a first electrode of the transistor T22, and a second electrode of the transistor T22 is connected to the NX node. A gate electrode of the transistor T23 is connected to the Q node, a first electrode of the transistor T23 is connected to the NX node, and the low potential power supply voltage GVSS is input to a second electrode of the transistor T23. A gate electrode of the transistor T24 is connected to the Q node, a first electrode of the transistor T24 is connected to the Qb node, and the low potential power supply voltage GVSS is input to a second electrode of the transistor T24. The sixth BDI clock BCLK6 is input to a gate electrode of the transistor T25, a first electrode of the transistor T25 is connected to the Qb node, and one electrode of the transistor T26 is connected to a second electrode of the transistor T25. A gate electrode of the transistor T26 is connected to an M node, a first electrode of the transistor T26 is connected to the second electrode of the transistor T25, and the low potential power supply voltage GVSS is input to a second electrode of the transistor T26.

The output unit PAT3 may include three output terminals NO1 to NO3 which share the Q node, thereby simplifying the circuit. The output unit PAT3 includes a pull-up transistor T31 outputting the carry clock signal CRCLK(n) as the carry signal CR(n) for image writing while the Q node is being bootstrapped to a voltage higher than the gate-on voltage, a pull-up transistor T32 outputting the IDW scan clock SCCLK(n) as a scan signal SCOUT(n) for image writing or outputting the BDI scan clock SCCLK(n) as a scan signal SCOUT(n) for black writing, and a pull-up transistor T33 outputting the sense clock signal SECLK(n) as a sense signal SEN(n) for image writing. A configuration of the output unit PAT3 is substantially the same as that described above with reference to FIG. 17.

The stabilization unit PAT4 includes pull-down transistors T41 to T43 suppressing ripples of the output terminals NO1 to NO3, while the Qb node is being charged with the gate-on voltage and a transistor T44 suppressing a ripple of the Q node. A configuration of the stabilization unit PAT4 is substantially the same as that described above with reference to FIG. 17.

The third BDI memory PAT5 charges the M node with the gate-on voltage according to the fifth BDI clock BCLK5 belonging to the third BDI clock group BCLK5~6, applies a charge voltage of the M node to the Q node according to the sixth BDI clock BCLK6 belonging to the third BDI clock group BCLK5~6, and discharges the Q node to the gate-off voltage according to the BDI reset signal BRST.

To this end, the third BDI memory PAT5 includes a transistor T51C turning on/off a current flow between a Q node (e.g., Q(n−8) node) of any one of the block stages B and the M node according to the fifth BDI clock BCLK5, a transistor T53C turning on/off a current flow between the input terminal of the high potential power supply voltage GVDD and the Q node according to the sixth BDI clock BCLK6, a transistor T52C turning on/off a current flow between the input terminal of the high potential power supply voltage GVDD and the transistor T53C according to a voltage of the M node, a transistor T55C turning on/off a current flow between the Q node and the input terminal of the low potential power supply voltage GVSS according to the BDI reset signal BRST, and a transistor T54C turning on/off a current flow between the Q node and the transistor T55C according to the voltage of the M node.

The fifth BDI clock BCLK5 is input to a gate electrode of the transistor T51C and a first electrode and a second electrode of the transistor T51C are connected to a Q node (e.g., Q(n−8) node) of any one of the block stages B and the M node. A gate electrode of the transistor T52C is connected to the M node, and a first electrode and a second electrode of the transistor T52C are connected to the input terminal of the high potential power supply voltage GVDD and one electrode of the transistor T53C. The sixth BDI clock BCLK6 is input to a gate electrode of the transistor T53C, and a first electrode and a second electrode of the transistor T53C are connected to the second electrode of the transistor T52C and the Q node. A gate electrode of the transistor T54C is connected to the M node, and a first electrode and a second electrode of the transistor T54C are connected to the Q node and one electrode of the transistor T55C. The BDI reset signal BRST is input to a gate electrode of the transistor T55C and a first electrode and a second electrode of the transistor T55C are connected to the second electrode of the transistor T54C and the input terminal of the low potential power supply voltage GVSS.

The third data memory PAT6 stores the IDW carry signal CR(n−4) input from any one of the B block stages at the M node, and discharges the M node to the gate-off voltage according to the IDW carry signal CR(n−4) input from any one of the A block stages.

The third data memory PAT6 includes a transistor T61C diode-connected to the input terminal of the IDW carry signal CR(n−4) input from any one of the B block stages, a transistor T62C turning on/off a current flow between the M node and the input terminal of the low potential power supply voltage GVSS according to the IDW carry signal CR(n+4) input from any one of the A block stages, and a capacitor CC connected between the M node and the input terminal of the low potential power supply voltage GVSS.

A gate electrode of the transistor T61C is connected to the input terminal of the IDW carry signal CR(n−4), and a first electrode and a second electrode of the transistor T61C are connected to the input terminal of the IDW carry signal CR(n−4). A gate electrode of the transistor T62C is connected to the input terminal of the IDW carry signal CR(n+4), and a first electrode and a second electrode of the transistor T62C are connected to the M node and the input terminal of the low potential power supply voltage GVSS. The capacitor CC maintains the BDI carry signal and the data carry signal charged in the M node for a predetermined time.

FIG. 20 is a detailed waveform view illustrating operations of the A blocks, B blocks, and C blocks illustrated in FIG. 16. In FIG. 20, the scan clocks SCCLK1~8, the BDI clocks BCLK1~6, the BDI start signal BVST, and the BDI reset signal BRST swing between a relatively high gate-on voltage and a relatively low gate-off voltage. Also, voltages of the M node swing between the gate-on voltage and the gate-off voltage. Also, the voltages of the Q node swing between the gate-on voltage and the gate-off voltage, and in particular, increase to a boosting voltage in synchronization with the scan clocks SCCLK1~8. The boosting voltage is higher than the gate-on voltage.

Referring to FIGS. 16 to 20, when BDI driving is performed in the A block (#1~8), IDW driving is performed in the C block (#1073~1080). Subsequently, when BDI driving is performed in the B block (#9~16), IDW driving is performed in the A block (#1081~1088). Subsequently, when BDI driving is performed in the C block (#17~24), IDW driving is performed in the B block (#1089~1096).

To this end, during an interval ①, the M node of the A block (#1~8) is charged with the BDI start signal BVST of the gate-on voltage (or the previous stage Q(n−8) node voltage) according to the first BDI clock BCLK1. The BDI start signal BVST (or the previous stage Q(n−8) node voltage) becomes a BDI carry signal. The M node of A block (#1~8) store the BDI carry signal from the interval ① to an interval ⑤ to maintain the charged state.

Subsequently, between the interval ① and ②, IDW driving is performed in the C block (#1073~1080). The C block (#1073~1080) outputs some SCCLK1~4 of the IDW scan clocks of the scan clock group SCCLK1~8, as scan signals for image writing.

Subsequently, during the interval ②, the Q node of the C blocks (#1073 to 1080) is discharged to the gate-off voltage according to the BDI reset signal BRST. The Q node of the C block (#1073~1080) maintains the gate-off voltage from the interval ② to the interval ⑤ according to the BDI reset signal BRST. Here, the IDW carry signal is stored at the third data memory of the C block (#1073~1080).

Subsequently, during the interval ③, according to the second BDI clock BCLK2, the Q node of the A block (#1~8) is connected to the M node and charged with the gate-on voltage.

Subsequently, during the interval ④, the Q node of the A block (#1~8) is bootstrapped in synchronization with the BDI scan clocks of the first scan clock group (SCCLK1~8), and as a result, the A block (#1~8) is BDI-driven. That is, the A block (#1~8) outputs the BDI scan clocks of the first scan clock group (SCCLK1~8) as scan signals for black writing. Here, the M node of the B block (#9~16) is charged with the Q node voltage of the A block (#1~8) of the gate-on voltage according to the third BDI clock BCLK3.

Subsequently, during the interval ⑤, the Q node of the A block (#1~8) is discharged to the gate-off voltage according to the BDI reset signal BRST.

Subsequently, during the interval ⑥, the M node of the A block (#1~8) is discharged to the BDI start signal BVST of the gate-off voltage (or previous stage Q(n−8) node voltage) according to the first BDI clock BCLK1. Also, during the interval ⑥, the Q node of the C block (#1073~1080) is connected to the M node according to the sixth BDI clock BCLK6 and charged with the gate-on voltage.

Meanwhile, in the C block (#1073~1081), IDW driving is temporarily stopped during the ②, ③, ④, ⑤, and ⑥ intervals. This is to prevent a collision between a data voltage for IDW (or IDW data voltage) and a data voltage for BDI (or BDI data voltage). In the C block (#1073~1080), IDW driving is resumed after the ⑥ interval. The C block (#1073~1080) outputs the remaining (SCCLK5~8) among the IDW scan clocks of the scan clock group (SCCLK1~8) as scan signals for image writing.

In this manner, the BDI scan clocks are input to A block while IDW scan clocks are being input to C block, the BDI scan clocks are input to B block while IDW scan clocks are being input to A block, and the BDI scan clocks are input to the C block while the IDW scan clocks are being input to the B block.

Unlike the first aspect, in the second aspect, the A, B and C blocks share the scan clock lines, and thus, it is necessary to reset the block which has been IDW-driven in addition to a charge time of the Q node for BDI driving.

Accordingly, while the BDI scan clocks are being input to the A block, the Q nodes of the stages belonging to the C block are discharged to the gate-off voltage and the IDW carry signal is stored at the C block. While the BDI scan clocks are being input to the B block, the Q nodes of the stages belonging to the A block are discharged to the gate-off voltage and the IDW carry signal is stored at the A block. While the BDI scan clocks are being input to the C block, the Q nodes of the stages belonging to the B block are discharged to the gate-off voltage and the IDW carry signal is stored at the B block.

Also, for sequential BDI driving, the BDI carry signal is stored at the B block in synchronization with the timing at which the BDI scan clocks are input to the A block, the BDI carry signal is stored at the C block in synchronization with the timing at which the BDI scan clocks are input to the B block, and the BDI carry signal is stored at the A block in synchronization with the timing at which the BDI scan clocks are input to the C block.

[Third Aspect]

FIG. 21 is a view illustrating a clock connection configuration of a gate driver according to a third aspect of the present disclosure.

Referring to FIG. 21, the gate driver according to the third aspect of the present disclosure performs a BDI reset function according to any one of the BDI clock signals, without using a BDI reset signal, as compared with that of FIG. 16. According to the third aspect of the present disclosure, since the BDI reset signal is not required, one BDI control line may be reduced.

Referring to FIG. 21, the gate driver according to the third aspect of the present disclosure may be implemented by a gate shift register, clock lines, etc. In which A block, B block and C block are alternately arranged. The A block, the B block, and the C block may each include a plurality of stages. The scan clocks SCCLK are implemented in N phases (e.g., 8 phases), the carry clocks CRCLK are implemented in N phases (e.g., 8 phases), and the sense clocks SECLK are N phases 8 phases), the A block, the B block, and the C block may each be composed of N (e.g., eight) stages.

The scan clocks SCCLK include N-phase scan clock group SCCLK1~8 including both IDW scan clocks synchronized with an image write timing and BDI scan clocks synchronized with a black write timing. The N-phase scan clock group SCCLK1~8 are input to A blocks, B blocks, and C blocks through N scan clock lines 21A.

The N-phase carry clocks CRCLK1~8 are input to the A blocks, B blocks, and C blocks through N carry clock lines 21B. Also, the N-phase sense clocks SECLK1~8 on the N-phase are input to the A blocks, B blocks, and C blocks through N sense clock lines 21C.

According to the third aspect of the present disclosure, since the sense clocks and the carry clocks are implemented as N-phase clocks, the number of the carry clock lines 21B and the number of the sense clock lines 21C are equal to the number of the scan clock lines 21A. However, in order to implement IDW driving and BDI driving described above, each of the stages that belong to the A block, the B block, and C block may further include a BDI memory in addition to the shift register unit to store a BDI carry signal for outputting BDI scan clocks and may further receive N−1 BDI control signals (e.g., 7 BDI control signals) to control an operation of the BDI memory. Each of the stages belonging to the A block, the B block, and the C block may further include a data memory in addition to the shift register unit to store an IDW carry signal for outputting IDW scan clocks.

The 7 additional BDI control signals may include 6 BDI clocks BCLK1~6 and one BDI start signal BVST. Six BDI clock lines 21D may further be provided for inputting 6 BDI clocks BCLK1~6, and one BDI start line 21F may further be provided for inputting one BDI start signal BVST.

Among the 6 BDI clocks BCLK1~6, the first BDI clock group BCLK1~2, 6 is input to the A blocks through the BDI clock lines 21D, the second BDI clock group BCLK3~4, 2 is input to the B blocks through the BDI clock lines 21D, and the third BDI clock group BCLK5~6, 4 is input to the C blocks through the BDI clock lines 21D. The sixth BDI clock BCLK6 input to the A blocks serves as a reset signal for discharging the Q node of the A blocks, the second BDI clock BCLK2 input to the B blocks serves as a reset signal for discharging the Q node of the B blocks, and the fourth BDI clock BCLK4 input to the C blocks serves as a reset signal for discharging the Q node of the C blocks.

The BDI start signal BVST is input to the A blocks, the B blocks, and the C blocks through the BDI start line 21F.

The IDW start signal VST is input to the uppermost stage, among the stages constituting the A blocks, and the IDW carry signal CR is input to the other remaining stages of the A blocks, the B blocks, and the C blocks excluding the uppermost stage. The high potential power supply voltage GVDD and the low potential power supply voltage GVSS are input to all the stages of the A blocks, the B blocks, and the C blocks. The IDW carry signal CR includes a previous stage IDW carry signal and a subsequent stage IDW carry signal. The previous stage IDW carry signal may be output from any one of the previous stages and may be synchronized with any of the N-phase carry clocks CRCLK1 to CRCLK8. The subsequent stage IDW carry signal may be output from any of the subsequent stages and may be synchronized with any one of the N-phase carry clocks CRCLK1 to CRCLK8.

The BDI start signal BVST is a BDI carry signal for determining a start timing of BDI driving. A Q node voltage of any one of the previous stages is input as a BDI carry signal to the other remaining blocks excluding a specific A, B, or C block, to which the BDI start signal BVST is input.

While IDW driving is performed in any one of the C blocks, BDI driving is performed in one of the A blocks, and while IDW driving is performed in any one of the A blocks, the BDI driving is performed in any one of the B blocks, and while IDW driving is performed in any one of the B blocks, BDI driving is performed in any one of the C blocks.

To this end, the BDI scan clocks are input to the A block while the IDW scan clocks are being input to the C block, the BDI scan clocks are input to the B block while the IDW scan clocks are being input into the A block, and the BDI scan clocks are input to the C block while the IDW scan clocks are being input to the B block.

Also, before the BDI scan clocks are input to the A block, the Q nodes of the stages belonging to the C block maintain the gate-on voltage, before the BDI scan clocks are input to the B block, the Q-nodes of the stages belonging to the A block maintain the gate-on voltage, and before the BDI scan clocks are input to the C block, the Q-nodes of the stages belonging to the B block maintain the gate-on voltage.

While the BDI scan clocks are input to the A block, the Q nodes of the stages belonging to the C block are discharged to the gate-off voltage, while the BDI scan clocks are input to the B block, the Q nodes of the stages belonging to the A block are discharged to the gate-off voltage, and while the BDI scan clocks are input to the C block, the Q nodes of the stages belonging to the B block are discharged to the gate-off voltage. Here, while the Q nodes are discharged to the gate-off voltage, the stages belonging to the A, B, and C blocks store the previous stage IDW carry signal (e.g., CR(n−4)) in the data memory.

Also, with reference to the previous stage IDW carry signal stored at the data memory, after the BDI scan clocks are input to the A block, the Q nodes of the stages belonging to the C block are recharged with the gate-on voltage, after the BDI scan clocks are input to the B block, the Q nodes of the stages belonging to the A block are recharged with the gate-on voltage, and after the BDI scan clocks are input to the C block, the Q nodes of the stages belonging to the B block are recharged with the gate-on voltage.

Meanwhile, when BDI driving is performed in any one of the A blocks, the BDI carry signal is simultaneously stored upon receiving the Q node voltage (gate-on voltage) of the stages belonging to the A block from any one of the B blocks. Also, when BDI driving is performed in one of the B blocks, the BDI carry signal is simultaneously stored upon receiving the Q node voltage (gate-on voltage) of the stages belonging to the B block from any one of the C blocks. Also, when BDI driving is performed in one of the C blocks, the BDI carry signal is simultaneously stored upon receiving the Q node voltage (gate-on voltage) of the stages belonging to the C block from any one of the A blocks.

FIG. 22 is a view illustrating a configuration of an nth stage of the A block illustrated in FIG. 21. FIG. 23 is a view illustrating a configuration of an nth stage of the B block illustrated in FIG. 21. FIG. 24 is a view illustrating a configuration of an nth stage of the C block illustrated in FIG. 21.

Referring to FIG. 22, the nth stage of the A block to which the technical idea of the present disclosure is applied may include a first shift register unit, a first BDI memory PAT5, and a first data memory PAT6.

The first shift register unit outputs an IDW scan clock SCCLK(n) belonging to the scan clock group SCCLK1~8 as a scan signal SCOUT(n) for image writing, outputs the BDI scan clock SCCLK(n) belonging to the scan clock group SCCLK1~8 as a scan signal SCOUT(n) for black writing, outputs the carry clock CRCLK(n) as a carry signal for image writing, and outputs the sense clock SECLK(n) as a sense signal for image writing during a period in which the Q node of the nth stage is activated by the gate-on voltage.

The first shift register unit may include an input and reset unit PAT1, an inverter unit PAT2, an output unit PAT3, and a stabilization unit PAT4.

The input and reset unit PAT1 charges the Q node with the gate-on voltage (i.e., the high potential power supply voltage GVDD) according to the previous stage carry signal CR(n−4) and discharges the Q node to the gate-off voltage (i.e., the low potential power supply voltage GVSS) according to the subsequent stage carry signal CR(n+4). The input and reset unit PAT1 includes a transistor T11 for charging the Q node with the previous stage carry signal of the gate-on voltage and a transistor T12 discharging the Q node to the low-potential power supply voltage GVSS according to the subsequent stage carry signal CR(n+4). The previous stage carry signal CR(n−4) is input to a gate electrode and a first electrode of the transistor T11, and a second electrode of the transistor T11 is connected to the Q node. The subsequent stage carry signal CR(n+4) is input to a gate electrode of the transistor T12, and a first electrode of the transistor T12 is connected to the Q node and the low-potential power supply voltage GVSS is input to a second electrode of the transistor T12.

The inverter unit PAT2 charges/discharges a voltage of a Qb node, reversely to that of the Q node, according to a voltage of the Q node. The inverter unit PAT2 includes a transistor T24 which discharges the Qb node to the low potential power supply voltage GVSS (i.e., gate-off voltage) when the Q node is charged with the gate-on voltage, transistors T21 to T23 which charges the Qb node with the high potential power supply voltage GVDD (i.e., the gate-on voltage) when the Q node is discharged to the gate-off voltage, and transistors T25 and T26 which discharges the Qb node to the low potential power supply voltage GVSS according to a voltage of an M node and the second BDI clock BCLK2 belonging to the first BDI clock group.

A gate electrode of the transistor T21 is connected to an NX node, the high potential power supply voltage GVDD is input to a first electrode of the transistor T21, and a second electrode of the transistor T21 is connected to the Qb node. The high potential power supply voltage GVDD is input to a gate electrode and a first electrode of the transistor T22, and a second electrode of the transistor T22 is connected to the NX node. A gate electrode of the transistor T23 is connected to the Q node, a first electrode of the transistor T23 is connected to the NX node, and the low potential power supply voltage GVSS is input to a second electrode of the transistor T23. A gate electrode of the transistor T24 is connected to the Q node, a first electrode of the transistor T24 is connected to the Qb node, and the low potential power supply voltage GVSS is input to a second electrode of the transistor T24. The second BDI clock BCLK2 is input to a gate electrode of the transistor T25, a first electrode of the transistor T25 is connected to the Qb node, and one electrode of the transistor T26 is connected to a second electrode of the transistor T25. A gate electrode of the transistor T26 is connected to an M node, a first electrode of the transistor T26 is connected to the second electrode of the transistor T25, and the low potential power supply voltage GVSS is input to a second electrode of the transistor T26.

The output unit PAT3 may include three output terminals NO1 to NO3 which share the Q node, thereby simplifying the circuit. The output unit PAT3 includes a pull-up transistor T31 outputting the carry clock signal CRCLK(n) as the carry signal CR(n) for image writing while the Q node is being bootstrapped to a voltage higher than the gate-on voltage, a pull-up transistor T32 outputting the IDW scan clock SCCLK(n) as a scan signal SCOUT(n) for image writing or outputting the BDI scan clock SCCLK(n) as a scan signal SCOUT(n) for black writing, and a pull-up transistor T33 outputting the sense clock signal SECLK(n) as a sense signal SEN(n) for image writing. A gate electrode of the pull-up transistor T31 is connected to the Q node, the carry clock signal CRCLK(n) is input to a first electrode of the pull-up transistor T31, and a second electrode of the pull-up transistor T31 is connected to a first output terminal NO1. A gate electrode of the pull-up transistor T32 is connected to the Q node, the scan clock signal SCCLK(n) is input to a first electrode of the pull-up transistor T32, and a second electrode of the pull-up transistor T32 is connected to a second output terminal NO2. A first booster capacitor CO1 may further be connected between the gate electrode of the pull-up transistor T32 and the second output terminal NO2. A gate electrode of the pull-up transistor T33 is connected to the Q node, the sense clock signal SECLK(n) is input to the first electrode of the pull-up transistor T33, and a second electrode of the pull-up transistor T33 is connected to a third output terminal NO3. A second booster capacitor CO2 may further be connected between the gate electrode of the pull-up transistor T33 and the third output terminal NO3.

The stabilization unit PAT4 includes pull-down transistors T41 to T43 suppressing ripples of the output terminals NO1 to NO3, while the Qb node is being charged with the gate-on voltage and a transistor T44 suppressing a ripple of the Q node. The gate electrodes of the pull-down transistors T41 to T43 are connected to the Qb node, and the low potential power supply voltage GVSS is input to the second electrodes of the pull-down transistors T41 to T43. The first electrode of the pull-down transistor T41 is connected to the first output terminal NO1, the first electrode of the pull-down transistor T42 is connected to the second output terminal NO2, and the first electrode of the pull-down transistor R43 is connected to the third output terminal NO3. The gate electrode of the transistor T44 is connected to the Qb node, the first electrode of the transistor T44 is connected to the Q node, and the low potential power supply voltage GVSS is input to the second electrode of the transistor T44.

The first BDI memory PAT5 charges the M node with the gate-on voltage according to the first BDI clock BCLK1 belonging to the first BDI clock group BCLK1~2, applies the charged voltage of the M node to the Q node according to the second BDI clock BCLK2 belonging to the first BDI clock group BCLK1~2, 6 and discharges the Q node to the gate-off voltage according to the sixth BDI clock BCLK6 belonging to the first BDI clock group BCLK1~2, 6.

To this end, the first BDI memory PAT5 includes a transistor T51A turning on/off a current flow between a Q node (e.g., Q(n−8) node) of any one of the block stages B and the M node according to the first BDI clock BCLK1, a transistor T53A turning on/off a current flow between the input terminal of the high potential power supply voltage GVDD and the Q node according to the second BDI clock BCLK2, a transistor T52A turning on/off a current flow between the input terminal of the high potential power supply voltage GVDD and the transistor T53A according to a voltage of the M node, a transistor T55A turning on/off a current flow between the Q node and the input terminal of the low potential power supply voltage GVSS according to the sixth BDI clock BCLK6, and a transistor T54A turning on/off a current flow between the Q node and the transistor T55A according to the voltage of the M node.

The first BDI clock BCLK1 is input to a gate electrode of the transistor T51A and a first electrode and a second electrode of the transistor T51A are connected to a Q node (e.g., Q(n−8) node) of any one of the block stages B and the M node. A gate electrode of the transistor T52A is connected to the M node, and a first electrode and a second electrode of the transistor T52A are connected to the input terminal of the high potential power supply voltage GVDD and one electrode of the transistor T53A. The second BDI clock BCLK2 is input to a gate electrode of the transistor T53A, and a first electrode and a second electrode of the transistor T53A are connected to the second electrode of the transistor T52A and the Q node. A gate electrode of the transistor T54A is connected to the M node, and a first electrode and a second electrode of the transistor T54A are connected to the Q node and one electrode of the transistor T55A. The sixth BDI clock BCLK6 is input to a gate electrode of the transistor T55A and a first electrode and a second electrode of the transistor T55A are connected to the second electrode of the transistor T54A and the input terminal of the low potential power supply voltage GVSS.

The first data memory PAT6 stores the IDW carry signal CR(n−4) input from any one of the C block stages at the M node, and discharges the M node to the gate-off voltage according to the IDW carry signal CR(n−4) input from any one of the B block stages.

The first data memory PAT6 includes a transistor T61A diode-connected to an input terminal of the IDW carry signal CR(n−4) input from any one of the C block stages, a transistor T62A turning on/off a current flow between the M node and the input terminal of the low-potential power supply voltage GVSS according to the IDW carry signal CR(n+4) input from any one of the B block stages, and a capacitor CA connected between the M node and the input terminal of the low potential power supply voltage GVSS.

A gate electrode of the transistor T61A is connected to an input terminal of the IDW carry signal CR(n−4) and a first electrode and a second electrode of the transistor T61A are connected to the input terminal of the IDW carry signal CR(n−4) and the M node. A gate electrode of the transistor T62A is connected to an input terminal of the IDW carry signal CR(n+4), and a first electrode and a second electrode of the transistor T62A are connected to the M node and the input terminal of the low potential power supply voltage GVSS. The capacitor CA maintains the BDI carry signal and the data carry signal charged in the M node for a predetermined time.

Referring to FIG. 23, the nth stage of the B block to which the technical idea of the present disclosure is applied includes a second shift register unit, a second BDI memory PAT5, and a second data memory PAT6.

The second shift register unit outputs the IDW scan clock SCCLK(n), which belongs to the scan clock group SCCLK1~8, as a scan signal SCOUT(n) for image writing, outputs the BDI scan clock SCCLK(n), which belongs to the scan clock group SCCLK1~8, as a scan signal SCOUT(n) for black writing, outputs the carry clock CRCLK(n) as a carry signal for image writing, and outputs the sense clock SECLK(n) as a sense signal for image writing, during a period in which the Q node of the nth stage is activated by the gate-on voltage.

The second shift register unit may include an input and reset unit PAT1, an inverter unit PAT2, an output unit PAT3, and a stabilization unit PAT4.

The input and reset unit PAT1 charges the Q node with the gate-on voltage (i.e., the high potential power supply voltage GVDD) according to the previous stage carry signal CR(n−4) and discharges the Q node to the gate-off voltage (i.e., the low potential power supply voltage GVSS) according to the subsequent stage carry signal CR(n+4). A configuration of the input and reset unit PAT1 is substantially the same as that described above with reference to FIG. 22.

The inverter unit PAT2 charges/discharges a voltage of a Qb node, reversely to that of the Q node, according to a voltage of the Q node. The inverter unit PAT2 includes a transistor T24 which discharges the Qb node to the low potential power supply voltage GVSS (i.e., gate-off voltage) when the Q node is charged with the gate-on voltage, transistors T21 to T23 which charges the Qb node with the high potential power supply voltage GVDD (i.e., the gate-on voltage) when the Q node is discharged to the gate-off voltage, and transistors T25 and T26 which discharge the Qb node to the low potential power supply voltage GVSS according to a voltage of the M node and the fourth BDI clock BCLK4 belonging to the second BDI clock group.

A gate electrode of the transistor T21 is connected to an NX node, the high potential power supply voltage GVDD is input to a first electrode of the transistor T21, and a second electrode of the transistor T21 is connected to the Qb node. The high potential power supply voltage GVDD is input to a gate electrode and a first electrode of the transistor T22, and a second electrode of the transistor T22 is connected to the NX node. A gate electrode of the transistor T23 is connected to the Q node, a first electrode of the transistor T23 is connected to the NX node, and the low potential power supply voltage GVSS is input to a second electrode of the transistor T23. A gate electrode of the transistor T24 is connected to the Q node, a first electrode of the transistor T24 is connected to the Qb node, and the low potential power supply voltage GVSS is input to a second electrode of the transistor T24. The fourth BDI clock BCLK4 is input to a gate electrode of the transistor T25, a first electrode of the transistor T25 is connected to the Qb node, and one electrode of the transistor T26 is connected to a second electrode of the transistor T25. A gate electrode of the transistor T26 is connected to an M node, a first electrode of the transistor T26 is connected to the second electrode of the transistor T25, and the low potential power supply voltage GVSS is input to a second electrode of the transistor T26.

The output unit PAT3 may include three output terminals NO1 to NO3 which share the Q node, thereby simplifying the circuit. The output unit PAT3 includes a pull-up transistor T31 outputting the carry clock signal CRCLK(n) as the carry signal CR(n) for image writing while the Q node is being bootstrapped to a voltage higher than the gate-on voltage, a pull-up transistor T32 outputting the IDW scan clock SCCLK(n) as a scan signal SCOUT(n) for image writing or outputting the BDI scan clock SCCLK(n) as a scan signal SCOUT(n) for black writing, and a pull-up transistor T33 outputting the sense clock signal SECLK(n) as a sense signal SEN(n) for image writing. A configuration of the output unit PAT3 is substantially the same as that described above with reference to FIG. 22.

The stabilization unit PAT4 includes pull-down transistors T41 to T43 suppressing ripples of the output terminals NO1 to NO3, while the Qb node is being charged with the gate-on voltage and a transistor T44 suppressing a ripple of the Q node. A configuration of the stabilization unit PAT4 is substantially the same as that described above with reference to FIG. 22.

The second BDI memory PAT5 charges the M node with the gate-on voltage according to the third BDI clock BCLK3 belonging to the second BDI clock group BCLK3~4, applies a charge voltage of the M node to the Q node according to the fourth BDI clock BCLK4 belonging to the second BDI clock group BCLK3~4, and discharges the Q node to the gate-off voltage according to the second BDI clock BCLK2 belonging to the second BDI clock group BCLK3~4.

To this end, the second BDI memory PAT5 includes a transistor T51B turning on/off a current flow between a Q node (e.g., Q(n−8) node) of any one of the block stages A and the M node according to the third BDI clock BCLK3, a transistor T53B turning on/off a current flow between the input terminal of the high potential power supply voltage GVDD and the Q node according to the fourth BDI clock BCLK4, a transistor T52B turning on/off a current flow between the input terminal of the high potential power supply voltage GVDD and the transistor T53B according to a voltage of the M node, a transistor T55B turning on/off a current flow between the Q node and the input terminal of the low potential power supply voltage GVSS according to the second BDI clock BCLK2, and a transistor T54B turning on/off a current flow between the Q node and the transistor T55B according to the voltage of the M node.

The third BDI clock BCLK3 is input to a gate electrode of the transistor T51B and a first electrode and a second electrode of the transistor T51B are connected to a Q node (e.g., Q(n−8) node) of any one of the block stages A and the M node. A gate electrode of the transistor T52B is connected to the M node, and a first electrode and a second electrode of the transistor T52B are connected to the input terminal of the high potential power supply voltage GVDD and one electrode of the transistor T53B. The fourth BDI clock BCLK4 is input to a gate electrode of the transistor T53B, and a first electrode and a second electrode of the transistor T53B are connected to the second electrode of the transistor T52B and the Q node. A gate electrode of the transistor T54B is connected to the M node, and a first electrode and a second electrode of the transistor T54B are connected to the Q node and one electrode of the transistor T55B. The second BDI clock BCLK2 is input to a gate electrode of the transistor T55B and a first electrode and a second electrode of the transistor T55B are connected to the second electrode of the transistor T54B and the input terminal of the low potential power supply voltage GVSS.

The second data memory PAT6 stores the IDW carry signal CR(n−4) input from any one of the A block stages at the M node, and discharges the M node to the gate-off voltage according to the IDW carry signal CR(n−4) input from any one of the C block stages.

The second data memory PAT6 includes a transistor T61B diode-connected to the input terminal of the IDW carry signal CR(n−4) input from any one of the A block stages, a transistor T62B turning on/off a current flow between the M node and the input terminal of the low potential power supply voltage GVSS according to the IDW carry signal CR(n+4) input from any one of the C block stages, and a capacitor CB connected between the M node and the input terminal of the low potential power supply voltage GVSS.

A gate electrode of the transistor T61B is connected to the input terminal of the IDW carry signal CR(n−4), and a first electrode and a second electrode of the transistor T61B are connected to the input terminal of the IDW carry signal CR(n−4). A gate electrode of the transistor T62B is connected to the input terminal of the IDW carry signal CR(n+4), and a first electrode and a second electrode of the transistor T62B are connected to the M node and the input terminal of the low potential power supply voltage GVSS. The capacitor CB maintains the BDI carry signal and the data carry signal charged in the M node for a predetermined time.

Referring to FIG. 24, the nth stage of the C block to which the technical idea of the present disclosure is applied includes a third shift register unit, a third BDI memory PAT5, and a third data memory PAT6.

The third shift register unit outputs the IDW scan clock SCCLK(n), which belongs to the scan clock group SCCLK1~8, as a scan signal SCOUT(n) for image writing, outputs the BDI scan clock SCCLK(n), which belongs to the scan clock group SCCLK1~8, as a scan signal SCOUT(n) for black writing, outputs the carry clock CRCLK(n) as a carry signal for image writing, and outputs the sense clock SECLK(n) as a sense signal for image writing, during a period in which the Q node of the nth stage is activated by the gate-on voltage.

The third shift register unit may include an input and reset unit PAT1, an inverter unit PAT2, an output unit PAT3, and a stabilization unit PAT4.

The input and reset unit PAT1 charges the Q node with the gate-on voltage (i.e., the high potential power supply voltage GVDD) according to the previous stage carry signal CR(n−4) and discharges the Q node to the gate-off voltage (i.e., the low potential power supply voltage GVSS) according to the subsequent stage carry signal CR(n+4). A configuration of the input and reset unit PAT1 is substantially the same as that described above with reference to FIG. 17.

The inverter unit PAT2 charges/discharges a voltage of a Qb node, reversely to that of the Q node, according to a voltage of the Q node. The inverter unit PAT2 includes a transistor T24 which discharges the Qb node to the low potential power supply voltage GVSS (i.e., gate-off voltage) when the Q node is charged with the gate-on voltage, transistors T21 to T23 which charges the Qb node with the high potential power supply voltage GVDD (i.e., the gate-on voltage) when the Q node is discharged to the gate-off voltage, and transistors T25 and T26 which discharge the Qb node to the low potential power supply voltage GVSS according to a voltage of the M node and the sixth BDI clock BCLK6 belonging to the second BDI clock group.

A gate electrode of the transistor T21 is connected to an NX node, the high potential power supply voltage GVDD is input to a first electrode of the transistor T21, and a second electrode of the transistor T21 is connected to the Qb node. The high potential power supply voltage GVDD is input to a gate electrode and a first electrode of the transistor T22, and a second electrode of the transistor T22 is connected to the NX node. A gate electrode of the transistor T23 is connected to the Q node, a first electrode of the transistor T23 is connected to the NX node, and the low potential power supply voltage GVSS is input to a second electrode of the transistor T23. A gate electrode of the transistor T24 is connected to the Q node, a first electrode of the transistor T24 is connected to the Qb node, and the low potential power supply voltage GVSS is input to a second electrode of the transistor T24. The sixth BDI clock BCLK6 is input to a gate electrode of the transistor T25, a first electrode of the transistor T25 is connected to the Qb node, and one electrode of the transistor T26 is connected to a second electrode of the transistor T25. A gate electrode of the transistor T26 is connected to an M node, a first electrode of the transistor T26 is connected to the second electrode of the transistor T25, and the low potential power supply voltage GVSS is input to a second electrode of the transistor T26.

The output unit PAT3 may include three output terminals NO1 to NO3 which share the Q node, thereby simplifying the circuit. The output unit PAT3 includes a pull-up transistor T31 outputting the carry clock signal CRCLK(n) as the carry signal CR(n) for image writing while the Q node is being bootstrapped to a voltage higher than the gate-on voltage, a pull-up transistor T32 outputting the IDW scan clock SCCLK(n) as a scan signal SCOUT(n) for image writing or outputting the BDI scan clock SCCLK(n) as a scan signal SCOUT(n) for black writing, and a pull-up transistor T33 outputting the sense clock signal SECLK(n) as a sense signal SEN(n) for image writing. A configuration of the output unit PAT3 is substantially the same as that described above with reference to FIG. 22.

The stabilization unit PAT4 includes pull-down transistors T41 to T43 suppressing ripples of the output terminals NO1 to NO3, while the Qb node is being charged with the gate-on voltage and a transistor T44 suppressing a ripple of the Q node. The configuration of the stabilization unit PAT4 is substantially the same as that described above with reference to FIG. 22.

The third BDI memory PAT5 charges the M node with the gate-on voltage according to the fifth BDI clock BCLK5 belonging to the third BDI clock group BCLK5~6, applies a charge voltage of the M node to the Q node according to the sixth BDI clock BCLK6 belonging to the third BDI clock group BCLK5~6, 4, and discharges the Q node to the gate-off voltage according to the fourth BDI clock BCLK4 belonging to the third BDI clock group BCLK5~6, 4.

To this end, the third BDI memory PAT5 includes a transistor T51C turning on/off a current flow between a Q node (e.g., Q(n−8) node) of any one of the block stages B and the M node according to the fifth BDI clock BCLK5, a transistor T53C turning on/off a current flow between the input terminal of the high potential power supply voltage GVDD and the Q node according to the sixth BDI clock BCLK6, a transistor T52C turning on/off a current flow between the input terminal of the high potential power supply voltage GVDD and the transistor T53C according to a voltage of the M node, a transistor T55C turning on/off a current flow between the Q node and the input terminal of the low potential power supply voltage GVSS according to the fourth BDI clock BCLK4, and a transistor T54C turning on/off a current flow between the Q node and the transistor T55C according to the voltage of the M node.

The fifth BDI clock BCLK5 is input to a gate electrode of the transistor T51C and a first electrode and a second electrode of the transistor T51C are connected to a Q node (e.g., Q(n−8) node) of any one of the block stages B and the M node. A gate electrode of the transistor T52C is connected to the M node, and a first electrode and a second electrode of the transistor T52C are connected to the input terminal of the high potential power supply voltage GVDD and one electrode of the transistor T53C. The sixth BDI clock BCLK6 is input to a gate electrode of the transistor T53C, and a first electrode and a second electrode of the transistor T53C are connected to the second electrode of the transistor T52C and the Q node. A gate electrode of the transistor T54C is connected to the M node, and a first electrode and a second electrode of the transistor T54C are connected to the Q node and one electrode of the transistor T55C. The fourth BDI clock BCLK4 is input to a gate electrode of the transistor T55C and a first electrode and a second electrode of the transistor T55C are connected to the second electrode of the transistor T54C and the input terminal of the low potential power supply voltage GVSS.

The third data memory PAT6 stores the IDW carry signal CR(n−4) input from any one of the B block stages at the M node, and discharges the M node to the gate-off voltage according to the IDW carry signal CR(n−4) input from any one of the A block stages.

The third data memory PAT6 includes a transistor T61C diode-connected to the input terminal of the IDW carry signal CR(n−4) input from any one of the B block stages, a transistor T62C turning on/off a current flow between the M node and the input terminal of the low potential power supply voltage GVSS according to the IDW carry signal CR(n+4) input from any one of the A block stages, and a capacitor CC connected between the M node and the input terminal of the low potential power supply voltage GVSS.

A gate electrode of the transistor T61C is connected to the input terminal of the IDW carry signal CR(n−4), and a first electrode and a second electrode of the transistor T61C are connected to the input terminal of the IDW carry signal CR(n−4). A gate electrode of the transistor T62C is connected to the input terminal of the IDW carry signal CR(n+4), and a first electrode and a second electrode of the transistor T62C are connected to the M node and the input terminal of the low potential power supply voltage GVSS. The capacitor CC maintains the BDI carry signal and the data carry signal charged in the M node for a predetermined time.

FIG. 25 is a detailed waveform view illustrating operations of the A blocks, B blocks, and C blocks illustrated in FIG. 21. In FIG. 25, the scan clocks SCCLK1~8, the BDI clocks BCLK1~6, and the BDI start signal BVST swing between a relatively high gate-on voltage and a relatively low gate-off voltage. Also, voltages of the M node swing between the gate-on voltage and the gate-off voltage. Also, the voltages of the Q node swing between the gate-on voltage and the gate-off voltage, and in particular, increase to a boosting voltage in synchronization with the scan clocks SCCLK1~8. The boosting voltage is higher than the gate-on voltage.

Referring to FIGS. 21 to 25, when BDI driving is performed in the A block (#1~8), IDW driving is performed in the C block (#1073~1080). Subsequently, when BDI driving is performed in the B block (#9~16), IDW driving is performed in the A block (#1081~1088). Subsequently, when BDI driving is performed in the C block (#17~24), IDW driving is performed in the B block (#1089~1096).

To this end, during an interval ①, the M node of the A block (#1~8) is charged with the BDI start signal BVST of the gate-on voltage (or the previous stage Q(n−8) node voltage) according to the first BDI clock BCLK1. The BDI start signal BVST (or the previous stage Q(n−8) node voltage) becomes a BDI carry signal. The M node of A block (#1~8) store the BDI carry signal from the interval ① to an interval ③ to maintain the charged state.

Subsequently, between the interval ① and the interval ②, IDW driving is performed in the C block (#1073~1080). The C block outputs some (SCCLK1~4) of the IDW scan clocks, as scan signals for image writing.

Subsequently, during the interval ②, the Q node of the C block (#1073 to 1080) is discharged to the gate-off voltage according to the fourth BDI clock BCLK4. The Q node of the C block (#1073~1080) maintains the gate-off voltage from the interval ② to the interval ③ according to the fourth BDI clock BCLK4. Here, the IDW carry signal is stored at the third data memory of the C block (#1073~1080).

Subsequently, during the interval ②, according to the second BDI clock BCLK2, the Q node of the A block (#1~8) is connected to the M node and charged with the gate-on voltage.

Subsequently, during the interval ③, the Q node of the A block (#1~8) is bootstrapped in synchronization with the BDI scan clocks of the first scan clock group (SCCLK1~8), and as a result, the A block (#1~8) is BDI-driven. That is, the A block (#1~8) outputs the BDI scan clocks of the first scan clock group (SCCLK1~8) as scan signals for black writing. Here, the M node of the B block (#9~16) is charged with the Q node voltage of the A block (#1~8) of the gate-on voltage according to the third BDI clock BCLK3.

Subsequently, during the interval ④, the Q node of the A block (#1~8) is discharged to the gate-off voltage according to the sixth BDI clock BCLK6. Also, during the interval ④, the Q node of the C block (#1073~1080) is connected to the M node and charged with the gate-on voltage according to the sixth BDI clock BCLK6.

Subsequently, during the interval ⑤, the M node of the A block (#1~8) is discharged to the BDI start signal BVST of the gate-off voltage (or previous stage Q(n−8) node voltage) according to the first BDI clock BCLK1.

Meanwhile, in the C block (#1073~1081), IDW driving is temporarily stopped during the ②, ③, and ④ intervals. This is to prevent a collision between a data voltage for IDW (or IDW data voltage) and a data voltage for BDI (or BDI data voltage). In the C block (#1073~1080), IDW driving is resumed at the ⑤ interval. The C block (#1073~1080) outputs the remaining (SCCLK5~8) among the IDW scan clocks of the scan clock group (SCCLK1~8) as scan signals for image writing.

In this manner, the BDI scan clocks are input to A block while IDW scan clocks are being input to C block, the BDI scan clocks are input to B block while IDW scan clocks are being input to A block, and the BDI scan clocks are input to the C block while the IDW scan clocks are being input to the B block.

Unlike the first aspect, in the third aspect, the A, B and C blocks share the scan clock lines, and thus, it is necessary to reset the block which has been IDW-driven in addition to a charge time of the Q node for BDI driving.

Accordingly, while the BDI scan clocks are being input to the A block, the Q nodes of the stages belonging to the C block are discharged to the gate-off voltage and the IDW carry signal is stored at the C block. While the BDI scan clocks are being input to the B block, the Q nodes of the stages belonging to the A block are discharged to the gate-off voltage and the IDW carry signal is stored at the A block. While the BDI scan clocks are being input to the C block, the Q nodes of the stages belonging to the B block are discharged to the gate-off voltage and the IDW carry signal is stored at the B block.

Also, for sequential BDI driving, the BDI carry signal is stored at the B block in synchronization with the timing at which the BDI scan clocks are input to the A block, the BDI carry signal is stored at the C block in synchronization with the timing at which the BDI scan clocks are input to the B block, and the BDI carry signal is stored at the A block in synchronization with the timing at which the BDI scan clocks are input to the C block.

According to the aspects of the present disclosure described above, the present disclosure has the following advantages.

In the present disclosure, since the clock lines for writing an input image and the clock lines for writing a black image are not separated but used in common, the number of clock lines is reduced, and since the scan signal, the sense signal, and the carry signal are all generated through the same gate shift registers, a mounting area of the number of the gate shift registers may be significantly reduced.

Furthermore, the present disclosure may further reduce the number of clock lines by implementing the BDI memory in each stage of the gate shift register.

Furthermore, the present disclosure may further reduce the number of clock lines by implementing the BDI memory and the image data memory in each stage of the gate shift register.

Furthermore, the present disclosure may further reduce the number of clock lines by replacing the BDI reset signal with the BDI clock signal, as well as by implementing the BDI memory and the image data memory in each stage of the gate shift register.

While the present disclosure has been illustrated and described in connection with the aspects, it will be apparent to those skilled in the art that modifications and variations can be made without departing from the spirit and scope of the disclosure as defined by the appended claims.

What is claimed is:

1. A gate driver comprising:

a gate shift register in which an A block and a B block each having a plurality of stages, the A block and the B block alternately arranged;

scan clock lines configured to input a first scan clock group and a second scan clock group each including image data writing (IDW) scan clocks synchronized with an image write timing and black data insertion (BDI) scan clocks synchronized with a black write timing to the A block and the B block;

carry clock lines configured to input carry clocks to the A block and the B block;

sense clock lines configured to input sense clocks to the A block and the B block, wherein each of the number of the carry clock lines and the number of the sense clock lines is half of the number of the scan clock lines, and each of the stages belonging to the A block and the B block includes a BDI memory storing a BDI carry signal for outputting the BDI scan clocks, BDI clock lines configured to input a first BDI clock group to the A block and to input a second BDI clock group to the B block;

a BDI start line configured to input a BDI start signal to the A block and the B block; and a BDI reset line configured to input a BDI reset signal to the A block and the B block, wherein each stage of the A block comprises a first BDI memory charging an M node with a gate-on voltage according to a first BDI clock belonging to a first BDI clock group, applying the charged voltage of the M node to the Q node according to a second BDI clock belonging to the first BDI clock group, and discharging the Q node to a gate-off voltage according to the BDI reset signal, and wherein the first BDI memory comprises, a first transistor turning on/off a current flow between a Q node of any one of the B block stages and the M node according to the first BDI clock;

a third transistor turning on/off a current flow between an input terminal of a high-potential power supply voltage and the Q node according to the second BDI clock;

a second transistor turning on/off a current flow between the input terminal of the high-potential power supply voltage and the third transistor according to a voltage of the M node;

a fifth transistor turning on/off a current flow between the Q node and an input terminal of a low-potential power supply voltage according to the BDI reset signal;

a fourth transistor turning on/off a current flow between the Q node and the fifth transistor according to the voltage of the M node; and a capacitor connected between the M node and the input terminal of the low-potential power supply voltage.

2. The gate driver of claim 1, wherein the BDI carry signal includes one of a BDI start signal and a Q node voltage in any one of previous stages.

3. The gate driver of claim 1, wherein the BDI scan clocks are input to the B block while the IDW scan clocks are input to the A block, and the BDI scan clocks are input to the A block while the IDW scan clocks are input to the B block.

4. The gate driver of claim 3, wherein Q nodes of the stages belonging to the B block maintain a gate-on voltage while the BDI scan clocks are input to the A block, and wherein Q nodes of the stages belonging to the A block maintain a gate-on voltage while the BDI scan clocks are input to the B block.

5. The gate driver of claim 3, wherein the BDI carry signal is stored at the B block in synchronization with a timing at which the BDI scan clocks are input to the A block, and where the BDI carry signal is stored at the A block in synchronization with a timing at which the BDI scan clocks are input to the B block.

6. The gate driver of claim 1, wherein each stage of the B block includes:

a second shift register unit outputting IDW scan clocks belonging to the second scan clock group, as a scan signal for image writing, outputting BDI scan clocks belonging to the second scan clock group, as a scan signal for black writing, outputting the carry clocks as a carry signal for image writing, and outputting the sense clocks as a sense signal for image writing, during a period in which a Q node thereof is activated by a gate-on voltage; and a second BDI memory charging the M node with the gate-on voltage according to a third BDI clock belonging to the second BDI clock group, applying the charged voltage of the M node to the Q node according to a fourth BDI clock belonging to the second BDI clock group, and discharging the Q node to the gate-off voltage according to the BDI reset signal.

7. The gate driver of claim 6, wherein the second BDI memory includes:

a first transistor turning on/off a current flow between a Q node of any one of the A block stages and the M node according to the third BDI clock;

a third transistor turning on/off a current flow between an input terminal of a high-potential power supply voltage and the Q node according to the fourth BDI clock;

a second transistor turning on/off a current flow between the input terminal of the high-potential power supply voltage and the third transistor according to a voltage of the M node;

a fifth transistor turning on/off a current flow between the Q node and an input terminal of a low-potential power supply voltage according to the BDI reset signal;

a fourth transistor turning on/off a current flow between the Q node and the fifth transistor according to the voltage of the M node; and a capacitor connected between the M node and the input terminal of the low-potential power supply voltage.

8. A gate driver comprising:

a gate shift register in which an A block, a B block, and a C block each having a plurality of stages, the A block and the B block and the C block being alternately arranged;

scan clock lines configured to input a scan clock group including both image data writing (IDW) scan clocks synchronized with an image write timing and black data insertion (BDI) scan clocks synchronized with a black write timing to the A block, the B block, and the C block;

carry clock lines configured to input carry clocks to the A block, the B block, and the C block;

sense clock lines configured to input sense clocks to the A block, the B block, and the C block, wherein the number of scan clock lines, the number of the carry clock lines, and the number of the sense clock lines are the same, each of the stages belonging to the A block, the B block, and the C block includes a BDI memory storing a BDI carry signal for outputting the BDI scan clocks and a data memory storing an IDW carry signal for outputting IDW scan clocks, BDI clock lines inputting a first BDI clock group to the A block, inputting a second BDI clock group to the B block, and inputting the third BDI clock group to the C block;

a BDI start line inputting a BDI start signal to the A block, the B block, and the C block; and a BDI reset line inputting a BDI reset signal to the A block, the B block, and the C block, wherein each stage of the A block includes:

a first shift register unit outputting IDW scan clocks belonging to the scan clock group, as a scan signal for image writing, outputting BDI scan clocks belonging to the scan clock group, as a scan signal for black writing, outputting the carry clocks as a carry signal for image writing, and outputting the sense clocks as a sense signal for image writing, during a period in which a Q node thereof is activated by a gate-on voltage;

a first BDI memory charging an M node with a gate-on voltage according to a first BDI clock belonging to the first BDI clock group, applying the charged voltage of the M node to the Q node according to a second BDI clock belonging to the first BDI clock group, and discharging the Q node to a gate-off voltage according to the BDI reset signal; and a first data memory storing the IDW carry signal input from any one of the C block stages at the M node and discharging the M node to a gate-off voltage according to the IDW carry signal input from any one of the B block stages, wherein the first BDI memory includes:

a first transistor turning on/off a current flow between a Q node of any one of the C block stages and the M node according to the first BDI clock;

a third transistor turning on/off a current flow between an input terminal of a high-potential power supply voltage and the Q node according to the second BDI clock;

a second transistor turning on/off a current flow between the input terminal of the high-potential power supply voltage and the third transistor according to a voltage of the M node;

a fifth transistor turning on/off a current flow between the Q node and an input terminal of a low-potential power supply voltage according to the BDI reset signal; and a fourth transistor turning on/off a current flow between the Q node and the fifth transistor according to the voltage of the M node, and wherein the first data memory includes:

a first transistor diode-connected to an input terminal of the IDW carry signal input from any one of the C block stages;

a second transistor turning on/off a current flow between the M node and the input terminal of the low-potential power supply voltage according to the IDW carry signal input from any one of the B block stages; and a capacitor connected between the M node and the input terminal of the low-potential power supply voltage.

9. The gate driver of claim 8, wherein the BDI carry signal is either a BDI start signal or a Q node voltage of any one of previous stages, and wherein the IDW carry signal is either an IDW start signal or an IDW carry signal of any one of the previous stages.

10. The gate driver of claim 8, wherein the BDI scan clocks are input to the A block while the IDW scan clocks are being input to the C block, the BDI scan clocks are input to the B block while the IDW scan clocks are being input to the A block, and the BDI scan clocks are input to the C block while the IDW scan clocks are being input to the B block.

11. The gate driver of claim 10, wherein Q nodes of the stages belonging to the C block are discharged to a gate-off voltage and the IDW carry signal is stored at the C block, while the BDI scan clocks are being input to the A block, wherein Q nodes of the stages belonging to the A block are discharged to the gate-off voltage and the IDW carry signal is stored at the A block, while the BDI scan clocks are being input to the B block, and Q nodes of the stages belonging to the B block are discharged to a gate-off voltage and the IDW carry signal is stored at the B block, while the BDI scan clocks are being input to the C block.

12. The gate driver of claim 10, wherein the BDI carry signal is stored at the B block in synchronization with a timing at which the BDI scan clocks are input to the A block, the BDI carry signal is stored at the C block in synchronization with a timing at which the BDI scan clocks are input to the B block, and the BDI carry signal is stored at the A block in synchronization with a timing at which the BDI scan clocks are input to the C block.

13. The gate driver of claim 8, wherein each stage of the B block comprises:

a second shift register unit outputting IDW scan clocks belonging to the scan clock group, as a scan signal for image writing, outputting BDI scan clocks belonging to the scan clock group, as a scan signal for black writing, outputting the carry clocks as a carry signal for image writing, and outputting the sense clocks as a sense signal for image writing, during a period in which a Q node thereof is activated by a gate-on voltage;

a second BDI memory charging the M node with the gate-on voltage according to a third BDI clock belonging to the second BDI clock group, applying the charged voltage of the M node to the Q node according to a fourth BDI clock belonging to the second BDI clock group, and discharging the Q node to the gate-off voltage according to the BDI reset signal; and a second data memory storing, at the M node, the IDW carry signal input from any one of the A block stages and discharging the M node to a gate-off voltage according to the IDW carry signal input from any one of the C block stages.

14. The gate driver of claim 13, wherein the second BDI memory comprises:

a first transistor turning on/off a current flow between a Q node of any one of the A block stages and the M node according to the third BDI clock;

a third transistor turning on/off a current flow between an input terminal of a high-potential power supply voltage and the Q node according to the fourth BDI clock;

a second transistor turning on/off a current flow between the input terminal of the high-potential power supply voltage and the third transistor according to a voltage of the M node;

a fifth transistor turning on/off a current flow between the Q node and an input terminal of a low-potential power supply voltage according to the BDI reset signal; and a fourth transistor turning on/off a current flow between the Q node and the fifth transistor according to the voltage of the M node, and the second data memory includes:

a first transistor diode-connected to the input terminal of the IDW carry signal input from any one of the A block stages;

a second transistor turning on/off a current flow between the M node and the input terminal of the low-potential power supply voltage according to the IDW carry signal input from any one of the C block stages; and a capacitor connected between the M node and the input terminal of the low-potential power supply voltage.

15. The gate driver of claim 8, wherein each stage of the C block includes:

a third shift register unit outputting IDW scan clocks belonging to the scan clock group, as a scan signal for image writing, outputting BDI scan clocks belonging to the scan clock group, as a scan signal for black writing, outputting the carry clocks as a carry signal for image writing, and outputting the sense clocks as a sense signal for image writing, during a period in which a Q node thereof is activated by a gate-on voltage;

a third BDI memory charging the M node with the gate-on voltage according to a fifth BDI clock belonging to the third BDI clock group, applying the charged voltage of the M node to the Q node according to a sixth BDI clock belonging to the third BDI clock group, and discharging the Q node to the gate-off voltage according to the BDI reset signal; and a third data memory storing, at the M node, the IDW carry signal input from any one of the B block stages and discharging the M node to a gate-off voltage according to the IDW carry signal input from any one of the A block stages.

16. The gate driver of claim 15, wherein the third BDI memory comprises:

a first transistor turning on/off a current flow between a Q node of any one of the B block stages and the M node according to the fifth BDI clock;

a third transistor turning on/off a current flow between an input terminal of a high-potential power supply voltage and the Q node according to the fourth BDI clock;

a second transistor turning on/off a current flow between the input terminal of the high-potential power supply voltage and the third transistor according to a voltage of the M node;

a fifth transistor turning on/off a current flow between the Q node and an input terminal of a low-potential power supply voltage according to the BDI reset signal; and a fourth transistor turning on/off a current flow between the Q node and the fifth transistor according to the voltage of the M node, and the third data memory includes:

a first transistor diode-connected to the input terminal of the IDW carry signal input from any one of the B block stages;

a second transistor turning on/off a current flow between the M node and the input terminal of the low-potential power supply voltage according to the IDW carry signal input from any one of the A block stages; and a capacitor connected between the M node and the input terminal of the low-potential power supply voltage.

17. The gate driver of claim 16, wherein the second BDI memory comprises:

a first transistor turning on/off a current flow between a Q node of any one of the A block stages and the M node according to the third BDI clock;

a third transistor turning on/off a current flow between an input terminal of a high-potential power supply voltage and the Q node according to the fourth BDI clock;

a second transistor turning on/off a current flow between the input terminal of the high-potential power supply voltage and the third transistor according to a voltage of the M node;

a fifth transistor turning on/off a current flow between the Q node and an input terminal of a low-potential power supply voltage according to the second BDI clock; and a fourth transistor turning on/off a current flow between the Q node and the fifth transistor according to the voltage of the M node, and wherein the second data memory comprises:

a first transistor diode-connected to the input terminal of the IDW carry signal input from any one of the A block stages;

a second transistor turning on/off a current flow between the M node and the input terminal of the low-potential power supply voltage according to the IDW carry signal input from any one of the C block stages; and a capacitor connected between the M node and the input terminal of the low-potential power supply voltage.

18. The gate driver of claim 15, wherein the third BDI memory comprises:

a first transistor turning on/off a current flow between a Q node of any one of the B block stages and the M node according to the fifth BDI clock;

a third transistor turning on/off a current flow between an input terminal of a high-potential power supply voltage and the Q node according to the fourth BDI clock;

a second transistor turning on/off a current flow between the input terminal of the high-potential power supply voltage and the third transistor according to a voltage of the M node;

a fifth transistor turning on/off a current flow between the Q node and an input terminal of a low-potential power supply voltage according to the fourth BDI clock; and a fourth transistor turning on/off a current flow between the Q node and the fifth transistor according to the voltage of the M node, and wherein the third data memory comprises:

a first transistor diode-connected to the input terminal of the IDW carry signal input from any one of the B block stages;

a second transistor turning on/off a current flow between the M node and the input terminal of the low-potential power supply voltage according to the IDW carry signal input from any one of the A block stages; and a capacitor connected between the M node and the input terminal of the low-potential power supply voltage.

19. The gate driver of claim 8, further comprising:

BDI clock lines inputting a first BDI clock group to the A block, inputting a second BDI clock group to the B block, and inputting the third BDI clock group to the C block; and a BDI start line inputting a BDI start signal to the A block, the B block, and the C block.

20. The gate driver of claim 19, wherein each stage of the A block comprises:

a first shift register unit outputting IDW scan clocks belonging to the scan clock group, as a scan signal for image writing, outputting BDI scan clocks belonging to the scan clock group, as a scan signal for black writing, outputting the carry clocks as a carry signal for image writing, and outputting the sense clocks as a sense signal for image writing, during a period in which a Q node thereof is activated by a gate-on voltage;

a first BDI memory charging an M node with a gate-on voltage according to a first BDI clock belonging to the first BDI clock group, applying the charged voltage of the M node to the Q node according to a second BDI clock belonging to the first BDI clock group, and discharging the Q node to a gate-off voltage according to a sixth BDI clock belonging to the first BDI clock group; and a first data memory storing the IDW carry signal input from any one of the C block stages at the M node and discharging the M node to a gate-off voltage according to the IDW carry signal input from any one of the B block stages.

21. The gate driver of claim 20, wherein the first BDI memory comprises:

a first transistor turning on/off a current flow between a Q node of any one of the C block stages and the M node according to the first BDI clock;

a third transistor turning on/off a current flow between an input terminal of a high-potential power supply voltage and the Q node according to the second BDI clock;

a second transistor turning on/off a current flow between the input terminal of the high-potential power supply voltage and the third transistor according to a voltage of the M node;

a fifth transistor turning on/off a current flow between the Q node and an input terminal of a low-potential power supply voltage according to the sixth BDI clock; and a fourth transistor turning on/off a current flow between the Q node and the fifth transistor according to the voltage of the M node, and wherein the first data memory comprises:

a first transistor diode-connected to an input terminal of the IDW carry signal input from any one of the C block stages;

a second transistor turning on/off a current flow between the M node and the input terminal of the low-potential power supply voltage according to the IDW carry signal input from any one of the B block stages; and a capacitor connected between the M node and the input terminal of the low-potential power supply voltage.

22. The gate driver of claim 19, wherein each stage of the B block comprises:

a second shift register unit outputting IDW scan clocks belonging to the scan clock group, as a scan signal for image writing, outputting BDI scan clocks belonging to the scan clock group, as a scan signal for black writing, outputting the carry clocks as a carry signal for image writing, and outputting the sense clocks as a sense signal for image writing, during a period in which a Q node thereof is activated by a gate-on voltage;

a second BDI memory charging the M node with the gate-on voltage according to a third BDI clock belonging to the second BDI clock group, applying the charged voltage of the M node to the Q node according to a fourth BDI clock belonging to the second BDI clock group, and discharging the Q node to the gate-off voltage according to a second BDI clock belonging to the second BDI clock group; and a second data memory storing, at the M node, the IDW carry signal input from any one of the A block stages and discharging the M node to a gate-off voltage according to the IDW carry signal input from any one of the C block stages.

23. The gate driver of claim 19, wherein each stage of the C block comprises:

a third shift register unit outputting IDW scan clocks belonging to the scan clock group, as a scan signal for image writing, outputting BDI scan clocks belonging to the scan clock group, as a scan signal for black writing, outputting the carry clocks as a carry signal for image writing, and outputting the sense clocks as a sense signal for image writing, during a period in which a Q node thereof is activated by a gate-on voltage;

a third BDI memory charging the M node with the gate-on voltage according to a fifth BDI clock belonging to the third BDI clock group, applying the charged voltage of the M node to the Q node according to a sixth BDI clock belonging to the third BDI clock group, and discharging the Q node to the gate-off voltage according to a fourth BDI clock belonging to the third BDI clock group; and a third data memory storing, at the M node, the IDW carry signal input from any one of the B block stages and discharging the M node to a gate-off voltage according to the IDW carry signal input from any one of the A block stages.

* * * * *